US005552851A

United States Patent [19]

Koboshi et al.

[11] Patent Number: 5,552,851

[45] Date of Patent: Sep. 3, 1996

[54] AUTOMATIC PROCESSING MACHINE FOR SILVER HALIDE PHOTOGRAPHIC LIGHT-SENSITIVE MATERIALS

[75] Inventors: Shigeharu Koboshi; Masao Ishikawa; Yoshimasa Komatsu; Hideo Ishii; Yorikatsu Miyazawa; Yoshifumi Tsubaki; Kaneo Saito; Hiroshi Yoshimoto, all of Hino, Japan

[73] Assignee: Konica Corporation, Tokyo, Japan

[21] Appl. No.: 561,495

[22] Filed: Nov. 20, 1995

Related U.S. Application Data

[62] Division of Ser. No. 382,894, Feb. 2, 1995, which is a division of Ser. No. 142,796, Oct. 25, 1993, Pat. No. 5,400,105.

[30] Foreign Application Priority Data

| | | | |
|---|---|---|---|
| Oct. 30, 1992 | [JP] | Japan | 4-293271 |
| Oct. 30, 1992 | [JP] | Japan | 4-293274 |
| Nov. 11, 1992 | [JP] | Japan | 4-301432 |

[51] Int. Cl.[6] ..... G03D 3/02; G03D 13/00

[52] U.S. Cl. ..... 354/298; 354/324

[58] Field of Search ..... 354/298, 324, 354/331, 336; 430/30, 398, 399, 400, 450, 465

[56] References Cited

U.S. PATENT DOCUMENTS

| | | | |
|---|---|---|---|
| 4,705,377 | 11/1987 | Kobayashi et al. | 354/322 |
| 4,705,379 | 11/1987 | Kobayashi et al. | 354/324 |
| 4,839,273 | 6/1989 | Yamada et al. | 430/399 X |
| 4,857,950 | 8/1989 | Takase et al. | 354/324 |
| 5,040,013 | 8/1991 | Kurokawa et al. | 354/322 |
| 5,240,822 | 8/1993 | Tanaka et al. | 430/450 |
| 5,318,061 | 7/1994 | Saito | 354/324 |
| 5,336,586 | 8/1994 | Ueda | 430/465 |
| 5,347,336 | 9/1994 | Yamada et al. | 354/324 |
| 5,351,103 | 9/1994 | Komatsu et al. | 354/324 |

FOREIGN PATENT DOCUMENTS

| | | | |
|---|---|---|---|
| 0537365A1 | 4/1993 | European Pat. Off. . | |
| 62-273537 | 11/1987 | Japan . | |
| 63-88548 | 4/1988 | Japan . | |
| 9220013 | 11/1992 | WIPO | 354/324 |

*Primary Examiner*—D. Rutledge

*Attorney, Agent, or Firm*—Frishauf, Holtz, Goodman, Langer & Chick

[57] ABSTRACT

In an apparatus for processing a light-sensitive silver halide photographic material, there is provided a solid agent replenishing device to store a package in which a solid agent is packed in a moistureproofing manner. The replenishing device releases the solid agent from the package so as to directly replenish the solid agents to the processing tank.

11 Claims, 40 Drawing Sheets

SOLUBILITY TEST UNIT ( A )

SOLUBILITY TEST UNIT ( B )

FIG. 16 (A)
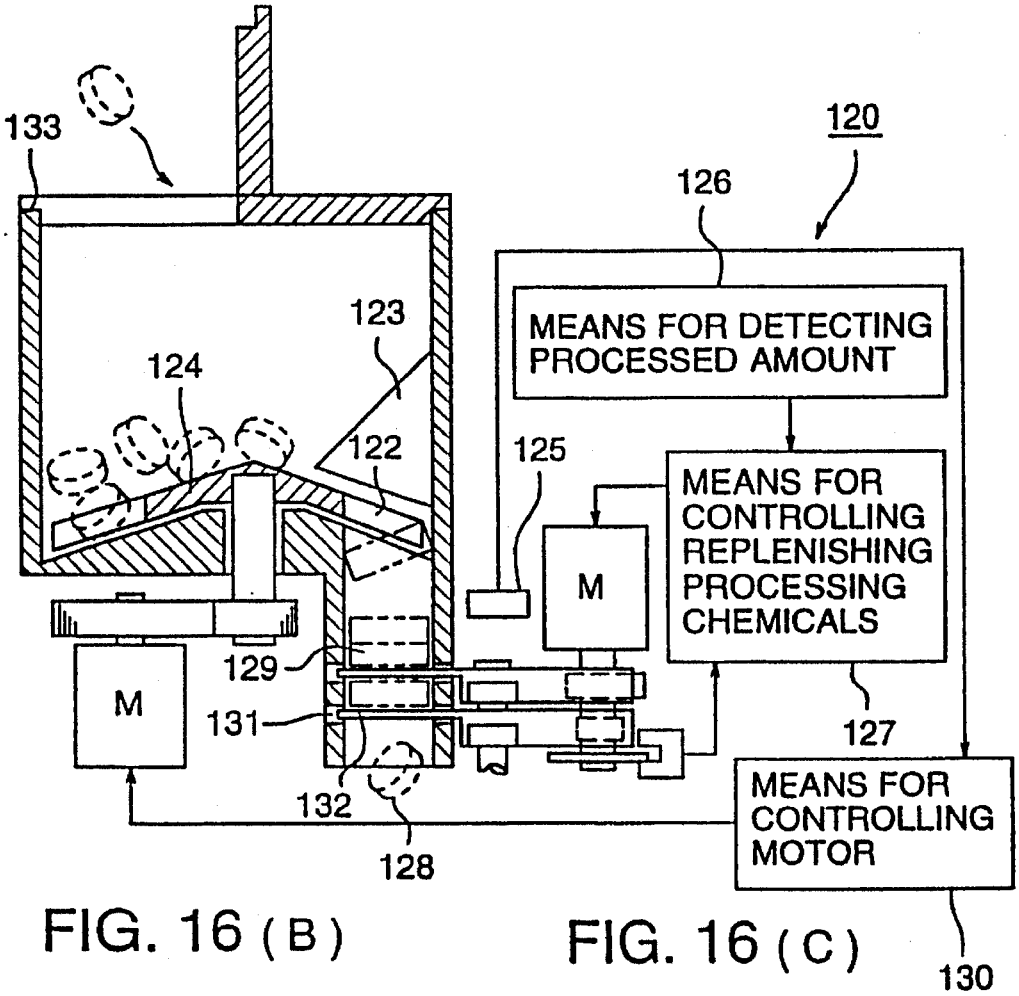
FIG. 16 (B)
FIG. 16 (C)
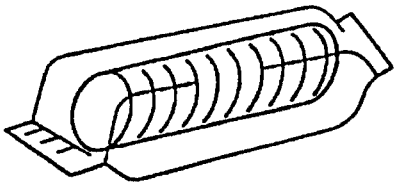
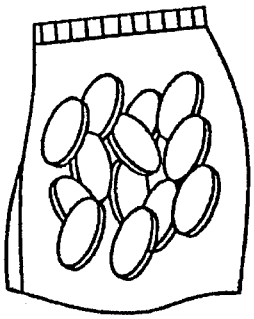

FIG. 20 ( A )
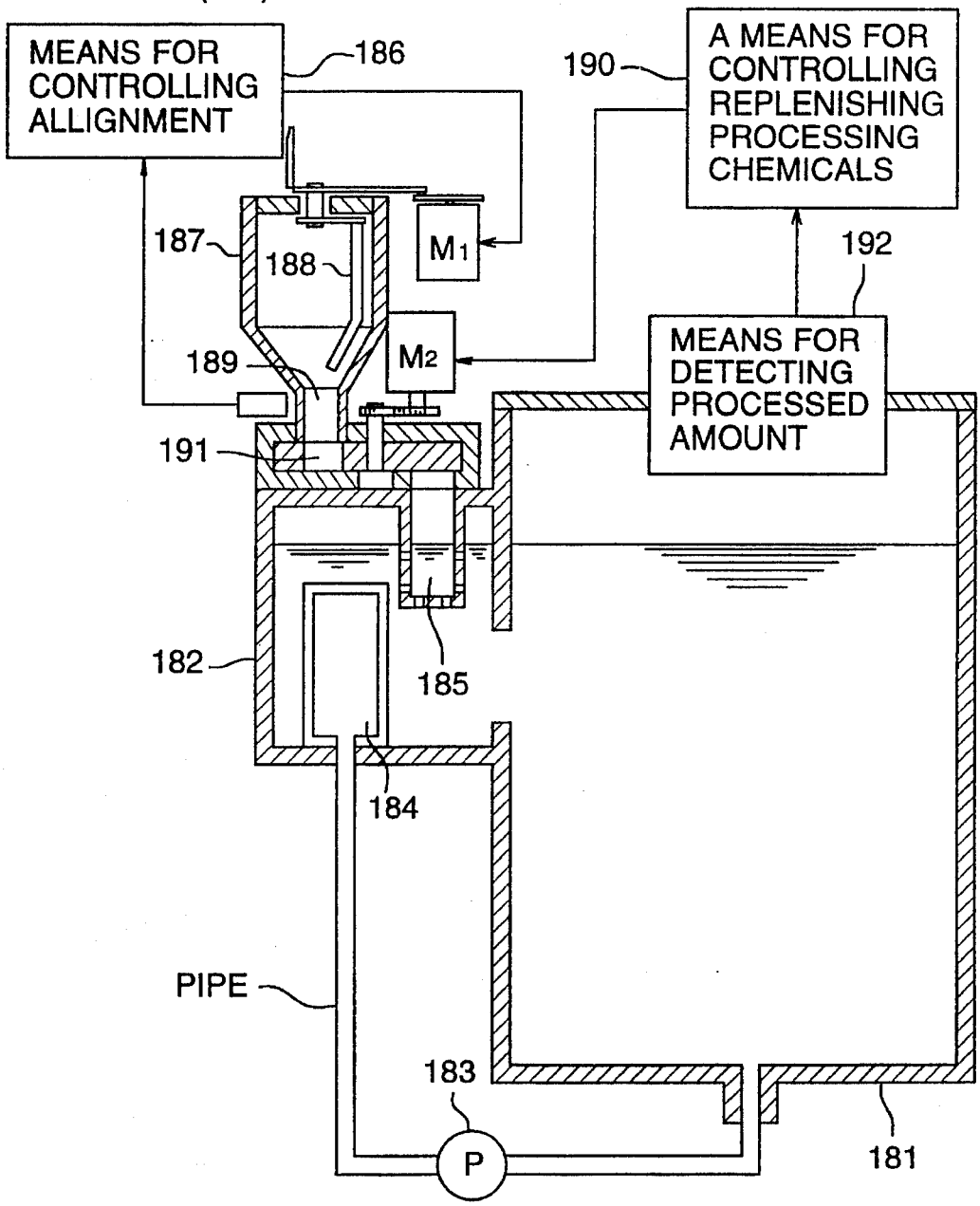
FIG. 20 ( B )
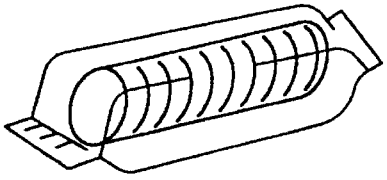
FIG. 20 ( C )
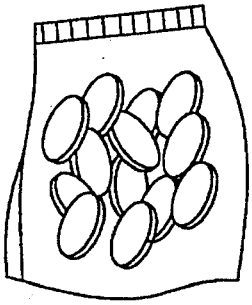

FIG. 23 ( A )
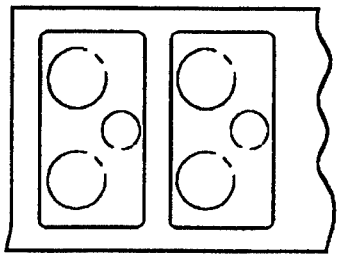
FIG. 23 ( B )
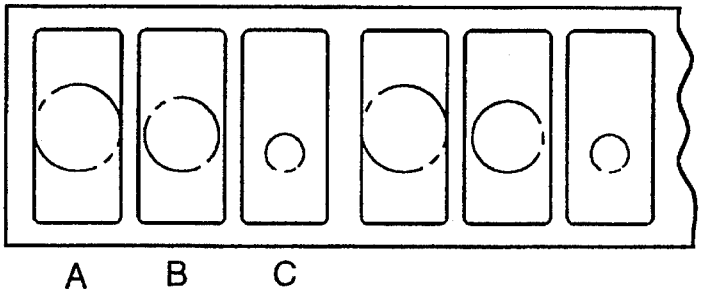
FIG. 23 ( C )
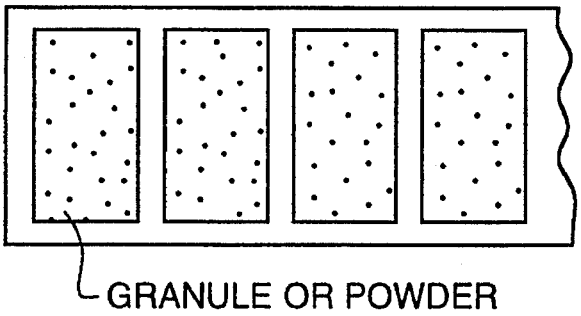
FIG. 23 ( D )
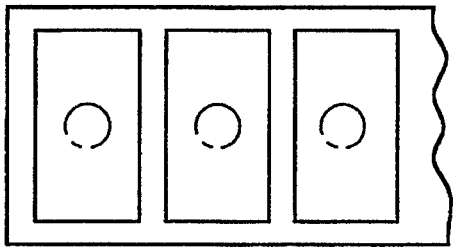
FIG. 23 ( E )
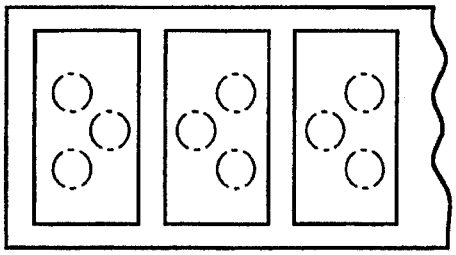

FIG. 32 ( A )
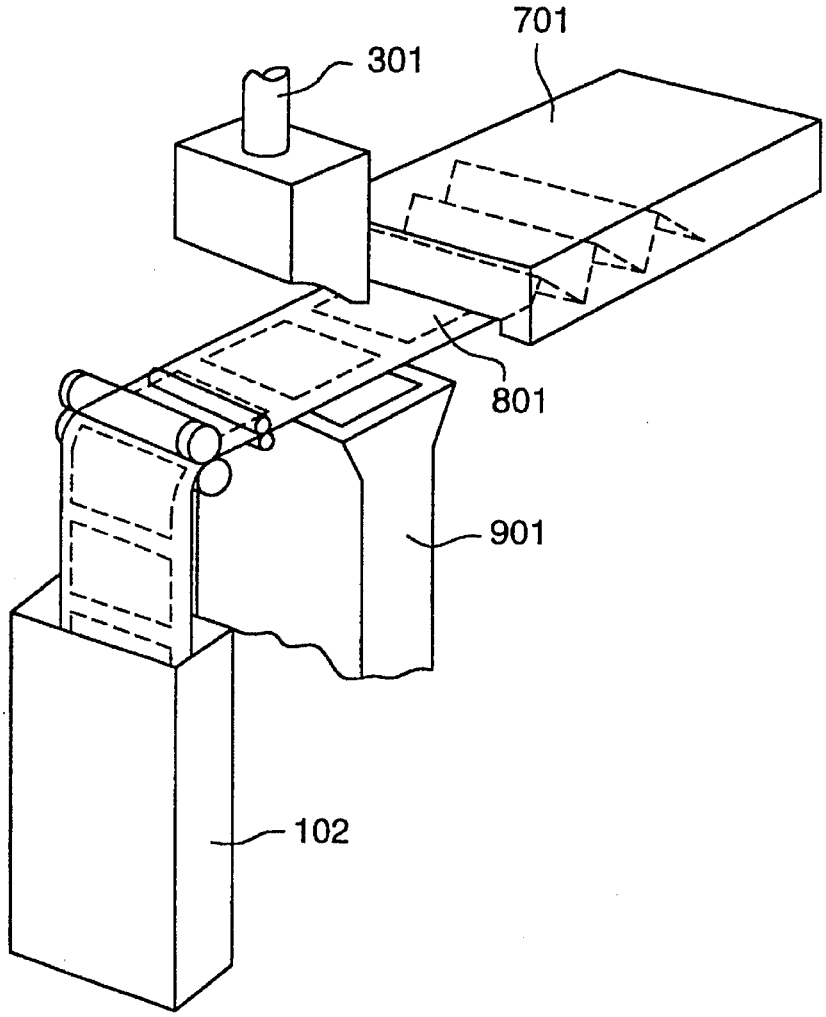
FIG. 32 ( B )
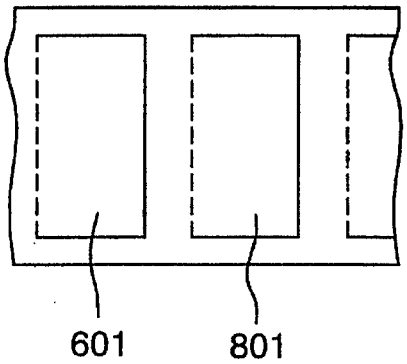

AUTOMATIC PROCESSING MACHINE FOR SILVER HALIDE PHOTOGRAPHIC LIGHT-SENSITIVE MATERIALS

This application is a Division of application Ser. No. 08/382,894, filed Feb. 2, 1995, which is a Divisional of U.S. application Ser. No. 08/142,796, filed Oct. 25, 1993 (now U.S. Pat. No. 5,400,105).

FIELD OF THE INVENTION

The present invention relates to an automatic processing machine for silver halide photographic light-sensitive materials, more specifically a compact automatic processing machine offering markedly improved operability free of dissolving operation and remarkably improved chemical stability.

BACKGROUND OF THE INVENTION

Silver halide color photographic light-sensitive materials (hereinafter also referred to as light-sensitive materials or photographic materials) are processed in developing, desilvering, washing, stabilizing and other processes after exposure. Silver halide black-and-white photographic light-sensitive materials are developed and fixed after exposure. A black-and-white developer or a color developer, a bleacher or a bleach-fixer, a fixer, tap water or deionized water, a stabilizing solution and a dye stabilizer are used for development, desilvering, fixing, washing, waterless washing and dye stabilization, respectively.

The liquids capable of performing these processes are called processing solutions. Each processing solution is usually kept at a temperature of 30° to 40° C. in which the light-sensitive material is immersed and processed.

These processes are usually carried .out by sequentially transporting the light-sensitive material through processing tanks containing the above processing solutions, using an automatic processing machine or another means.

The automatic processing machine mentioned herein is generally a processing machine having a developing portion, a fixing portion, a desilvering portion, a washing or stabilizing portion and a drying portion, and a means for automatically sequentially transporting the photographic light-sensitive material to the processing tanks.

In carrying out processing using such an automatic processing machine, the processing solution in each processing tank is supplemented with a processing agent to keep the activity of the processing solution in the processing tank constant.

For this purpose, it is common to prepare a replenisher containing the processing agent dissolved therein.

Specifically, processing is carried out while supplying the previously prepared replenisher from the replenisher tank to the processing tank as appropriate.

In this case, it is the common practice to prepare the replenisher itself to be stored in the replenisher tank in a separate place, and in mini-labs etc., the replenisher is usually prepared in a given amount in a replenisher tank made within the processing machine at a time by manual dissolution or mixing dissolution using a mechanical mixer.

The silver halide photographic light-sensitive material processing agent (hereinafter also referred to as photographic processing agent) is supplied in the form of powder or liquid; it is prepared as a solution in a given amount of water in the case of powder. In the case of liquid, it is prepared as a dilution in a given amount of water in the case of liquid, since it is supplied in a concentrated state.

Replenisher tanks may be set by the automatic processing machine, requiring considerable space. Also, in recently-increasing mini-labs, replenisher tanks are housed in the automatic processing machine; in this case as well, sufficient space must be available for the replenisher tanks, each of which should contain at least 5 to 10 liter of replenisher.

Any processing agent for replenishment is divided in some parts to ensure constantly good performance in photographic processing. For example, the color developer replenisher is divided in three or four parts, and the bleach-fixer replenisher for color photography is divided in two parts: a part of the oxidant ferric salt of organic acid and a part of the reducing agent thiosulfate. In preparing the replenisher, said dense part of ferric salt of organic acid and said dense part of thiosulfate are mixed together and diluted with a given amount of water before using.

Said dense parts are placed in containers such as plastic containers, which containers are packed in outer packages, such as corrugated cardboard boxes, for 1 unit of commercial distribution.

The processing agent for replenishment in a kit of part agents is dissolved, diluted, mixed and then diluted to a given volume before using. Said processing agent for replenishment has the following drawbacks:

First, almost all conventional kits comprise dense aqueous solutions concentrated for improved operability, most of which are very dangerous because of high pH values of not more than 2.0 or not less than 12.0 in that they are harmful to the human body by skin contact etc. Also, many of them are strong oxidants or reducing agents, possessing very dangerous corrosivity in transport by ships or aircraft. The aqueous solution is subject to limitation as to solubility, being heavier and bulkier than in the case of solid. Since the concentrated solution is a dangerous article as stated above, its containers must be sufficiently tough to avoid destruction and spillage even if it is fallen; plastic container disposal poses a problem.

Second, the part agents are separately contained in respective containers; some processing agents for replenishment comprise several bottles of part agents so that each unit of commercial distribution thereof involves a considerable number of containers, which requires much space for storage and transportation. For example, the color developer replenishing agent for CPK-2-20QA, a processing solution for color printing paper, is available in 10-liter units, wherein part A (a kit including a preservative), part B (a kit including a color developing agent) and part C (alkaline agent) are each contained in a 500-ml plastic container. Similarly, the bleach-fixer replenisher is available in 8-liter units, wherein three part agents are contained in respective bottles. The stabilizer replenisher is available in 10-liter units, wherein two part agents are contained in respective bottles. These replenishing agents are stored and transported in respective outer packages of various sizes. The outer package size ranges from about 17×14×16.5 cm for the stabilizer replenisher to about 18.5×30.5×22.5 cm for the bleach-fixer replenisher; it is not possible to pile packages of replenishers in storing or transporting them or in stocking them at dealer shops unless they are of the same kind, so that much space, is required.

The third drawback concerns with the problem of waste container disposal. In recent years, there has been strong demand for environmental conservation and saving resources mainly in Europe and the United States; in the photographic industry, plastic container disposal has been of major concern. Specifically, although plastic containers for photographic use are cheap, conveniently storable and transportable and excellent in chemical resistance, they pose problems of accumulation in the environment because they are hardly biodegradable, and emission of large amounts of carbon dioxide upon burning, which contribute to global warming and acid rain. As for the problems posed on the user side, they include decrease in the available working area due to occupation of the narrow working space by crowding plastic containers, which are too tough to compress.

The fourth drawback is poor chemical stability.

Usually, the life time of a replenisher is at most 2 weeks even in the presence of a floating lid. However, with the trend toward replenishing rate reduction, it has recently been often the case where a 10-liter replenisher is used over a period of more than 1 month in a mini-lab receiving an order of 30 rolls of color films daily on average.

In this case, the replenisher in the replenishing tank is often much more frequently in contact with air than the processing solution in the processing tank; often, replenishing has no effect due to replenisher deterioration. Accordingly, attempts have been made to reduce the replenishing tank capacity to 5 liter or reduce the replenishing kit unit to 5 liter. However, this approach involves another drawback of the necessity of additional packing material.

For example, in preparing a color developer replenisher for color printing paper, a given volume of water is placed in the replenisher tank, after which dense kit A, which contains a preservative, is added, followed by stirring, and dense kit B, which contains a color developing agent, is then added, followed by stirring, and dense kit C, which contains an alkaline agent, is then added, followed by stirring, and finally water is added to make a given volume. This series of procedures is liable to be accompanied by some problems. For example, in case of insufficient stirring or a failure to add the starting water, the color developing agent tends to crystalize, and the resulting crystal can stay in the bellows pump and fail to be supplied so that the photographic performance becomes labile or the bellows pump breaks. Also, the dense kits are not always used immediately after production; they may be used even 1 year after production; in some cases, performance becomes labile due to oxidation of the color developing agent or preservative.

The color developer replenisher prepared from dense kits or powder is also known to pose some problems in the replenisher tank. For example, if the replenisher remains unused for a long time, crystals can deposit on the inside wall of the replenisher tank, the replenisher becomes susceptible to oxidation, and tar forms. Under some storage conditions, other problems arise, including separation of easily-crystallizing components of the replenisher, such as the color developing agent, at low temperatures; some makers specify replenisher storage conditions and instruct the users to keep their replenishers under those conditions.

As stated above, when a replenisher, e.g., a color developer replenisher for color printing paper, is prepared using a commonly used dense kit or powder, the above-mentioned problems arise; similar problems arise in the case of bleach-fixer, bleacher and fixer. For example, the bleach-fixer is characterized by considerably poor storage stability. This is because the bleach-fixer is usually of high acidity and considerably low pH for neutralizing the alkalinity of the dye fixer carried over by the printing paper being processed because the bleach-fixing process immediately follows the process with a color developer of high pH. It is said that at low pH values, any bleach-fixer comprising a thiosulfate and an oxidant is considerably poor in storage stability and cannot be replenished at low replenishing rates. The same applies to the fixer and stabilizer.

Another problem is that the replenisher becomes increasingly dense in answer to the recent trend toward replenishing rate reduction and rapid processing; it has recently been a common practice to concentrate the replenisher to the limit of solubility.

This deteriorates replenisher storage stability, thus posing many practical problems such as crystal separation.

On the other hand, in addition to the above method of preparing a replenisher using a dense kit or powder, another method is known wherein a dense kit is added as such.

In this method, supplying means such as a bellows pump are used to supply the dense kit as such directly to the processing tank and a given volume of replenishing water is added independently, to improve the low efficiency in dissolving operation. This method really obviates solution preparing operation and is free of the problem of poor storage stability because no replenisher solution is prepared, in comparison with the above method, wherein the replenisher is prepared from a dense kit or powder.

However, this method also involves many problems. The major problem is the increased size of the automatic processing machine because of the necessity for a dense kit tank for supplying the dense kit and a pump for supplying the dense kit. For example, in the case of CPK-2-20, a processing solution for color printing paper, the dense kit of color developer replenisher is divided in three parts; the dense kit of bleach-fixer replenisher, three parts; and the dense kit of stabilizer replenisher, two parts. To supply all these dense kits, eight tanks and eight pumps are required. In the conventional replenishing method, three tanks and three pumps are sufficient, since each replenisher requires one tank and one pump. In short, more tanks and more pumps than in the conventional method are required for supplying the dense kits, and a pump for water used to prepare the replenisher is also required. Also, since bellows pump precision is not so high, it is difficult to accurately discharge a plurality of solutions simultaneously, which can result in an imbalanced composition.

Moreover, dense kits are difficult to maintain due to proneness to crystallization near the outlet of replenisher nozzle because they are dense solutions. Another problem is that the bellows pump is insufficient in supplying accuracy so that replenishing accuracy fluctuates widely in supplying a dense replenisher, resulting in very labile photographic performance. Still another problem is that the amount of waste plastic containers remains unchanged, in comparison with the conventional replenishing method, even when dense kits are supplied.

In addition to the above methods, some proposals have been made to obviate the use of plastic containers and improve replenisher chemical stability.

For example, Japanese Patent Publication Open to Public Inspection (hereinafter referred to as Japanese Patent O.P.I. Publication) No. 11032/1983 discloses an art wherein developing components are encapsuled in microcapsules; Japanese Patent O.P.I. Publication No. 61837/1976 discloses photographic tablets containing a disintegrating agent. Japanese Patent O.P.I. Publication Nos. 109042/1990, 109043/1990, 39735/1991 and 39739/1991 disclose methods using granular photographic processing agents having a particular average grain size.

The photographic tablets containing a disintegrating agent described in Japanese Patent O.P.I. Publication No. 61837/1976 are merely easily-soluble tablets. This proposal never leads to the idea of the present invention that a solid processing agent is added directly to the processing tank and dissolved therein.

Japanese Patent O.P.I. Publication No..109042/1990 describes a granular photographic processing agent having a particular average grain size.

However, none of these publications proposes an automatic processing machine which has sufficiently simplified operability free of replenisher dissolving operation and which offers stable photographic performance or a compact automatic processing machine having no replenisher tanks.

On the other hand, as a means for obviating the necessity for previous dissolving operation, Japanese Patent O.P.I. Publication No. 11344/1991 discloses an art wherein pasty part agents, in amounts according to the mixing ratio of the part agents, are pushed out from respective unit containers and appropriately diluted at given dilution rates to accurately prepare and supply replenishers. Although this method really reduces or almost obviates the necessity for dissolving operation, pasty part agents are unstable because of the presence of solvent and are difficult to push out in given amounts for long periods, and in addition, when they are used at low frequencies, nozzle clogging tends to occur, which hampers the obtainment of constant photographic performance. Also, paste containers are required, which must be made of a flexible and tough material, usually a composite material, which is usually difficult to recycle and is hence undesirable from the viewpoint of environmental protection. Particularly, pasty chemicals are known to be poor in storage stability due to the use of organic solvent to prepare the paste.

Japanese Utility Model Publication No. 85732/1989 discloses an automatic processing machine having a means for adding a tablet fungicide to the stabilizer, but this never leads to the idea of a processing agent replenishment controlling means, since the fungicide itself poses no problem even in the event of entry in large amounts, and in addition, the addition of such a fungicide is essential, since its purpose is to preserve the stabilizer.

WO 91-07698 and WO 91-07699 disclose a method wherein CD-3 or CD-4 is added in a solid form while the other components added as activators in the form of liquid. However, the relevant patents concern with regeneration, particularly low rate replenishment involving almost no overflow, specifically a method wherein bromide and chloride ions are adsorbed and removed from the developer by means of ion exchange resin, after which the lacking components, namely alkali agent activator and a small amount of solid or liquid dense color developing agent are added while maintaining a constant volume.

The present invention is totally different from the inventions described above in that processing agent replenishment is achieved solely by adding a separately weighed solid processing agent to the processing tank and dissolve it therein, whereby previous replenisher dissolving operation is obviated to ensure maintenance-free operation; the present invention is never expected from the above invention.

A processing agent holding means that houses or affixes moisture-proof-packed processing agent packages, a numerical aperture of a processing tank that is 12 $cm^2/l$ and control of replenishing water in an automatic processing machine employing solid processing agents, are not known.

In a conventional automatic processing machine, drive for a light-sensitive material transport means as well drive for a circulation pump for processing solutions and operation of a heater for a processing solution preparation tank have been stopped upon a termination of passing of a light-sensitive material, namely a termination of development processing. Accordingly, in an automatic processing machine employing solid processing agents such as tablets, in particular, a period of time from the moment of replenishment of solid processing agents to the moment when operations of the light-sensitive material transport means and the circulation pump are stopped after a termination of passing of a light-sensitive material, namely a termination of processing is short, and thereby circulation of solutions tends to be stopped with unsolved processing solutions remaining in a processing solution preparation tank and in a processing tank. In that case, extremely high concentration portions are caused in the processing solution preparation tank and processing tank during the suspended circulation, and when such high concentration portions are circulated again in processing for the following light-sensitive material, they give remarkable concentration unevenness to processing solutions, adversely affecting light-sensitive materials in terms of photographic characteristics. Or, when a developing agent of the processing solution is paraphenylenediamine used for a color developing agent, chemical change such as oxidation tends to be caused on processing agents at the high concentration portions, and thereby, substances which are hardly dissolved in the following circulation started again are produced, reducing effective concentration of the processing solution, which is a problem.

SUMMARY OF THE INVENTION

It is an object of the present invention to provide an automatic processing machine obviating the use of liquid chemicals dangerous in transport and handling to allow the use of solid chemicals without troublesome operation by the user.

It is another object of the present invention to provide an automatic processing machine obviating the necessity of manual dissolving operation by the user for a completely automated replenishing system.

It is still another object of the present invention to provide a compact automatic processing machine having no built-in replenishing tanks.

It is yet another object of the present invention to provide an automatic processing system free of the necessity of liquid replenisher storage and offering improved processing stability.

It is still yet another object of the present invention to provide an environmentally friendly processing system using a reduced amount of plastic packaging material by obviating the use of plastic bottles for liquids.

The present inventors made investigations to solve the problems described above, and found that the problems can be solved by as follows:

The inventors found that the above objects of the invention can be accomplished by an automatic processing machine for silver halide photographic light-sensitive materials having at least one processing tank for containing a processing solution for processing an exposed silver halide light-sensitive material, a means for stocking a package in which a separately weighed solid processing agent is packaged in a moistureproofing manner and/or an immobilizing means for setting the package containing said solid processing agent, a means for releasing said separately weighed solid processing agent from the package and supplying said sold processing agent to said processing tank, a means for detecting information on the amount of processing of said silver halide photographic light-sensitive material, and a means for controlling said supplying means according to said information on the amount of processing of said silver halide photographic light-sensitive material as detected by said detecting means to add the solid processing agent.

The inventors also found that the above objects can also be accomplished by an automatic processing machine for silver halide photographic light-sensitive materials having a processing tank for containing a processing solution for processing an exposed silver halide light-sensitive material, a means for stocking a solid processing agent and/or an immobilizing means for setting the package containing said processing agent, a means for supplying said separately weighed solid processing agent to said processing tank, a means for detecting information on the amount of processing of said silver halide photographic light-sensitive material, a means for controlling said supplying means according to said information on the amount of processing of said silver halide photographic light-sensitive material as detected by said detecting means to add said solid processing agent, a means for supplying replenishing water to said processing tank, a control means for controlling said water supply means according to said information on the amount of processing of said photographic light-sensitive material, and said control means further controlling said water supply means in accordance with information on an amount of evaporation from said processing tank.

The inventors also found that the above objects can also be accomplished by an automatic processing machine for silver halide photographic light-sensitive materials having a processing tank for containing a processing solution for processing an exposed silver halide photographic light-sensitive material, a means for stocking a separately weighed solid processing agent and/or an immobilizing means for setting the package containing said processing agent, a means for supplying said separately weighed solid processing agent to said processing tank, a means for detecting information on the amount of processing of said silver halide photographic light-sensitive material, a means for controlling said supplying means according to said information on the amount of processing of said silver halide photographic light-sensitive material as detected by said detecting means to add said solid processing agent, wherein the opening coefficient of said processing tank (an air-contacting area of said processing solution of 1.0 l in said processing tank under a normal condition) is not larger tank 12 $cm^2/l$.

The inventors also found that the above objects can also be accomplished by an automatic processing machine for silver halide photographic light-sensitive materials having a processing tank for containing a processing solution for processing an exposed silver halide photographic light-sensitive material, which processing tank is equipped with a processing portion where said light-sensitive material is processed and a processing agent receiving portion, between which said processing solution is allowed to flow, a means for stocking a separately weighed solid processing agent and/or an immobilizing means for setting the package containing said processing agent, a means for supplying said separately weighed solid processing agent to said processing agent receiving portion, a means for detecting information on the amount of processing of said silver halide photographic light-sensitive material, a means for controlling said supplying means according to said information on the amount of processing of said silver halide photographic light-sensitive material as detected by said detecting means to add said solid processing agent, a means for circulating said processing solution between said processing portion and said processing agent receiving portion, and a flow control means for controlling the number of circulation times of said processing solution to be 0.5–2.0 times/min. agent.

The present inventors made extensive experiments concerning the direct addition of a solidified processing agent to a tank, and determined the optimum replenishing rate for each processing solution free of photographic performance fluctuation. Although this optimum replenishing rate was thought to depend on the size of the processing tank of the automatic processing machine, i.e., the volume of the processing solution, the inventors found that efficient use of a property of solid chemicals, i.e., practically low solubility, is advantageous that the concentration does not rise rapidly even if the chemical is added at a time, replenishing water can be injected according to the dissolution, and very stable photographic performance is obtained. It was realized that dissolution before using is not an essential requirement.

The amount of processing agent added at a time is preferably 0.1 to 50 g, more preferably 1 to 20 g for color developer, 5 to 50 g for fixer and bleach-fixer, 0.1 to 10 g for stabilizer, and 0.5 to 20 g for black-and-white developer. Even when a solid processing agent is added directly to the processing tank of an ordinary small-sized processing machine in this amount range and processing is carried out while dissolving gradually the solid processing agent, the photographic condition is not adversely affected. This is because the solid processing agent exhibits stable processing performance with its composition well balanced according to the amount of consumption while continuing the processing even when a large amount is added at a time because the solid processing agent dissolves gradually rather than rapidly, as stated above. It was found that photographic performance can also be kept constant by injecting replenishing water according to the dissolution. This is quite a surprising finding which has not been reported. Also, in the present invention, the solid processing agent is added directly to the processing tank, wherein the processing solution is always kept almost constant at the processing temperature, i.e., dissolution speed is almost constant throughout the year, which makes it possible to obtain the desired preset balance of the addition of the solid processing agent and the composition. Another great advantage was found that the so-called non-dissolution phenomenon does not occur as in dissolution in cold water. The non-dissolution phenomenon, named by the present inventors, is a solidifying phenomenon occurring upon addition of a solid processing agent to cold water at a time followed by slow or almost no stirring, resulting in vitrification of the solid processing agent. The solid processing agent, once vitrified, long remains undissolved even with vigorous stirring. In contrast, dissolution in warm water at the processing temperature for the automatic processing machine allows sequential dissolution of the solid processing agent even if it is added in large amounts at a time. The present inventors made further investigations based on these findings, and developed the present invention.

In the present invention, it is preferable that a processing agent holding means which holds and/or fixes a processing agent package wherein a solid processing agent separately weighed in advance is moisture-proof-packaged and a feeding means which unpacks the processing agent package held and/or fixed by the processing agent holding means mentioned above and feeds solid processing agents packaged in the processing agent package into the aforementioned processing tank are provided. In this way, it is possible to prevent, due to moisture-proof-package, that solid processing agents are deteriorated during the period from the moment they are loaded in an automatic processing machine to the moment they are replenished, and it is possible to make the automatic processing machine small because no moisture-proofing means is necessary to be provided in the automatic processing machine.

It is desirable to provide a replenishing water supplying means, desirably under control by the photographic light-sensitive material processing amount detecting means necessary to control the addition of the solid processing agent. It should be emphasized, however, that the replenishing water is not for dissolving the solid processing agent, i.e., the solid processing agent and the replenishing water have totally reverse functions in that the former is for compensating the shortage of components consumed by processing, while the latter is for diluting the reaction inhibitory components dissolved upon processing to make photographic performance constant. Traditionally, water has been used to dissolve chemicals. In contrast, in the present invention, as stated above, the primary purpose of the addition of replenishing water is to dilute the cumulative components dissolved upon reaction while compensating the water loss due to carry-over by the photographic material and evaporation via the tank surface. It is therefore preferable to control the replenishing water supplying means by the processing amount detecting means, since a sensor can be omitted, though it may be controlled separately from the addition of the solid processing agent.

In the present invention, wherein a solid processing agent is added directly to the processing tank, water is therefore unnecessary merely for the purpose of preparing replenishers as in the prior art. This feature results in a major secondary effect of overflow volume reduction. Traditionally, because of the common idea that replenishing solutions must be prepared in advance, as dense replenishing solutions as possible have been used to compensate the shortage of components. Although it has been realized that replenishing rates can be reduced by increasing the solution concentration, whereby the volume of overflow waste liquid, which poses an environmental problem, can be reduced, this has been impossible due to the limitation of the solubility of processing chemicals. In the present invention, the processing chemicals do not become more dense than the tank solution concentration, there is no high concentration state exceeding the tank solution, and replenishment is necessary for desired processing chemicals only; therefore, even overflow-free replenishment is possible.

However, as stated above, it is preferable to use replenishing water to lower the concentrations of accumulated reaction inhibitory components, particularly halide ions in the developer and silver ions in the fixer and bleach-fixer. This replenishing water serves to dilute these reaction inhibitory components and to separately compensate the water loss from each processing solution due to carry-over by the photographic material and evaporation via the tank surface, thus making a marked contribution to the improved processing stability of the present invention.

Therefore, the controlling information used to supply replenishing water includes the amount (e.g., area) of processing of the photographic material, acting time, warming time, stopping time, installation site ambient temperature and relative humidity, and solid processing agent dissolution speed. Controlling the amount of replenishing water added based on these information parameters will make it possible to manage the chemical components in the processing tank in an ideal condition; this may be an epoch-making method of photographic processing management as viewed from the viewpoint of photographic performance. This is because conventional methods have a major problem in which the processing agent components become increasingly dense due to evaporation via each tank as the replenishing rate decreases. Generally, the most preferable for correction for evaporation loss is to dilute the replenisher and supply it in large amounts, but this has a drawback of environmentally undesirable increase in overflow waste. For this reason, the trend has been toward lower replenishing rates. The use of replenisher to compensate the evaporation loss leads to its entry into the processing tank even in the absence of processing, resulting in an imbalanced composition. Thus, it has been a common practice to compensate the water loss by supplying water to reach the starting level every morning, but this is merely the addition of water to the processing solution in the tank whose volume has decreased due to temperature change, rather than compensation of the water loss due to evaporation with water, offering no real solution.

Appropriate compensation for the water loss due to evaporation is to keep the component balance constant except for component change due to consumption by the photographic material, or to supply water according to the amount of water loss due to evaporation caused by the tank solution temperature and tank surface vapor pressure, irrespective of the presence or absence of processing.

Accordingly, in the present invention, replenishing water is supplied for three purposes: 1) To dilute the accumulating harmful inhibitory components dissolving upon reaction in light-sensitive material processing to keep a constant concentration, 2) to dilute the undesirable chemicals carried over by the processed photographic material or by the previous solution, and 3) to compensate the water loss due to evaporation via the tank surface. Information required to accomplish these purposes is detected, based on which the preset water supplying means is controlled to perform the tasks. This is a new method made feasible by the present invention. This water replenishing means for the present invention proved to offer marked improvement in processing stability. In the present invention, the solid processing agent is separately weighed in a given amount, preferably a specified amount. This ensures very accurate replenishment in the automatic processing machine of the present invention, offering very stable continuous processing performance. The phrase "previously separately weighed" mentioned herein means that before charging the processing agent to the automatic processing machine of the invention or before setting the package containing the processing agent to the immobilizing means, the processing agent was separately weighed in a given amount, involving embodiments wherein tablets or pills of a given size are formed and embodiments where granules or powder is packaged in a given amount. However, the scope of the invention does not include the embodiments wherein powder or granules are placed in a stocking means and an amount corresponding to a single addition is weighed out upon supply. In the conventional replenisher supplying system, a bellows pump is used, but its precision is not constant so that it is unsuitable to precise control of replenishment. On the other hand, in the present invention, the solid processing agent is weighed in a specified amount at, for example, the factory where it is produced, and replenishment is controlled on an ON/OFF basis by determining whether the solid processing agent is added or not, thus involving no dispersion among replenishing operations. Processing agent supply accuracy is therefore markedly high, which is also conducive to stable processing performance. The solid processing agent of the present invention may take any form, including powder, granules, tablets and pills, and even mixtures thereof are acceptable. Also, the objects of the present invention can be accomplished even when using the solid processing agent in combination with liquid, as long as it is safe, such as water. Tablets and pills are preferred for separate weighing. In the case of powder, it is preferable to separately package it in an alkali-soluble film, plastic film or paper after separate weighing.

Accordingly, tablets and pills permit supply in accurately separately weighed portions, and powder and granules are separately weighed and separately packaged, whereby the solid processing agent of the present invention is completed. Tablets and pills can be given moisture resistance by coating with a water-soluble moisture-resistant polymer or by using a moisture-resistant packaging material. Powder and granules can be given moisture resistance by using a moisture-resistant packaging material.

The scope of solid processing agent mentioned herein includes powdery processing agents and solid processing agents in the form of tablets, pills, granules and others, which may be subjected to a moisture resistance treatment as necessary. Pasty or slurry processing agents are in the form of semi-liquid and poor in storage stability, and those of any shape subject to legal regulation because of danger in transport are not included in the scope of the solid processing agent of the present invention.

The powder for the present invention is defined as an aggregate of microcrystals. The granule for the present invention is defined as a particle having a grain size of 50 to 5000 μm, prepared by powder granulation. The tablet for the present invention are defined to be formed by compressing a powder or granule into a given shape.

With regard to factors for fluctuation of photographic characteristics, it is effective that a solution numerical aperture of a color developing solution in an automatic processing machine is made small. It was found that when an aperture area is not more than 12 $cm^2/l$, in particular, fluctuation of photographic characteristics can be improved remarkably only in the structure of the invention. When the numerical aperture exceeds 12 $cm^2/l$, undissolved solid processing agents and thick solution immediately after dissolution are subject to air oxidation, resulting in generation of undissolved substances and scum which cause a problem of contaminating an automatic processing machine or a light-sensitive material to be processed. When the numerical aperture is not more than 12 $cm^2/l$, however, the problems mentioned above can be solved.

The numerical aperture as defined here is represented by an area of contact between a unit volume of a processing solution and air. Its unit is represented by $cm^2/l$. In the invention, the numerical aperture is not more than 12 $cm^2/l$ and that ranging within 2–10 $cm^2/l$ is more preferable. The most preferable is 3–5 $cm^2/l$. It is possible to make the numerical aperture small generally by using a floating lid made of resin or the like which intercepts air, or by using a developing unit of a slit type described in Japanese Patent O.P.I. Publication Nos. 131138/1988, 216050/1988 and 235940/1988.

Further, in the automatic processing machine of the invention, even when a transport means for a light-sensitive material stops running after completion of development processing of the light-sensitive material, a pump is driven to continue working for circulation of a processing solution for a predetermined period of time from the stop of the transport means. Therefore, when circulation of the processing solution is stopped after the predetermined period of time for the pump to continue operating which is set to be short as far as possible but is sufficient for replenished processing agents to be dissolved, no undissolved processing agents remain in a tank for preparing processing solution, resulting in neither clogging of a filter section nor deterioration of a processing solution, realizing stable processing and less requirement of electric power. The period of time of 2 hours for the pump to continue working after an end of development processing is preferable, and more preferable is that of 10 minutes–70 minutes wherein a range of 15 minutes–50 minutes is especially preferable. When this period of time is too long, it causes deterioration of a processing solution, while, when it is too short, solid processing agents are not dissolved sufficiently. Therefore, the ranges mentioned above are preferable.

BRIEF DESCRIPTION OF THE DRAWINGS

FIGS. 16(A), (B) and (C) show still other supplying apparatuses for a solid processing agent.

FIGS. 20(A), (B) and (C) are cross-sectional views of a supplying apparatus and an oblique view of a package.

FIGS. 23(A) through (E) are plans of a seal package.

FIGS. 32(A) and (B) are oblique views of the apparatus for cutting a package in a "⊐" shape of FIG. 31.

DETAILED DESCRIPTION OF THE PREFERRED EMBODIMENT

Figure 1:
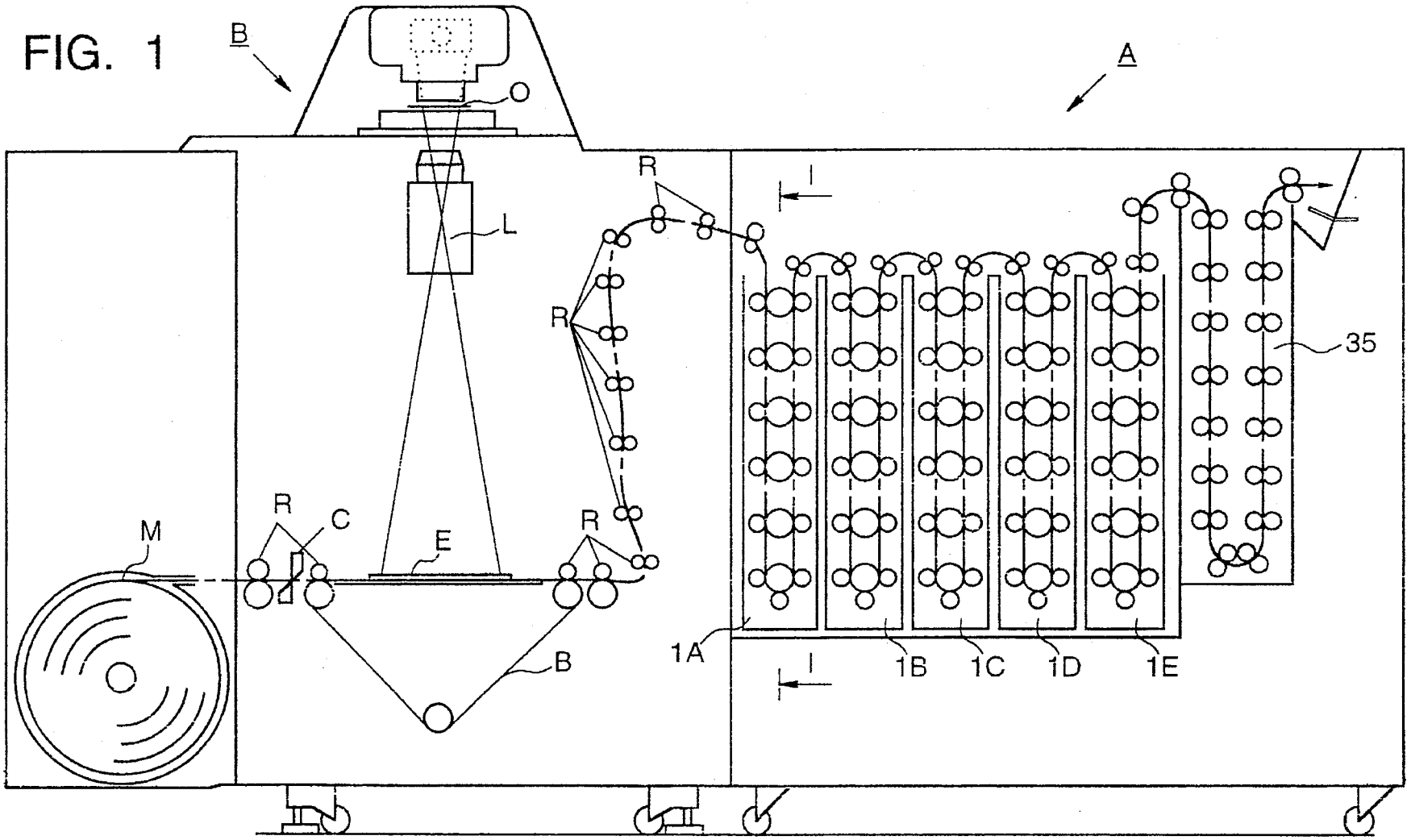
FIG. 1 is a schematic diagram of a printer processor wherein an automatic processing machine and a photographic printer are unified.

The present invention is hereinafter described in detail.

Of the above solid processing agents, tablets are preferably used, since they offer high replenishing accuracy and are easy to handle.

For solidifying a photographic processing agent, various methods can be optionally selected; for example, a photographic processing agent in the form of a dense solution, fine powder or granules and a water-soluble binder are kneaded and formed, or a water-soluble binder is sprayed over the surface of the pre-formed photographic processing agent to form a coating (see Japanese Patent Application Nos. 135887/1990, 203165/1990, 203166/1990, 203167/1990, 203168/1990 and 300409/1990).

In the preferred method of tablet production, a powdery solid processing agent is granulated and then tableted. This method is advantageous in that photographic performance is stable as a result of improvement in solubility and storage stability, in comparison with solid processing agents prepared solely by mixing and tableting solid processing agent components.

For forming tablets, known granulating methods can be used, including tumbling granulation, extrusion granulation, compressive granulation, disintegration granulation, stirring granulation, fluidized bed granulation and spray drying granulation. In forming tablets, it is preferable to use a granulation product having an average grain size of 100 to 800 μm, more preferably 200 to 750 μm, since unevenness in the composition, or so-called segregation, is not likely upon granulation product mixing and compression. In addition, the grain size distribution is preferably such that not less than 60% of the grains fall in the range of ±100 to 150 μm apart from the average grain size. In compressing the granulation product obtained, a known compressing machine, such as a hydraulic press, a single tableting machine, a rotary tableting machine or a briquetting machine, can be used. Although the solid processing agent obtained by compression can take any shape, cylindrical agents, i.e., so-called tablets, are preferred from the viewpoint of productivity and handling quality.

More preferably, components such as an alkali agent, a reducing agent, a bleaching agent and a preservative, are separately granulated, whereby the above effect is enhanced.

Tablet processing agents can be produced by ordinary methods such as those described in Japanese Patent O.P.I. Publication Nos. 61837/1976, 155038/1979 and 88025/1977 and British Patent No. 1213808. Granular processing agents can be produced by ordinary methods such as those described in Japanese Patent O.P.I. Publication Nos. 109042/1990, 109043/1990, 39735/1991 and 39739/1991. Powdery processing agents can be produced by ordinary methods such as those described in Japanese Patent O.P.I. Publication No. 133332/1979, British Patent Nos. 725892 and 729862 and German Patent No. 3733861.

From the viewpoint of solubility and the desired effect of the present invention, the apparent density of the solid photographic processing agent described above is preferably 1.0 to 2.5 g/cm$^3$; this range is preferable from the viewpoint of solid strength for the lower limit and solid solubility for the upper limit. When the solid processing agent is of granule or powder form, the apparent density is preferably 0.40 to 0.95 g/cm$^3$.

Although the solid processing agent for the present invention may be used for various photographic processing agents, such as a color developing agent, a black-and-white developing agent, a bleaching agent, a fixing agent, a bleach-fixing agent, and a stabilizing agent, the effect of the invention, particularly the photographic performance stabilizing effect, is enhanced when it is applied to a color developing agent.

Those exemplified from the regulation for dangerous liquid products are black-and-white developing agents, color developing agents, bleaching agents, bleach-fixing agents and stabilizers.

For the embodiment of the present invention, it is best to solidify all processing agents, but it is preferable to solidify at least the color developing agent. This is because the effect of the present invention is most enhanced, since the color developing agent contains many components showing chemical interaction and also harmful components. More preferably, in addition to the color developing agent, the bleach-fixing agent or the bleaching agent and the fixing agent are solidified, which are recognized as involving a risk in transportation, since they are distributed in liquid kits.

Although solidification of part of a processing agent is included in the scope of the present invention, it is preferable to solidify the entire components of the processing agent. Desirably, each component is formed as a separate solid processing agent and packaged in the same style. It is also desirable to package each component in the order of repeated addition.

It is preferable to add all processing agents to be supplied to respective processing tanks according to information on the amount of processing in the form of solid processing agents. Where necessary, replenishing water is supplied on the basis of such information or other replenishing water controlling information. In this case, the liquid added to the processing tank may be replenishing water alone. In other words, when two or more processing tanks require replenishment, by sharing the replenishing water, only one tank is sufficient to store the replenishing liquid, resulting in automatic processing machine size reduction. It is a preferred mode, for automatic processing machine size reduction, that a single replenishing water tank be installed outside the automatic processing machine.

In solidifying a color developing agent, it is preferable to solidify all of the alkali agent, coloring agent and reducing agent, and to confine the number of tablet kinds to not more than 3, preferably 1. When solidifying in two or more agents, it is preferable to package these tablets or granules in the same package.

In order to prevent moisture, in a package housing solid photographic processing agents for processing a silver halide photographic light-sensitive material, it is preferable to provide a moisture-absorption member on the surface of the above-mentioned package.

Since the package of solid photographic processing agent is covered with a moisture-absorbing material on the inside surface contacting the solid photographic processing agent, inside thereof tightly closed is intercepted from outside air so that it is sealed from the outside air. Since the moisture-absorbing material absorbs moisture remaining inside the package, the humidity inside the package becomes very low. Thus, the solid photographic processing agents can not absorb any more moisture.

Even when there is a void between each solid processing material and a package, moisture is absorbed so that the absorption activity of solid processing agent stops to be in an equilibrium condition. Therefore, each solid photographic processing agent housed therein is not adversely affected. Accordingly, the quality of processing negative film and prints are not decreased. In addition, since desiccants are not necessary to be inserted other than to a package, it is not necessary to worry about falling desiccant into the processing tank.

In addition, even when there is a large difference in the dimensions of each package, no serious problems are caused in terms of housing solid photographic processing agent.

Here, "moisture-absorbing material" is defined to be a material absorbing moisture when moisture adheres thereon and let it permeate therein. Owing to this material, one or several solid photographic processing agent are always surrounded by moisture-absorbing material.

As a moisture-absorbing material, it is desirable to use pulp materials such as paper not coated for easier disposal and incineration circumstances. Alternately, it is allowed that polymer absorption materials or sponge is placed inside thereof.

In addition, this moisture-absorbing material can serve as a package too. In such a case, it goes without saying that the outside surface of the package must be provided with moisture-proof treatment.

In addition, it is also possible that another kind of moisture-proof package is used and that a moisture-absorbing material is blown into or coated on the inner wall.

In order to prevent moisture, it is also preferable to make a container for a solid photographic processing agent for processing a silver halide photographic light-sensitive material, in the container the ratio of voids represented by the formula "(y–x)/y" is made 0.35 or less, wherein the notation "y" is the volume ($cm^3$) of aforesaid container and "x" is total volume ($cm^3$) of a solid photographic processing agent housed in aforesaid container.

Each container, housing prescribed amounts of a solid photographic processing agent, is made of paper tubing, a singly-packaged envelope or a PTP (press through pack). The containers are designed so that the ratice of voids becomes 0.35 or less. The containers are installed in an automatic processing machine and used at a prescribed position. The solid agents are supplied into a processing tank, or a dissolution tank if necessary, by means of conventional technological means. Accordingly, moisture which is harmful to each agent is prevented from entering the solid photographic processing agent. Thus, it is extremely favorable. In another embodiment, the container having a rigid body is constituted by a part having a compartment housing a prescribed amount of a solid photographic processing agent and a part covering aforesaid compartment and having a discharging outlet at one point for the solid photographic processing agent. As stated above, each compartment is designed so that the ratio of voids becomes 0.35 or less and they are tightly closed from outside air. By regulating the ratio of voids to 0.35 or less, the solid photographic processing agent may absorb a small amount of moisture remaining inside a container, thereafter, since the humidity in the compartment becomes very low, aforesaid solid processing agent is prevented to absorb any further moisture.

By the use of a container wherein solid photographic processing agents are closed tightly as in the present invention in place of a conventional liquid photographic processing agent, moisture-resistance is maintained so that chemically stable processing agents can be supplied. In addition, since the space for containers of solid agents can be reduced considerably compared to conventional liquid photographic processing agents, it is extremely advantageous in terms of conveyance, transportation, cost and safety. In any case, by reducing the percentage of voids to 0.35 or less, each solid Photographic processing agent absorbs moisture remaining in the container so that activity of moisture therein stops resulting in equilibrium condition. Since there is minimal moisture therein, each solid photographic processing agent absorbs insignificant moisture. In addition, after a packaging is broken manually or automatically, each processing agent is charged into aforesaid automatic processing machine as it is necessary, then, it is dissolved automatically and can be used as a processing agent. Therefore, preparation of processing agents and pouring of processing agents become unnecessary. Thus, these energy-saving effects are also noteworthy.

In order to prevent moisture, tablets and pills can be moisture-resistant packaged with the following materials:

Usable synthetic resin materials are polyethylene (prepared by the high pressure method or the low pressure method), polypropylene (whether elongated or not), polyvinyl chloride, polyvinyl acetate, nylon (elongated or not), polyvinylidene chloride, polystyrene, polycarbonate, vinylon, Eval, polyethylene terephthalate (PET), other polyester resins, hydrochlorinated rubber, acrylonitrile-butadiene copolymer, epoxy-phosphate resin (the polymers described in Japanese Patent O.P.I. Publication Nos. 63037/1988 and 32952/1982). Pulp is also acceptable.

These materials may be prepared as laminated films combined by adhesion, but may be prepared by coating.

It is preferable to use various gas barrier film such as aluminum foil or aluminum evaporated synthetic resin between the above synthetic resin films.

For the storage stability of solid processing agents of these packing materials and for prevention of stain occurrence, the total oxygen permeability is preferably not higher than 50 ml/m$^2$/24 hr/atm (at 20° C., 65% RH), more preferably not higher than 30 ml/m$^2$/24 hr/atm.

The total thickness of plural layers of these packaging materials or a single layer of a package material is preferably 1 to 3000 μm, more preferably 10 to 2000 μm, and still more preferably 50 to 1000 μm.

These synthetic resin films may be single-layer (polymer) resin films or multiple-layer laminated (polymer) resin films.

Examples of single-layer polymer resin films meeting the requirements of the present invention include:

(1) polyethylene terephthalate (PET) of not less than 0.1 mm in thickness, (2) acrylonitrile-butadiene copolymers of not less than 0.3 mm in thickness, and (3) hydrochlorinated rubber of not less than 0.1 mm in thickness. Preference is given to polyethylene terephthalate because of excellent alkali resistance and acid resistance.

Examples of laminated polymer resin films meeting the requirements of the present invention include:

(4) PET/polyvinyl alcohol-ethylene copolymer (Eval)/polyethylene (PE), (5) stretched polypropylene (OPP)/Eval/PE, (6) non-stretched polypropylene (CPP)/Eval/PE, (7) nylon (N) /aluminum foil (Al)/PE, (8) PET/Al/PE, (9) cellophane/PE/Al/PE,

(10) Al/paper/PE,

(11) PET/PE/Al/PE,

(12) N/PE/Al/PE,

(13) paper/PE/Al/PE,

(14) PET/Al/PET/polypropylene (PP),

(15) PET/Al/PET/high density polyethylene (HDPE),

(16) PET/Al/PE/low density polyethylene (LDPE),

(17) Eval/PP,

(18) PET/Al/PP,

(19) paper/Al/PE,

(20) PE/PVDC-coated nylon/PE/ethylvinyl acetate-polyethylene condensation product (EVA),

(21) PE/PVDC-coated N/PE,

(22) EVA/PE/aluminum-deposited nylon/PE/EVA,

(23) aluminum-deposited nylon/N/PE/EVA,

(24) OPP/PVDC-coated N/PE,

(25) PE/PVDC-coated N/PE,

(26) OPP/Eval/LDPE,

(27) OPP/Eval/CPP,

(28) PET/Eval/LDPE,

(29) ON (stretched nylon)/Eval/LDPE, and

(30) CN (non-stretched nylon)/Eval/LDPE, with preference given to (20) through (30).

Example configurations of these packaging materials include the following (the innermost face is in contact with the processing agent):

PE/base cardboard/PE/Al/epoxy-phosphate resin layer/polyester resin layer/PE,

PE/K-nylon/PE or adhesive/Al/PE/cardboard/PE,

PE/vinylon/PE or adhesive/Al/PE/cardboard/PE,

PE/vinylidene chloride/PE or adhesive/Al/PE/cardboard/PE,

PE/polyester/PE or adhesive/Al/PE/cardboard/PE, and polypropylene/K-nylon/polypropylene/Al/polypropylene/cardboard/polypropylene.

Methods for moisture-resistant packaging tablets or granules include four-side sealing, three-side sealing, stick packaging (pillow packaging, gusset packaging), PTP packaging and cartridge packaging.

Four-side sealing, three-side sealing and stick (pillow, gusset) packaging are differentiated by packaging form, and the above-mentioned materials are used therefor. It should be noted, however, when these methods are applied to the peel open method, a sealant is laminated to provide peel opening suitability.

The peel open method is usually available in three modes: the cohesive failure method, the interfacial peeling method and the interlayer peeling method.

The cohesive failure method involves the use of a hot melt adhesive and a heat seal lacquer as a sealant, wherein peeling is achieved by internal cohesive failure of the sealant layer upon package opening.

The interfacial peeling method is based on peeling in the interface between two films, wherein the sealing film (sealant) and the adherend are not completely molten together so that they can be detached with moderate strength. The sealant is a film blended with viscous resin, and its material can be selected from polyethylene, polypropylene or a copolymer thereof, polyester, etc., depending on the material of the adherend.

The interlayer peeling method is based on peeling between laminate films using a multiple layered co-extruded film.

In the peel open method using a film of the present invention, interlayer peeling or interfacial peeling is preferred.

Since these sealants are thin, it is a common practice to use them with lamination with other films such as polyethylene, polypropylene, polystyrene, polycarbonate, polyester (polyethylene terephthalate), polyvinyl chloride, nylon, Eval or aluminum, with preference given to polyethylene, polypropylene, polyester and Eval from the viewpoint of moisture resistance, environmental concern and compatibility with the contents. Also, in view of printability, the outermost face is preferably of non-stretched polypropylene, polyester, paper or the like.

Available sealant films include the CMPS film, produced by Tocello, Diflan PP-100 and PS-300, produced by Dainippon Ink & Chemicals, Inc., the LTS film, produced by Toppan Printing Co., Ltd., and Sanseal FR and Sanseal MS, produced by San-Ei Chemical Industries, Ltd. Polyester-laminated types include Diklan C-1600T and C-1602T.

PTP is a kind of blister packaging wherein formed sheets of PVC, CPP or the like, containing a solid processing agent, are heat sealed with aluminum sealing material.

The recent tendency for PVC is toward avoidance of the use as a forming material from the viewpoint of environmental concern; A-PET and highly moisture-resistant PP (e.g., TAS- 1130, TAS-2230, TAS-3230, produced by Taisei Kako K.K.) have recently been preferred.

The water-soluble films or binders which are preferably used to bind or coat processing agents are those based on polyvinyl alcohol, methyl cellulose, polyethylene oxide, starch, polyvinylpyrrolidone, hydroxypropyl cellulose, pullulan, dextran, gum arabic, polyvinyl acetate, hydroxyethyl cellulose, carboxyethyl cellulose, carboxymethylhydroxyethyl cellulose sodium salt, poly(alkyl) oxazoline or polyethylene glycol, with preference given to those based on polyvinyl alcohol or pullulan from the viewpoint of the desired effect of coating or binding.

Preferred polyvinyl alcohol, a very good film-forming material, exhibits good strength and flexibility under almost all conditions. Commercially available polyvinyl alcohol compositions for inject-molded films vary widely as to molecular weight and the degree of hydrolysis; the molecular weight is preferably about 10000 to about 100000. Here, the degree of hydrolysis is defined as the ratio of acetate groups replaced by hydroxyl groups in the polyvinyl alcohol. For film application, the degree of hydrolysis is normally in the range from about 70 to 100%. As stated above, the term polyvinyl alcohol usually involves polyvinyl acetate compounds.

These water-soluble films are produced by ordinary methods such as those described in Japanese Patent O.P.I. Publication Nos. 124945/1990, 97348/1986, 158245/1985, 86638/1990, 117867/1982, 75650/1990, 226018/1984, 218741/1988 and 13565/1979.

Water-soluble films which are commercially available under trade names of Solupuron (produced by Aicello Kagaku), Hicellon (produced by Nichigo Film) and pullulan (produced by Hayashibara Co., Ltd.) can be used. Also, the 7-000 series polyvinyl alcohol films available from the MONO-SOL division of Chris Craft Industries Inc., which dissolve in water at temperatures of about 34° to 200° F., which are harmless and which exhibit high chemical resistance, are particularly preferably used.

From the viewpoint of solid processing agent storage stability, water-soluble film dissolution time and crystallization in the automatic processing machine, the film thickness of the water-soluble film is preferably 10 to 120μ, more preferably 15 to 80μ, and still more preferably 20 to 60μ.

The water-soluble film is preferably thermoplastic. This is because thermoplasticity facilitates heat seal work and ultrasonic welding work and enhances the coating effect.

The tensile strength of the water-soluble film is preferably $0.5\times10^6$ to $50\times10^6$ kg/m$^2$, more preferably $1\times10^6$ to $25\times10^6$ kg/m$^2$, and still more preferably $1.5\times10^6$ to $10\times10^6$ kg/m$^2$. Tensile strength is determined by the method described in JIS Z-1521.

The photographic processing agent wrapped, bound or coated with a water-soluble film or a binder is preferably packaged in a moisture-resistant packaging material to prevent damage due to high humidities, atmospheric moisture such as rain and fog, and accidental contact with scattered water or wet hands during storage, transportation and handling. Said moisture-resistant packaging material is preferably 10 to 150μ in thickness. Said moisture-resistant packaging material is at least one selected from the group comprising polyolefin films such as those of polyethylene terephthalate, polyethylene and polypropylene, craft paper enhanced for moisture resistant by polyethylene, wax paper, moisture-resistant cellophane, glassine, polyester, polystyrene, polyvinyl chloride, polyvinylidene chloride, polyamide, polycarbonate, acrylonitrile and foils of metals such as aluminum, and metallized polymer films, and may be a composite thereof.

Also, in embodying the present invention, preference is also given to degradable plastics, specifically biodegradable or photodegradable plastics as moisture-resistant packaging materials.

Said biodegradable plastics include 1) naturally occurring high molecular compounds, 2) microbial polymers, 3) highly biodegradable synthetic polymers and 4) blends of naturally occurring biodegradable high molecular substances in plastics. Photodegradable plastics include 5) those having in the main chain thereof a group whose bond is broken upon UV excitation. In addition to the above-mentioned high molecular substances, those which are both photodegradable and biodegradable can also be preferably used.

Typical examples of such substances are as follows.

Examples of biodegradable plastics include:

1) naturally occurring high molecular substances such as polysaccharides, cellulose, polylacetic acid, chitin, chitosan, polyamino acid and modified configurations thereof;

2) microbial polymers such as Biopol, which is based on PHB-PHV (copolymer of 3-hydroxybutyrate and 3-hydroxyvalerate), and microbial cellulose;

3) highly biodegradable synthetic polymers such as polyvinyl alcohol, polycaprolactone and copolymers and mixtures thereof; and 4) blends of naturally occurring biodegradable high molecular substances in plastics such as those prepared by adding starch or cellulose to plastics to provide shape disintegrability.

Examples of photodegradable plastics of 5)include those having a carbonyl group introduced therein for photodisintegrability, which may be supplemented with UV absorbent for promoted disintegration.

Ordinary biodegradable plastics such as those described in "Kagaku to Kogyo", Vol. 64, No. 10, pp. 478–484 (1990) and "Kino Zairyo", 1990 July issue, pp. 23–34 can be used. Also usable biodegradable plastics are commercial products such as Biopol, produced by ICI, Eco, produced by Union Carbide, Ecolite, produced by Eco Plastic, Ecostar, produced by St. Lawrence Starch, and Knuckle P, produced by Nippon Unicar.

The moisture-resistant packaging material described above is preferably not more than 10 g·mm/m$^2$ 24 hr, more preferably not more than 5 g·mm/m$^2$ 24 hr in water permeation coefficient.

In the present invention, means for supplying a solid processing agent to the processing tank are exemplified by known methods such as those described in Japanese Utility Model Publication Nos. 137783/1988, 97522/1988 and 85732/1989 for tablet processing agents. Essentially, any method is acceptable, as long as a means for supplying the tablets to the processing tank is provided. For granular or powdery processing agents, available methods include gravity fall methods such as those described in Japanese Utility Model Publication Nos. 81964/1987, 84151/1988 and Japanese Patent O.P.I publication No. 292375/1989, and screw-based methods such as those described in Japanese Utility Model Publication Nos. 105159/1988 and 195345/1988. These examples are not to be construed as limitative.

Preferably, however, for supplying the solid processing agent to the processing tank, a given amount of the solid processing agent, previously separately packaged, is taken out from the package according to the amount of processing of the light-sensitive material. Specifically, the solid processing agent, in a given amount, preferably in an amount equivalent to a single replenishment, is housed in a package of at least two packaging materials, which package is separated in two directions or part thereof is broken to allow the solid processing agent to be taken out. The solid processing agent is thus allowed to fall freely and to be supplied easily to the processing tank equipped with a filtering means. The given amount of the solid processing agent remains moisture-resistant unless the package is opened, because each is contained in a separately sealed package to avoid contact with the atmosphere and the adjacent solid processing agent.

A mode of embodiment is a package of at least two packaging materials between which the solid processing agent is inserted, wherein the two packaging materials are in contact or adhesion mutually so that they can be separated from each other. By pulling in different directions, the packaging materials are separated on the contact or adhesion surface, so that the solid processing agent can be taken out.

In another mode of embodiment, at least one of the two packaging materials, between which the solid processing agent is inserted, is made openable by external force. The term "opening" mentioned herein means cutting or breakage of the package while leaving a part thereof intact. For opening the package, the solid processing agent is forced to be pushed out by exerting a compressive force in the direction from the non-openable packaging material to the openable packaging material via the solid processing agent, or the solid processing agent is made takable by cutting the openable packaging material with a sharp element.

A supply starting signal is generated by detecting information on the amount of processing. Upon reception of such supply starting signal, the driving means for separation or opening is activated. A supply stopping signal is generated by detecting information on the completion of supply of a specified amount. Upon reception of such supply stopping signal, the driving means for separation or opening is disabled.

The above solid processing agent supplying means is equipped with a controlling means for adding a given amount of the solid processing agent according to information on the amount of processing of light-sensitive material, which constitutes a key to the present invention. It is essential for the automatic processing machine of the present invention to keep the component concentration in each processing tank constant and hence stabilize photographic performance. The information on the amount of processing of silver halide photographic light-sensitive material is a value in proportion to the amount of the silver halide photographic light-sensitive material to be processed by a processing solution or the amount of the silver halide photographic light-sensitive material already processed by a processing solution or the amount of the silver halide photographic light-sensitive material being processed by a processing solution, offering a direct or indirect index of the reduction in the amount of the processing agent in the processing solution. This information may be detected at any timing, before or after light-sensitive material transportation into the processing solution or during its immersion in the processing solution. It may also be the amount of the light-sensitive material printed using a printer, or the concentration of the processing solution contained in the processing tank or concentration change, or the amount discharged after drying the processing solution.

Although any portion is acceptable to add the solid processing agent of the present invention, as long as it is located in the processing tank, preference is given to a portion communicating with the processing portion for the light-sensitive material and allowing the processing solution to flow to/from the processing portion. The preferred configuration is such that a given amount of processing solution is circulated to/from the processing portion to allow the dissolved components to be transferred to the processing portion. It is preferable to add the solid processing agent into a processing solution being warmed.

Usually, the automatic processing machine is equipped with an electric heater to warm processing solutions, wherein a heat exchanger is provided in the auxiliary tank connected to the processing tank (processing portion), which auxiliary tank is equipped with a pump for supplying the solution at constant rate from the processing tank to have constant temperature.

A filter is usually arranged to remove crystalline foreign substances occurring due to contamination or crystallization in the processing solution.

It is most preferable to add the solid processing agent to a warmed portion communicating with the processing portion like this auxiliary tank. This is because the insoluble components of the added processing agent are isolated from the processing portion by the filtering portion to prevent the solids from entering the processing portion and adhere to the light-sensitive material etc.

Also, when a processing agent receiving portion, along with the processing portion, is provided in the processing tank, it is preferable to provide a shield or another device to avoid direct contact of the insoluble components with the film etc.

For the filter and filtering apparatus, any material can be used, as long as it is commonly used in ordinary automatic processing machines, and the effect of the present invention is not affected by any particular structure or material.

In the present invention, the addition of a solid processing agent to the processing tank obviates the necessity of tanks etc. for stocking the replenishers and making the automatic processing machine compact, and provided that the automatic processing machine is equipped with a circulating means, solid processing agent solubility improves markedly.

A circulation cycle of a processing solution circulated by a circulating means in the invention is preferably 0.5–2.0 cycles/min and that of 0.8–2.0 cycles/min, even of 1.0–2.0 cycles/min is more preferable. Owing to this, dissolution of solid processing agents is accelerated, and thereby, occurrence of a group of high concentration solution, occurrence of uneven density of processed light-sensitive materials and occurrence of insufficiently-processed light-sensitive materials can be prevented.

A mold-preventing means for a water-replenishing tank in the invention will be explained as follows. When the replacement rate in the water-replenishing tank falls to cause water to stay in the tank for a long time, scale is formed and after two or three hours from the formation of scale, water is decomposed and emits an offensive odor, which is a problem. Further, when the formed scale is directly mixed in a replenisher to be replenished, it adheres to the surface of a photographic light-sensitive material, causing streaks in the case of a color developing tank, causing insufficient desilvering in the case of a desilvering tank, and causing contamination in the case of a stabilizing tank. Thus, the scale deteriorates the value of finished commodities remarkably regardless of the type of a tank in which the scale is mixed. Therefore, it is necessary to clean periodically for removing the scale, which is very much time-consuming and is far from maintenance free. When the scale enters a processing tank and fails to be removed by a filter, rollers for transport use require cleaning which needs a great deal of work. For the purpose of maintenance free, therefore, a water-replenishing tank of the invention is provided with a mold-preventing means. The mold-preventing means can be attained by at least one means selected from the following group.

(Group)

(1) Chelating agent adding means (2) Mold-preventing agent adding means (3) Deionizing processing means (4) UV irradiation means
(5) Magnetic processing means
(6) Ultrasonic processing means
(7) Electrolytic sterilization means
(8) Silver ion discharging means
(9) Air-foaming means These means will be explained concretely as follows. Chelating agents and sterilizing agents used as a mold-preventing means in the invention include compounds described on page 398 of No. 6, Vol. 9 of "Water Quality Criteria" Phot Sci. and Eng. by L. E. West (1965), described in Vol. 85 of "Microbiological Gro with in Motion-Picture Processing" SMPTE Journal by M. E. Beach (March 1976), described on page 239 of No. 6, Vol. 10 of "Photoprocessingu Wash Water Biocides" J. Imaging Tech. by R. O. Deegan (December 1984) and described in Japanese Patent O.P.I. Publication Nos. 8542/1982, 105145/1983, 157244/1982 and 220951/1987.

As a chelating agent, those including ethylenediaminetetraacetic acid, diethylenetriaminepentaacetic acid, 1-hydroxyethylidene-1, 1-diphosphonic acid and ethylenediaminetetra (methylenephosphonic acid)

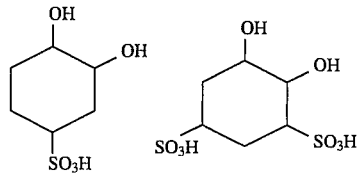

are preferable, while as a sterilizing agent, phenol type compounds, thiazole type compounds and benztriazole type compounds are preferable. As concrete examples, 1,2-benzisothiazoline 3-on, 2-methyl-4-isothiazoline3-on, 2-octyl-4-isothiazoline3-on, 5-chloro-2-methyl-4-isothiazoline3-on, 0-phenylfersodium, and benztriazole are given as a preferable compound. With regard to these compounds, it is preferable that they are in a tablet shape when they are packed collectively, while it is preferable that they are in an individual package corresponding in weight to one replenishment when they are separately weighed.

With regard to the means for adding the aforementioned compounds, they may be added manually by those who prepare solutions, but it is preferable that a device for feeding solid processing agents of the invention is provided for adding them, and it is further preferable from a viewpoint of maintenance free that a water-replenishing tank is provided with a detector through which the compounds are added automatically when water is replenished up to a certain level on the tank.

A means for modifying water by means of ion-exchange resins in the invention can work based on the means described in Japanese Patent O.P.I. Publication No. 131632/1986.

As ion-exchange resins, there are various types of cation-exchange resins (strongly acidic cation-exchange resin, weakly acidic cation-exchange resin) and various types of anion-exchange resins (strongly basic anion-exchange resin), and these can be used independently or in combination. Normally, it is preferable to use both strongly acidic H type cation-exchange resins and weakly basic OH type anion-exchange resins. They may be applied on a water-replenishing tank, or water may be modified separately.

As a preferable strongly acidic ion-exchange resin, there by be given DIAION SKIB, SK102, SK104, SK106, SK110, SK112 and SK116 (made by Mitsubishi Kasei), while, as a preferable strongly basic anion-exchange resin of an OH type, there may be given DIAION, PA406, PA408, PA412, PA416 and PA418 made by Mitsubishi Kasei.

The UV irradiation means of the invention can work based on the means described in Japanese Patent O.P.I. Publication No. 263939/1985. As a UV irradiation device, those made by Kindai-Baio Lab. (with Head Office located at Kobe City) are small in size and can be used preferably. The means for giving a magnetic field in the invention can work based on the means described in Japanese Patent O.P.I. Publication No. 26393/1985. The means for giving a ultrasonic wave in the invention can work based on the means described in Japanese Patent O.P.I. Publication No. 263940/1985. The means for giving an electrolysis in the invention can work based on the means described in Japanese Patent O.P.I. Publication No. 22468/1991. A means for discharging Ag ions in the invention includes those wherein silver leaves or silver plates are put in a water-replenishing tank, or internal surfaces of the tank is coated with silver, or silver ion discharging compounds are put in the tank. With regard to preferable silver ion discharging compounds, Bio-sure SG or SGD (made by Kinki Pipe Lab.) coated on the internal surface of the tank or put in the tank can offer a great effect.

The air foaming means in the invention can be a means for blowing air bubbles in a water-replenishing tank which is extremely simple, and it is selected according to the size of the water-replenishing tank. From the viewpoint of miniaturization and economy, (1), (2), (3), (7) and (8) are selected preferably as a means for preventing scale and microbes, and (1), (3) and (8) are selected more preferably. ( 8 ) is the most preferable.

Silver-ion-emitting compounds indicated in means (8) include organic acid silver such as silver chloride, silver bromide, silver iodide, silver oxide, silver sulfate and silver acetate, silver oxalate, silver behenate and silver maleate.

Those used preferably in the invention among the silver compounds mentioned above include one wherein $SiO_2$—$Na_2O$ lath objects having the chemical structure of a network structure type are basic structural components, and one wherein the silver compounds mentioned above are contained in zeolitic substance having the three-dimensional skeletal structure wherein $SiO_4$ tetrahedron and $AlO_4$ tetrahedron both having the structure of a methane type own one oxygen atom jointly.

As a zeolitic substance and a glass substance both containing the silver compounds and the compounds both mentioned above, there may be given Bio-Sure SG made by Kinki Pipe Laboratory, Opargent tablets made by Opofarma Co. and Zeomic made by Sinanen Zeomic Co.

A zeolitic substance and a glass substance both containing the silver compounds and the compounds both related to the invention can be used in various forms. For example, they may be in a form of powder, a sphere, a pellet, a fiber or a filter, or they may be used after being pushed, through kneading, in fibers of cotton, wool or of polyester. Concrete examples of them include SANITER 30 made by KURARE CO. and others.

Among the foregoing, those in a form of a filter and a sphere represent preferable embodiments.

Furthermore, another preferable embodiment is represented by one wherein a zeolitic substance and a glass substance both containing the silver compounds or the compounds both mentioned above .are used after being put in a container permeable to water such as a plastic case or the container in a tea bag form.

A p-phenylenediamine compound having a water-solubilizing group is preferably used as a color developing agent in the color developer for the present invention, since it enhances the desired effect of the invention and causes little fogging.

The p-phenylenediamine compounds having a water-solubilizing group are advantageous over the p-phenylenediamine compounds having no water-solubilizing group, such as N,N-diethyl-p-phenylenediamine, that they do not contaminate the light-sensitive material and are not irritative to skin upon skin contact. In addition, their use in combination with the color developer for the present invention allows more efficient accomplishment of the desired object of the invention.

The p-phenylenediamine compound for the present invention has at least one water-solubilizing group as described above on the amino group or benzene nucleus thereof. Preferred water-solubilizing groups include:

$-(CH_2)_n-CH_2OH$, $-(CH_2)_m-NHSO_2-(CH_2)_n-CH_3$, $-(CH_2)_m-O-(CH_2)_n-CH_3$, $-(CH_2CH_2O)_nC_mH_{2m+1}$ (m and n independently represent an integer of not less than 0), a —COOH group and a $-SO_3H$ group.

Examples of color developing agents preferably used for the present invention are C-1 through C-16 described on pages 26 through 31 of Japanese Patent Application No. 203169/1990.

The color developing agent described above is used normally in the form of a salt such as hydrochloride, sulfate or p-toluenesulfonate.

The above-mentioned color developing agents may be used singly or in combination, and may be used in combination with black-and-white developing agents such as phenidone, 4 -hydroxymethyl-4-methyl-1-phenyl-3-pyrazolidone and Metol as desired.

It is a preferred mode of embodiment of the present invention to add a compound represented by the following formula A or B to the color developer relating to the present invention, whereby the desired effect of the invention is enhanced.

Specifically, it is effective in that not only the storage stability of tablets and other forms of solid processing agent improve in comparison with other compounds, but also sufficient strength is maintained. Another advantage is that photographic performance becomes stable and fogging in the unexposed portion is suppressed.

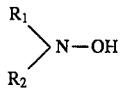

Formula A wherein $R_1$ and $R_2$ independently represent an alkyl group, an aryl group,

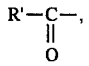

or a hydrogen atom, provided that they do not represent a hydrogen atom concurrently. The alkyl groups represented by $R_1$ and $R_2$ may be identical or not, each of which preferably has 1 to 3 carbon atoms. These alkyl groups may have a carboxylate group, a phosphate group, a sulfonate group or a hydroxyl group.

R' represents an alkoxy group, an alkyl group or an aryl group. The alkyl groups and aryl groups for $R_1$, $R_2$ and R' include those having a substituent. $R_1$ and $R_2$ may bind together to form a ring, such as a heterocyclic ring like piperidine, pyridine, triazine or morpholine.

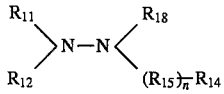

Formula B wherein $R_{11}$, $R_{12}$ and $R_{13}$ independently represent a hydrogen atom, a substituted or unsubstituted alkyl group, aryl group or heterocyclic group; $R_{14}$ represents a hydroxyl group, a hydroxyamino group, a substituted or unsubstituted alkyl group, aryl group, heterocyclic group, alkoxy group, aryloxy group, carbamoyl group or amino group. The heterocyclic group is a 5- or 6-membered ring comprising C, H, O, N, S and halogen atoms, whether saturated or unsaturated. $R_{15}$ represents a divalent group selected from the group comprising —CO—, $-SO_2-$ and

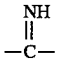

n represents 0 or 1. Provided that n is 0, $R_{14}$ represents a group selected from an alkyl group, an aryl group and a heterocyclic group; $R_{13}$ and $R_{14}$ may cooperate to form a heterocyclic group.

Examples of the hydroxylamine compound represented by formula A are given in U.S. Pat. Nos. 3,287,125, 33,293, 034 and 3,287,124 and other publications. Particularly preferable compounds are compound Nos. A-1 through A-39 described on pages 36 through 38 of Japanese Patent Application No. 203169/1990, compound Nos. 1 through 53 described on pages 3 through 6 of Japanese Patent O.P.I. Publication No. 33845/1991 and compound Nos. 1 through 52 described on pages 5 through 7 of Japanese Patent O.P.I. Publication No. 63646/1991.

Examples of the compound represented by formula B are compound Nos. B-1 through B-33 described on pages 40 through 43 of Japanese Patent Application No. 203169/1990 and compound Nos. 1 through 56 described on pages 4 through 6 of Japanese Patent O.P.I. Publication No. 33846/1991.

These compounds represented by formula A or B are used normally in the forms of free amine, hydrochloride, sulfate, p-toluenesulfonate, oxalate, phosphate, acetate and others.

The color developer and black-and-white developer used for the present invention may incorporate a trace amount of sulfite as a preservative. Examples of such sulfites include sodium sulfite, potassium sulfite, sodium bisulfite and potassium bisulfite.

The color developer and black-and-white developer used for the present invention must contain a buffer. Examples of buffers include sodium carbonate, potassium carbonate, sodium bicarbonate, potassium bicarbonate, trisodium phosphate, tripotassium phosphate, dipotassium phosphate, sodium borate, potassium borate, sodium tetraborate (boric acid), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate).

Examples of developing accelerators which can be added as necessary include the thioether compounds disclosed in Japanese Patent Examined Publication Nos. 16088/1962, 5987/1962, 7826/1963, 12380/1969 and 9019/1970 and U.S. Pat. No. 3,813,247, the p-phenylenediamine compounds disclosed in Japanese Patent O.P.I. Publication Nos. 49829/1977 and 15554/1975, the quaternary ammonium salts disclosed in Japanese Patent O.P.I. Publication Nos. 137726/1975, 156826/1981 and 43429/1977 and Japanese Patent Examined Publication No. 30074/1969, the p-aminophenols disclosed in U.S. Pat. Nos. 2,610,122 and 4,119,462, the amine compounds disclosed in U.S. Pat. Nos. 2,494,903, 3,128,182, 4,230,796, 3,253,919, 2,482,546, 2,596,926 and 3,582,346 and Japanese Patent Examined Publication No. 11431/1966, the polyalkylene oxides disclosed in Japanese Patent Examined Publication Nos. 16088/1962, 25201/1967, 11431/1966 and 23883/1967 and U.S. Pat. Nos. 3,128,183 and 3,532,501, and 1-phenyl-3-pyrazolidones, hydrozines, meso-ionic compounds, ionic compounds and imidazoles.

Preferably, the color developer contains substantially no benzyl alcohol, specifically not more than 2.0 ml per liter of color developer, more preferably absolutely no benzyl alcohol. When the color developer contains substantially no benzyl alcohol, better results are obtained with less fluctuation in photographic properties in continuous processing, particularly less increase in the degree of staining.

For the prevention of fogging and other purposes, chlorine and bromine ions must be present in the color developer. In the present invention, it is preferable, from the viewpoint of developing speed, staining and minimum density fluctuation, that chlorine ions be contained at $1.0\times10^{-2}$ to $1.5\times10^{-1}$ mol/l, more preferably $4\times10^{-2}$ to $1\times10^{-1}$ mol/l. It is therefore preferable to prepare the solid processing agent to make the color developer in the processing tank have a concentration in the above range.

In addition to chlorine ions and bromine ions, the color developer and black-and-white developer used for the present invention may incorporate antifogging agents which are optionally selected as necessary. Antifogging agents which can be used include alkali metal halides such as potassium iodide and organic antifogging agents. Typical examples of organic antifogging agents include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine and adenine.

From the viewpoint of the desired effect of the present invention, it is preferable to add a triazinylstilbene brightening agent to the color developer and black-and-white developer used for the present invention. Said brightening agent is preferably represented by the following formula E:

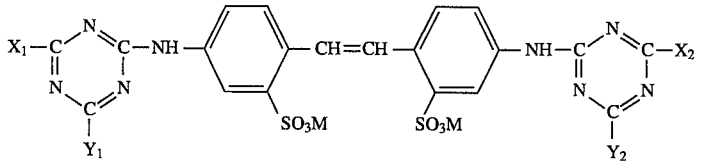

Formula E

In the present invention, it is preferable, from the viewpoint of developing speed, maximum density, sensitivity and minimum density, that the color developer in the processing tank contain bromine ions at a concentration of $3.0\times10^{-5}$ to $1.0\times10^{-3}$ mol/l, more preferably $5.0\times10^{-5}$ to $5\times10^{-4}$ mol/l, and still more preferably $1\times10^{-4}$ to $3\times10^{-4}$ mol/l. In this case as well, it is preferable to prepare the solid processing agent to make the color developer in the processing tank have a bromine concentration in the above range.

Provided that chlorine ions are added directly to the color developer, examples of chlorine ion sources include sodium chloride, potassium chloride, ammonium chloride, nickel chloride, magnesium chloride, manganese chloride, calcium chloride and cadmium chloride, with preference given to sodium chloride and potassium chloride.

Chlorine ions may also be supplied in the form of a counterpart salt of the color developer or the brightening agent added thereto. Examples of bromine ion sources include sodium bromide, potassium bromide, ammonium bromide, lithium bromide, calcium bromide, magnesium bromide, manganese bromide, nickel bromide, cadmium bromide, cerium bromide and thallium bromide, with preference given to potassium bromide and sodium bromide.

wherein $X_2$, $X_3$, $Y_1$ and $Y_2$ independently represent a hydroxyl group, a chlorine atom, a bromine atom or another halogen atom, an alkyl group, an aryl group,

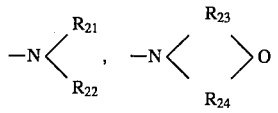

or —$OR_{25}$, wherein $R_{21}$ and $R_{22}$ independently represent a hydrogen atom, an alkyl group (may be substituted) or an aryl group (may be substituted); $R_{23}$ and $R_{24}$ each represent an alkylene group (may be substituted); $R_{25}$ represents a hydrogen atom, an alkyl group (may be substituted) or an aryl group (may be substituted); M represents a cation.

Details of the groups in formula E and substituents therefor are the same as those described in line 8 from bottom, page 63, through line 3 from bottom, page 64, of Japanese Patent Application No. 240400/1990.

Examples of the compound represented by formula E are given below.

| | M | $X_2$ | $Y_1$ | $X_3$ | $Y_2$ |
|---|---|---|---|---|---|
| E-1 | Na | 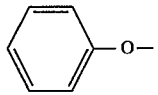 | $-NHC_2H_4OH$ | $-NHC_2H_4OH$ | 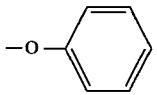 |
| E-2 | Na | $HOC_2H_4NH-$ | $-NHC_2H_4OH$ | $-NHC_2H_4OH$ | $-NHC_2H_4OH$ |
| E-3 | Na | 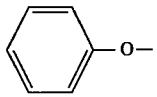 | $-N(C_2H_4OH)_2$ | $-N(C_2H_4OH)_2$ | 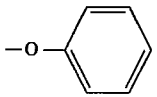 |
| E-4 | Na | $(HOC_2H_4)_2N-$ | $-OCH_3$ | $-OCH_3$ | $-NHC_2H_4SO_3Na$ |
| E-5 | Na | $HOCH_2CH_2NH-$ | $-N(C_2H_4OH)_2$ | $-N(C_2H_4OH)_2$ | $-NHCH_2CHOH$<br>\|<br>$CH_2OH$ |
| E-6 | Na | $(HOC_2H_4)_2N-$ | $-N(C_2H_4OH)_2$ | $-N(C_2H_4OH)_2$ | $-N(C_2H_4OH)_2$ |
| E-7 | Na | 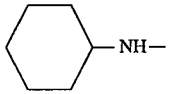 | $-NHC_2H_4OH$ | $-NHC_2H_4OH$ | 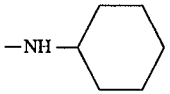 |
| E-8 | Na | 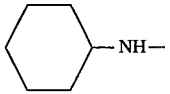 | $-N(C_2H_4OH)_2$ | $-N(C_2H_4OH)_2$ | 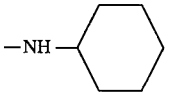 |
| E-9 | Na | $HO-$ | 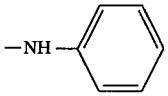 | 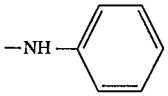 | $-OH$ |
| E-10 | Na | $H_2N-$ | 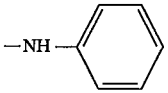 | 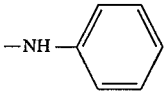 | $-NH_2$ |
| E-11 | Na | $CH_3O-$ | 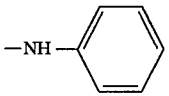 | 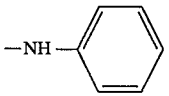 | $-OCH_3$ |

-continued
| | M | $X_2$ | $Y_1$ | $X_3$ | $Y_2$ |
|---|---|---|---|---|---|
| E-12 | Na | $HOC_2H_4NH-$ | 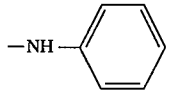 | 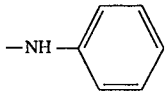 | $-NHC_2H_4OH$ |
| E-13 | Na | $(HOC_2H_4)_2N-$ | 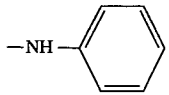 | 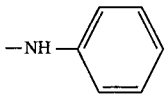 | $-N(C_2H_4OH)_2$ |
| E-14 | Na | $HOC_2H_4NH-$ | 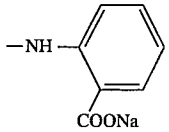 | 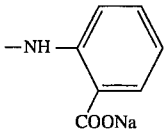 | $-NHC_2H_4OH$ |
| E-15 | Na | 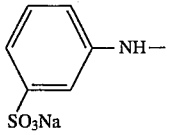 | $-N(C_2H_4OH)_2$ | $-N(C_2H_4OH)_2$ | 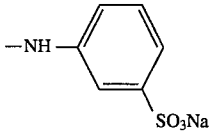 |
| E-16 | Na | 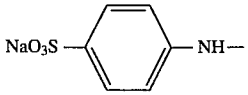 | $-N(C_2H_4OH)_2$ | $-N(C_2H_4OH)_2$ | 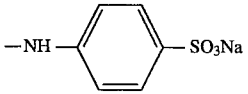 |
| E-17 | Na | 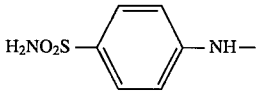 | $-N(C_2H_4OH)_2$ | $-N(C_2H_4OH)_2$ | 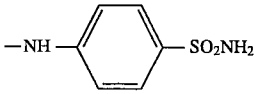 |
| E-18 | Na | 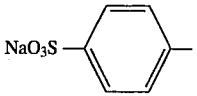 | $-N(C_2H_4OH)_2$ | $-N(C_2H_4OH)_2$ | 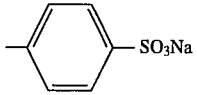 |
| E-19 | Na | $HOCH_2CH(CH_3)CH_2HN-$ | $-OCH_3$ | $-OCH_3$ | $-NHCH_2CH(CH_3)CH_2OH$ |
| E-20 | Na | $(HOC_2H_4)_2N-$ | 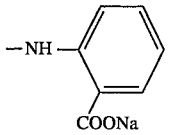 | 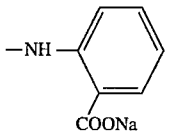 | $-N(C_2H_4OH)_2$ |

-continued
| | M | $X_2$ | $Y_1$ | $X_3$ | $Y_2$ |
|---|---|---|---|---|---|
| E-21 | Na | $HOC_2H_4NH-$ | 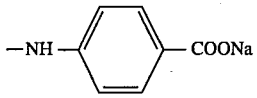 | 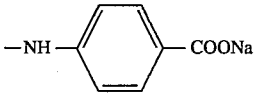 | $-NHC_2H_4OH$ |
| E-22 | Na | 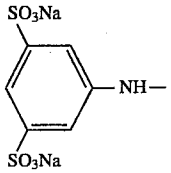 | $-NHC_2H_5$ | $-NHC_2H_5$ | 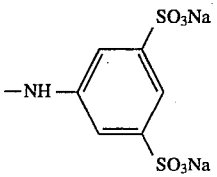 |
| E-23 | Na | 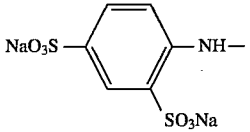 | $-NHCH_3$ | $-NHCH_3$ | 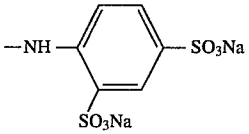 |
| E-24 | Na | 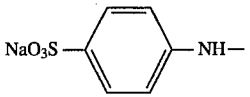 | 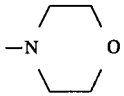 | 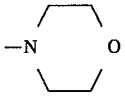 | 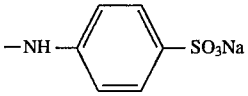 |
| E-25 | Na | $HOC_2H_4NH-$ | 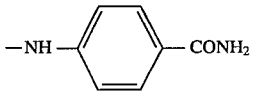 | 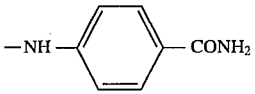 | $-NHC_2H_4OH$ |
| E-26 | Na | $HOC_2H_4NH-$ | 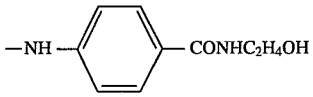 | 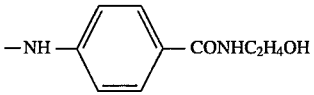 | $-NHC_2H_4OH$ |
| E-27 | Na | $(HOC_2H_4)_2N-$ | 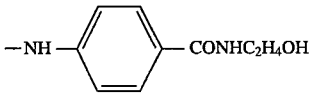 | 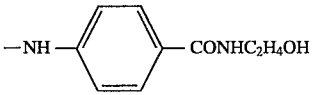 | $-N(C_2H_4OH)_2$ |
| E-28 | Na | $HOC_2H_4NH-$ | 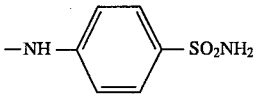 | 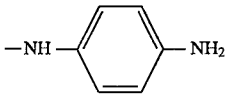 | $-NHC_2H_4OH$ |
| E-29 | Na | $HOC_2H_4NH-$ | 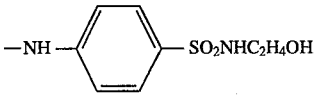 | 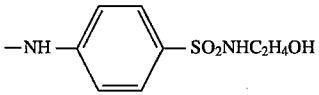 | $-NHC_2H_4OH$ |

-continued
| | M | $X_2$ | $Y_1$ | $X_3$ | $Y_2$ |
|---|---|---|---|---|---|
| E-30 | Na | $(HOC_2H_4)_2N-$ | 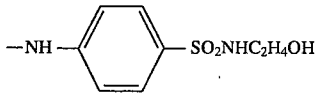 | 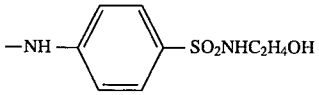 | $-N(C_2H_4OH)_2$ |
| E-31 | Na | 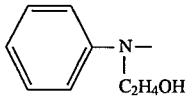 | 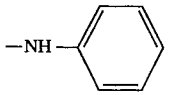 | 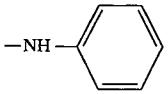 | 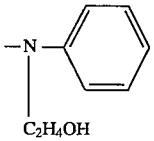 |
| E-33 | Na | 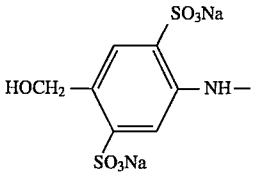 | 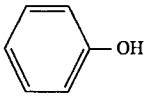 | 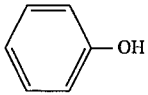 | 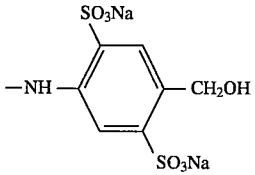 |
| E-33 | Na | 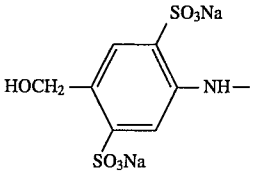 | $-NHC_2H_5$ | $-NHC_2H_5$ | 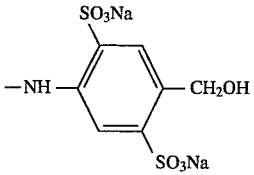 |
| E-34 | Na | $CH_3O-$ | $-NHCH_2CH(OH)CH_3$ | $-NHCH_2CH(OH)CH_3$ | $-OCH_3$ |
| E-35 | Na | 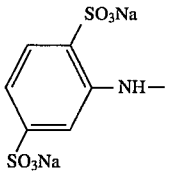 | 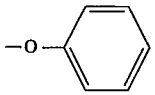 | 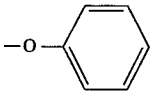 | 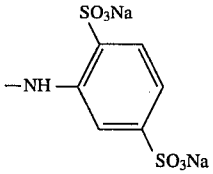 |
| E-36 | Na | 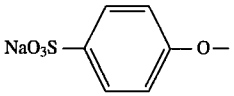 | $-N(C_2H_4OH)_2$ | $-N(C_2H_4OH)_2$ | 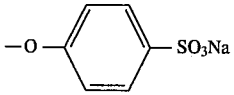 |

-continued
| | M | $X_2$ | $Y_1$ | $X_3$ | $Y_2$ |
|---|---|---|---|---|---|
| E-37 | Na | 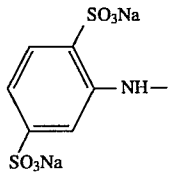 | $-N(C_2H_5)_2$ | $-N(C_2H_5)_2$ | 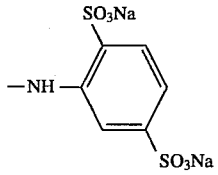 |
| E-38 | Na | 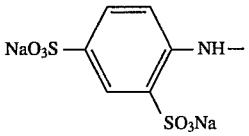 | $-NHCH_3$ | $-NHCH_3$ | 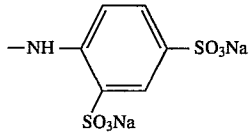 |
| E-39 | Na | $CH_3O-$ | $-NHCH(CH_2OH)CH_3$ | $-NHCH(CH_2OH)CH_3$ | $-OCH_3$ |
| E-40 | Na | $CH_3O-$ | $-N(C_2H_4OH)_2$ | $-N(C_2H_4OH)_2$ | $-OCH_3$ |
| E-41 | Na | $CH_3O-$ | $-NHC_2H_4SO_3Na$ | $-NHC_2H_4SO_3Na$ | $-OCH_3$ |
| E-42 | Na | $CH_3O-$ | $-NHC_2H_4OH$ | $-NHC_2H_4OH$ | $-OCH_3$ |
| E-43 | Na | $CH_3O-$ | 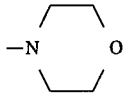 | 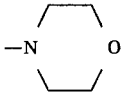 | $-OCH_3$ |
| E-44 | Na | $CH_3O-$ | $-NHC_2H_4SO_3K$ | $-NHC_2H_4SO_3K$ | |
| E-45 | Na | 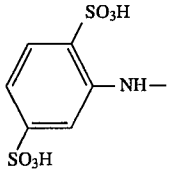 | $-N(C_2H_5)_2$ | $-N(C_2H_5)_2$ | 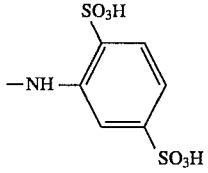 |

These compounds can be synthesized by known methods. Of the example compounds given above, E-4, E-24, E-34, E-35, E- 36, E-37 and E-41 are preferably used. It is preferable to prepare the solid processing agent so that the amount of these compounds added falls in the range from 0.2 to 10 g, preferably from 0.4 to 5 g per liter of color developer.

The color developer and black-and-white developer used for the present invention may also incorporate organic solvents such as methyl cellosolve, methanol, acetone, dimethylformamide, β-cyclodextrin and the compounds described in Japanese Patent Examined Publication Nos. 33378/1972 and 9509/1969 for increasing the solubility of the developing agent as necessary.

Auxiliary developing agents may be used in combination with the principal developing agent. Examples of such auxiliary developing agents include Metol, phenidone, N,N-diethyl-p-aminophenol hydrochloride and N,N,N',N'-tetramethyl-p-phenylenediamine hydrochloride.

It is also possible to use various additives such as anti-staining agents, anti-sludge agents and lamination effect enhancers.

It is preferable, from the viewpoint of efficient accomplishment of the desired effect of the present invention, that the color developer and the black-and-white developer incorporate one of the chelating agent represented by the following formula K and example compound Nos. K-1 through K- 22, described in line 8 from bottom, page 63, through line 3 from bottom, page 64, of Japanese Patent Application No. 240400/1990.

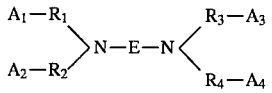

Formula K

Of these chelating agents, K-2, K-9, K-12, K-13, K-17 and K-19 are preferably used, with more preference given to K-2 and K-9, since their addition to the color developer enhances the effect of the invention.

It is preferable to add these chelating agents to the solid processing agent so that their amount falls in the range from 0.1 to 20 g, preferably from 0.2 to 8 g per liter of color developer or black-and-white developer.

The color developer and black-and-white developer may also contain anionic, cationic, amphoteric and nonionic surfactants.

Various surfactants such as alkylsulfonic acids, arylsulfonic acids, aliphatic carboxylic acids and aromatic carboxylic acids may be added as necessary.

The bleaching agents which are preferably used in the bleacher or bleach-fixer relating to the present invention are ferric complex salts of the organic acid represented by the following formula C:

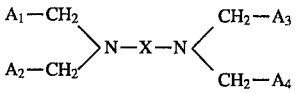

Formula C wherein $A_1$ through $A_4$, whether identical or not, independently represent —$CH_2OH$, —COOM or —$PO_3M_1M_2$; M, $M_1$ and $M_2$ independently represent a hydrogen atom, an atom of alkali metal or ammonium. X represents a substituted or unsubstituted alkylene group having 3 to 6 carbon atoms.

The compound represented by formula C is described in detail below.

$A_1$ through $A_4$ in formula IV are not described in detail here, since they are identical with $A_1$ through $A_4$ described in line 15, page 12, through line 3, page 15, of Japanese Patent Application No. 260628/1989.

A ferric complex salt of the organic acid represented by formula C is preferably used for the present invention, since a small amount is sufficient to solidify itself because of the high bleaching capability so that weight and size reduction is possible, and since it offers an additional effect of improving the storage stability of solid processing agent.

Examples of preferred compounds represented by the above formula C are given below.

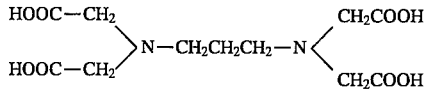

(C-1)

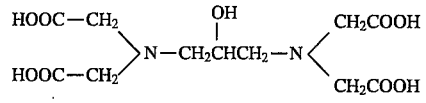

(C-2)

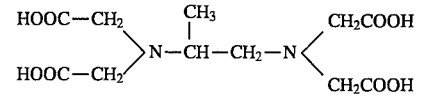

(C-3)

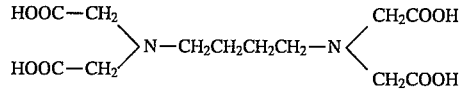

(C-4)

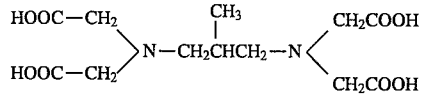

(C-5)

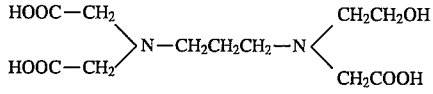

(C-6)

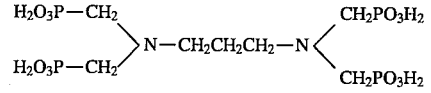

(C-7)

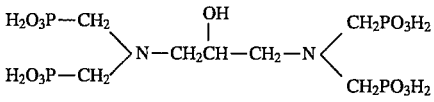

(C-8)

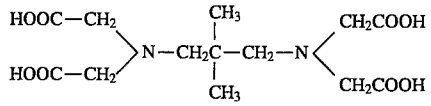

(C-9)

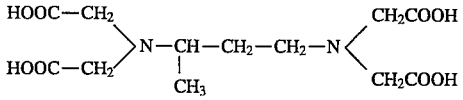

(C-10)

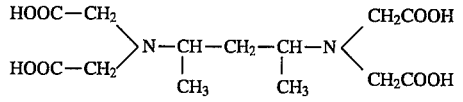

(C-11)

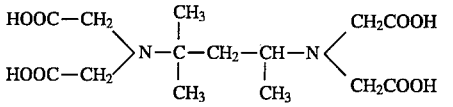

(C-12)

The ferric complex salts of these compounds C-1 through C-12 may be sodium salts, potassium salts or ammonium salts thereof, which can be selected optionally. From the viewpoint of the desired effect of the present invention and solubility, ammonium salts of these ferric complex salts are preferably used.

Of the compounds exemplified above, C-I, C-3, C-4, C-5 and C-9 are preferred, with more preference given to C-1.

In the present invention, ferric complex salts of the following compounds and others can be used as bleaching agents for the bleacher or bleach-fixer in addition to the iron complex salts of the compound represented by the above formula C.

A'-1: Ethylenediaminetetraacetic acid
A'-2: trans-1,2-cyclohexanediaminetetraacetic acid
A'-3: Dihydroxyethylglycinic acid
A'-4: Ethylenediaminetetrakismethylenephosphonic acid
A'-5: Nitrilotrismethylenephosphonic acid
A'-6: Diethylenetriaminepentakismethylenephosphonic acid
A'-7: Diethylenetriaminepentaacetic acid
A'-8: Ethylenediaminediorthohydroxyphenylacetic acid
A'-9: Hydroxyethylethylenediaminetriacetic acid
A'-10: Ethylenediaminedipropionic acid
A'-11: Ethylenediaminediacetic acid
A'-12: Hydroxyethyliminodiacetic acid
A'-13: Nitrilotriacetic acid
A'-14: Nitrilotripropionic acid
A'-15: Triethylenetetraminehexaacetic acid
A'-16: Ethylenediaminetetrapropionic acid
A'-17: β-alaninediacetic acid The amount of the above-mentioned ferric complex salt of organic acid added preferably falls in the range from 0.01 to 2.0 mol, more preferably from 0.05 to 1.5 mol per liter of bleacher or bleach-fixer. It is therefore preferable to prepare the solid processing agent so that the organic acid ferric complex salt concentration of the bleacher or bleach-fixer in the processing tank falls in the above range.

The bleacher may incorporate at least one of the imidazole described in Japanese Patent O.P.I. Publication No. 295258/1989, derivatives thereof and the compounds represented by formulas I through IX given in the same publication, whereby rapid processing is facilitated.

In addition to the above-mentioned developing accelerators, the example compounds given on pages 51 through 115 of Japanese Patent O.P.I. Publication No. 123459/1987, the example compounds given on pages 22 through 25 of Japanese Patent O.P.I. Publication No. 17445/1988 and the compounds described in Japanese Patent O.P.I. Publication Nos. 95630/1978 and 28426/1978 can also be used.

In addition to the above-mentioned additives, the bleacher or bleach-fixer may incorporate halides such as ammonium bromide, potassium bromide and sodium bromide, various brightening agents, defoaming agents and surfactants.

The fixing agents which are preferably used in the fixer or bleach-fixer for the present invention are thiocyanates and thiosulfates. The amount of thiocyanate added is preferably not less than 0.1 mol/l, more preferably not less than 0.5 mol/l, and still more preferably not less than 1.0 mol/l for processing a color negative film. The amount of thiosulfate added is preferably not less than 0.2 mol/l, more preferably not less than 0.5 mol/l for processing a color negative film. Also, the object of the present invention can be more efficiently accomplished by using a thiocyanate and a thiosulfate in combination.

In addition to these fixing agents, the fixer or bleach-fixers for the present invention may contain two or more pH regulators comprising various salts. It is also desirable to add a large amount of a re-halogenating agent such as an alkali halide or an ammonium halide, e.g., potassium bromide, sodium bromide, sodium chloride or ammonium bromide. Compounds which are known to be added to fixer or bleach-fixer, such as alkylamines and polyethylene oxides, may be added as appropriate.

It is preferable to add a compound represented by the following formula FA, described on page 56 of Japanese Patent O.P.I. Publication No. 295258/1989, to the fixer or bleach-fixer, whereby not only the effect of the invention is enhanced but also an additional effect is obtained in that sludge formation in the processing solution capable of fixing is significantly suppressed during prolonged processing of a small amount of light-sensitive material.

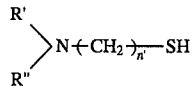

Formula FA

Compounds represented by formula FA can be synthesized by ordinary methods such as those described in U.S. Pat. Nos. 3,335,161 and 3,260,718. These compounds represented by formula FA may be used singly or in combination.

Good results are obtained when these compounds represented by formula FA are used in amounts of 0.1 to 200 g per liter of processing solution.

In the present invention, it is preferable to add a chelating agent having a ferric ion chelate stability constant of over 8 to the stabilizer. Here, the chelate stability constant is the constant which is well known in L. G. Sillen and A. E. Martell, "Stability Constants of Metal Ion Complexes", The Chemical Society, London (1964), S. Chaberek and A. E. Martell, "Organic Sequestering Agents", Wiley (1959), and other publications.

Examples of chelating agents having a ferric ion chelate stability constant of over 8 include those described in Japanese Patent Application Nos. 234776/1990 and 324507/1989.

The amount of the above chelating agent used is preferably 0.01 to 50 g, more preferably 0.05 to 20 g per liter of stabilizer, in which content range good results are obtained.

Ammonium compounds are preferably added to the stabilizer, which are supplied as ammonium salts of various inorganic compounds. The amount of ammonium compound added preferably falls in the range from 0.001 to 1.0 mol, more preferably from 0.002 to 2.0 mol per liter of stabilizer.

The stabilizer preferably contains a sulfite.

The stabilizer preferably contains a metal salt in combination with the chelating agent described above. Examples of such metal salts include salts of Ba, Ca, Ce, Co, In, La, Mn, Ni, Bi, Pb, Sn, Zn, Ti, Zr, Mg, Al and Sr, and it can be supplied as an inorganic salt such as halide, hydroxide, sulfate, carbonate, phosphate or acetate, or a water-soluble chelating agent. The amount of metal salt added preferably falls in the range from $1\times10^{-4}$ to $1\times10^{-1}$ mol, more preferably from $4\times10^{-4}$ to $2\times10^{-2}$ mol per liter of stabilizer.

EXAMPLES

Example 1

An example of automatic processing machine to which the present invention is applicable is described by means of drawings. FIG. 1 is a schematic diagram of a printer processor wherein automatic processing machine A and photographic printer B are unified.

In FIG. 1, in the lower left of photographic printer B is set a magazine M housing a roll of printing paper which is an unexposed silver halide photographic light-sensitive material. The printing paper drawn from the magazine is cut into a sheet of printing paper of given size via roller R and cutter portion C. This sheet of printing paper is transported by transporting belt B to exposure portion E, where it is subjected to exposure for original image 0. The thus-exposed sheet of printing paper is further transported by a number of pairs of feed roller R to automatic processing machine A. In the automatic processing machine A, the sheet of printing paper is sequentially transported through color developing tank 1A, bleach-fixing tank 1B and stabilizing tanks 1C, 1D and 1E (comprising substantially three tanks) by a transporting roller (no reference symbol given), where it is subjected to color development, bleach-fixation and stabilization, respectively. The sheet of printing paper thus processed is dried at drying portion 35 and then discharged out of the automatic processing machine.

In the figure, the dashed line indicates the transportation path for silver halide photographic light-sensitive material. Also, although the light-sensitive material is introduced to automatic processing machine A in a cut form in this example, it may be introduced to the automatic processing machine in a band form. In such a case, processing efficiency can be improved by providing an accumulator for transient retention of the light-sensitive material between automatic processing machine A and photographic printer B. Also, the automatic processing machine relating to the present invention may be unified with photographic printer B or may stand alone. The silver halide photographic light-sensitive material processed by the automatic processing machine relating to the present invention is not limited to exposed printing paper; it may be an exposed negative film or the like. Although the following description of the present invention concerns with an automatic processing machine which comprises substantially three tanks, namely a color developing tank, a bleach-fixing tank and a stabilizing tank, it is not to be construed as limitative; the invention is applicable to automatic processing machines which comprise substantially four tanks, namely a color developing tank, a bleaching tank, a luring tank and a stabilizing tank.

The invention may also be applied to an automatic processing machine wherein a developing tank, a bleaching tank, a bleach-fixing tank and a stabilizing tank are provided in the order of processing a light-sensitive material. Further, the invention may be applied also to an automatic processing machine wherein a developing tank and a fixing tank are provided in the order of processing a light-sensitive material. Even in the aforementioned cases, each processing tank is naturally structured as indicated below.

Figure 2:
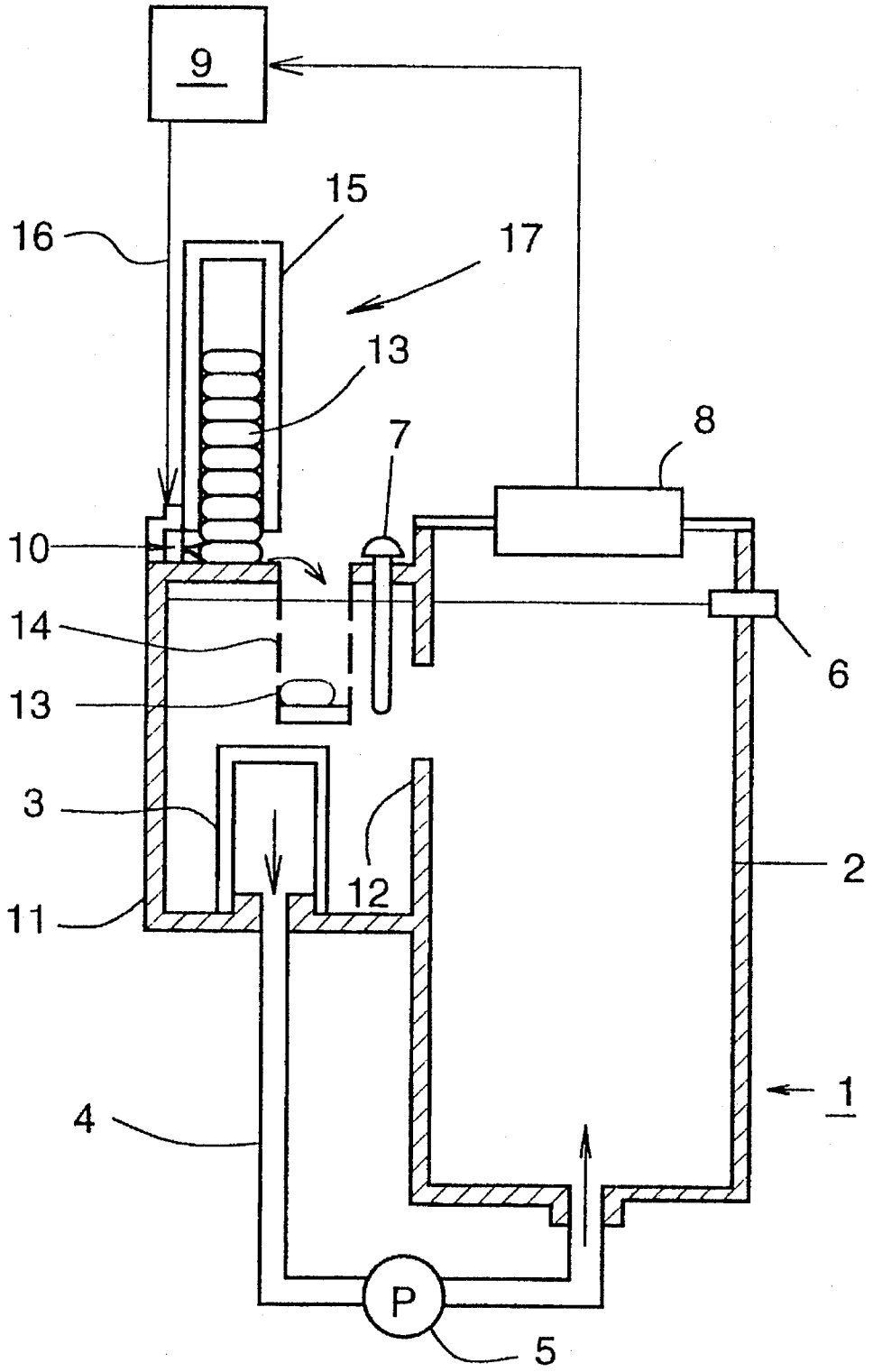
FIG. 2 is a cross-sectional view of the processing agent receiving portion and processing agent supplying means for an automatic processing machine.

FIG. 2 is a schematic diagram of color developing tank 1A of automatic processing machine A of FIG. 1, as viewed on the I—I cross-section thereof. Bleach-fixing tank 1B and stabilizing tanks 1C, 1D and 1E are of the same configuration as color developing tank 1A; processing tank 1 mentioned hereinafter means any of color developing tank 1A, bleach-fixing tank 1B and stabilizing tanks 1C, 1D and 1E. In the figure, light-sensitive material transporting means etc. are not illustrated for simple representation. Also, the present example concerns with the use of tablet 13 as a solid processing agent.

Processing tank 1 has processing portion 2 for processing a light-sensitive material and solid processing agent receiving portion 11 which is unified outside the separating wall of said processing portion 2 and to which tablet 13 is supplied. Processing portion 2 and solid processing agent receiving portion 11 are mutually separated by separating wall 12 having a communicating window, which allows passage of the processing solution. Because receiving portion 11 has processing agent receiving section 14 formed therein, the processing agent never moves to processing portion 12 while remaining solid.

Cylindrical filter 3, provided under solid processing agent receiving portion 11 in an exchangeable state, functions to remove insoluble substances, such as paper rubbish, from the processing solution. The inside of filter 3 communicates to the aspiration side of circulatory pump 5 (means for circulation) via circulatory pipe 4 set through the lower wall of solid processing agent receiving portion 11.

The circulatory system is configured with circulatory pipe 4 forming a solution circulating path, circulatory pump 5, processing tank 1 and other elements. The other end of circulatory pipe 4 communicating to the discharge side of circulatory pump 5 passes through the lower wall of processing portion 2 and communicates to said processing portion 2. By this configuration, upon activation of circulatory pump 5, the processing solution is aspirated via solid processing agent receiving portion 11 and discharged to processing portion 2, where it is mixed with the processing-solution in processing portion 2 and then returns to solid processing agent receiving portion 11; this circulation is repeated in cycles. The flow rate of this circulatory flow is preferably 0.5–2.0 rotations (1 rotation=circulatory volume/tank capacity), more preferably 0.8. to 2.0 rotations per minute and further preferably 1.0–2.0 rotations. Also, the direction of circulation of the processing solution is not limited to the direction shown in FIG. 2; it may be opposite.

Waste liquid discharge pipe 6, which is for overflowing the processing solution in processing portion 2, serves not only to keep the liquid level constant but also to prevent retention and concentration of the components carried over with the light-sensitive material from the processing solution in the processing portion and the components oozing out from the light-sensitive material.

Bar heater 7 is arranged in such manner that it passes through the upper wall of solid processing agent receiving portion 11 and is immersed in the processing solution in solid processing agent receiving portion 11. This heater 7 is for heating the processing solution in processing tank 1, i.e., it is a temperature controlling means for retaining the processing solution in processing tank 1 in an appropriate temperature range (e.g., from 20° to 55° C.).

Processing amount information detecting means 8, provided at the inlet of the automatic processing machine, is used to detect information on the amount of processing of the light-sensitive material. This processing amount information detecting means 8 comprises a plurality of left-right arranged detecting elements and functions to detect the width of the light-sensitive material and count the detection time. Because the transportation rate of the light-sensitive material is pre-set mechanically, the area of light-sensitive material processed can be calculated from information on the width and the time. This processing amount information detecting means may be any one, as long as it is capable of detecting the width and transportation time of light-sensitive material. Examples of such processing amount information detecting means include an infrared sensor, a microswitch and an ultrasonic sensor. In the case of the printer processor of FIG. 1, the processing amount information detecting means may be such that the area of light-sensitive material processed is indirectly detected, e.g., the amount of light-sensitive material printed, or the number of pre-set area of light-sensitive material units processed may be detected. Detection timing, which is before processing in the present example, may be after processing or during immersion in the processing solution (these can be achieved by properly changing the position of processing amount information detecting means 8 to another position allowing information detection after or during processing). The information detected is not limited to the area of light-sensitive material processed as in the above description; any information can serve for the purpose, as long as it is a value in proportion to the amount of light-sensitive material which is to be processed, which was processed or which is being processed; it may be the concentration of the processing solution in the processing tank or the change therein. Processing amount information detecting means 8 need not always be provided for each of processing tanks 1A, 1B, 1C, 1D and 1E; it is preferable to provide one processing amount information detecting means 8 for each automatic processing machine.

Processing agent supplying means 17 for adding the solid processing agent, stocked in cartridge 15, to the processing tank, arranged above faltering portion (section) 14 described below, has cartridge 15 containing tablet 13 (solid processing agent), and pusher 10 for pushing out one or more pieces of tablet 13. This processing agent supplying means 17 is controlled by processing agent supply controlling means 9 described later, and upon supplying signal reception from processing agent supply controlling means 9, it pushes out waiting tablet 13 by means of pusher 10 to filtering portion (section) 14 in solid processing agent receiving portion 11. In the present invention, solid processing agent 13 is supplied to filtering portion (section) 14 in solid processing agent receiving portion 11, but it may be supplied to any portion in processing tank 1. In other words, with respect to the position to which the solid processing agent is added, the present invention requires merely the capability of dissolving the solid processing agent using the processing solution; it is necessary to add the components according to the information on the mount of processing of light-sensitive material and keep the processing performance of the processing solution in processing tank 1 constant. More preferably, the solid processing agent is supplied to the circulatory path for the processing solution. Preferably, this processing agent supplying means 17 is arranged to avoid contact of the solid processing agent before being supplied to the processing tank with moisture in the processing tank of the automatic processing machine, atmospheric moisture and the spilled processing solution.

Filtering means (section) 14, immersed in the processing solution in solid processing agent receiving portion 11, removes the substances which originate from tablet 13 and other types of solid processing agent and which can cause flaws in the finished image, poor processing in the portion to which they adhere, and other undesirable things, if they adhere to the light-sensitive material, such as insoluble substances from tablet 13 supplied by processing agent supplying means 17, e.g., insoluble contaminants in tablet 13, and lumps of tablet 13 resulting from its disintegration. This filtering means (section) 14 is coated with resin. The filtering portion need not always be provided in solid processing agent receiving portion 11; it may be provided at any position, as long as tablet 13 supplied by processing agent supplying means 17 does not enter the light-sensitive material transporting path illustrated in FIG. 1 or the processing solution in processing portion 2.

Processing agent supply controlling means 9 controls processing agent supplying means 17; when the information on the amount of processing of light-sensitive material (processing area, in the present example), as detected by processing amount information detecting means 8, reaches a given level, it passes a processing agent supplying signal to processing agent supplying means 17. Processing agent supply controlling means 9 controls processing agent supplying means 17 so that the required amount of processing agent according to the information on the amount of light-sensitive material processed is supplied to solid processing agent receiving portion 11.

Next, the action of the present invention is described by means of FIG. 2. With respect to the exposed light-sensitive material, information on the amount of processing is detected by processing amount information detecting means 8 at the inlet of automatic processing machine A. Upon reach of the integrated area of light-sensitive material processed to a given level, processing agent supply controlling means 9 passes a supplying signal to processing agent supplying means 17 according to the information on the amount of processing detected by processing amount information detecting means 8. Upon supplying signal reception, processing agent supplying means 17 pushes out and supplies tablet 13 by means of pusher 10 to filtering portion (section) 14 in solid processing agent receiving portion 11. Tablet 13 thus supplied is dissolved in the processing solution in solid processing agent receiving portion 11, wherein its dissolution is facilitated by the processing solution being circulated by a means for circulation in the cycle of solid processing agent receiving portion 11→circulatory pump 5→processing portion 2→communicating window→solid processing agent receiving portion 11. The detected light-sensitive material is sequentially transported by a transporting roller through color developing tank 1A, bleach-fixing tank 1B and stabilizing tanks 1C, 1D and 1E (see automatic processing machine A in FIG. 1). Here, carry-over time during which a light-sensitive material emerges from a processing solution in a processing tank and enters a processing solution in the following processing tank is normally 5 seconds or less and preferably 1 second or less. Color developing tank 1A, bleach-fixing tank 1B and stabilizing tanks 1C, 1D and 1E may be equipped with processing agent supplying means 17A, 17B, 17C, 17D and 17E, respectively, for simultaneously supplying the processing agent thereto. Supplying timing may be different among these supplying means. The given area based on which the processing agent supplying means is controlled by processing agent supply controlling means 9 may be constant among processing tanks 1A, 1B, 1C, 1D and 1E or not.

Another embodiment of the present invention is described below. Bleach-fixing tank 1B and stabilizing tanks 1C, 1D and 1E are of the same configuration as color developing tank 1A; processing tank 1 mentioned hereinafter means any of color developing tank 1A, bleach-fixing tank 1B and stabilizing tanks 1C, 1D and 1E. Since the same numbers as in FIG. 2 are used for corresponding components having the same function, they are not described here. Also, light-sensitive material transporting means etc. are not illustrated for simple representation. In this example, a faltering means has been mentioned as a preferred example, the desired effect of the present invention can be sufficiently obtained even in the absence of such a filtering means.

As stated above, the present invention is excellently effective in that a compact automatic processing machine is realized because replenisher tanks are unnecessary, which are necessary for conventional automatic processing machines, and hence no space therefor is required, that solution preparing operation is unnecessary because a solid processing agent is supplied to the processing tank so that there is no fear of solution spillage or adhesion to, and contamination of, the human body, clothing and peripheral equipment during solution preparation, and handling is easy, and that processing solution replenishing accuracy improves so that stable processing performance is obtained without deterioration of the processing agent replenisher components.

Figure 3:
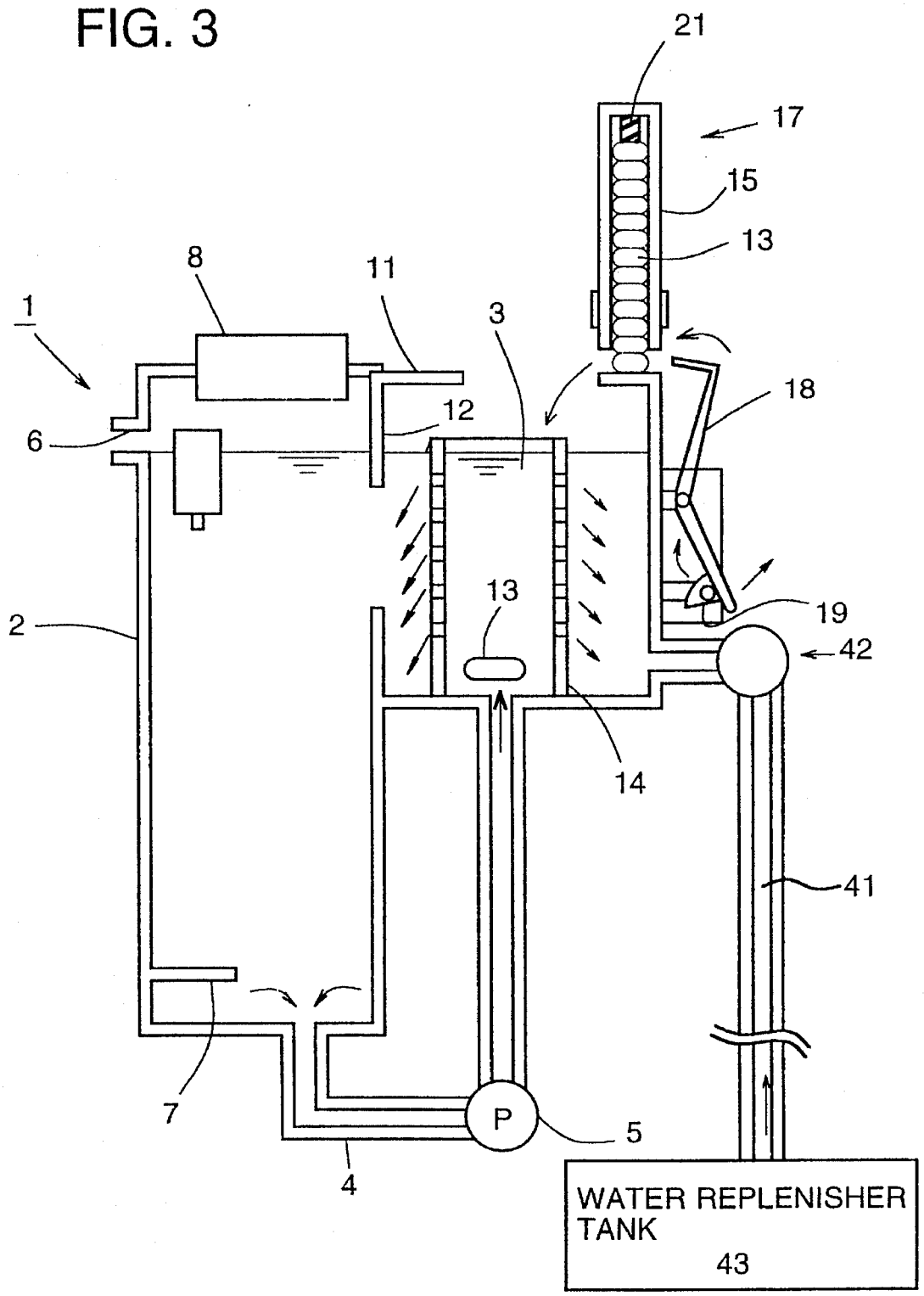
FIG. 3 is a cross-sectional view of the processing agent receiving portion, processing agent supplying means and replenishing water supplying means for an automatic processing machine.
Figure 4:
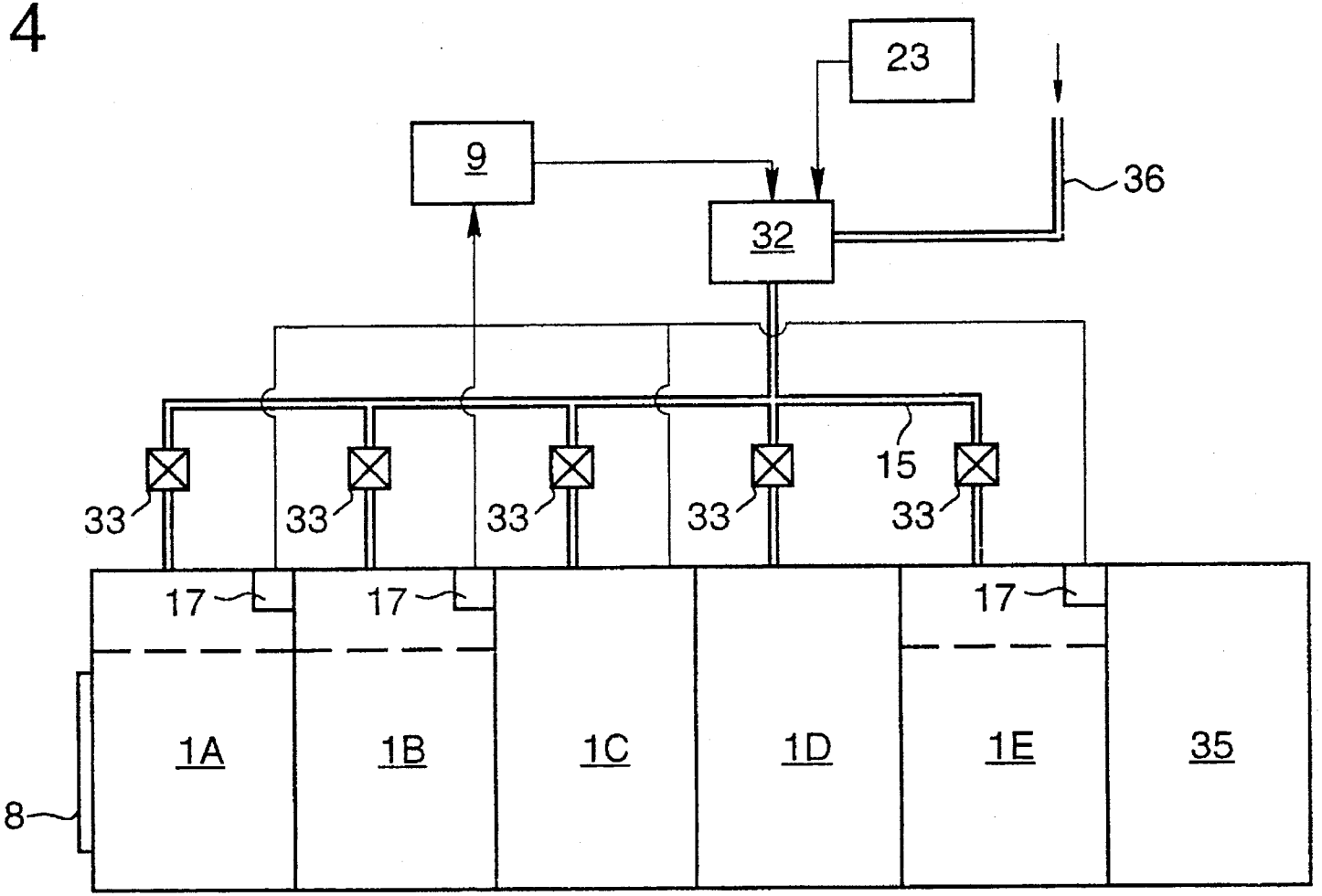
FIG. 4 is a plan of the automatic processing machine A described above.
Figure 5:
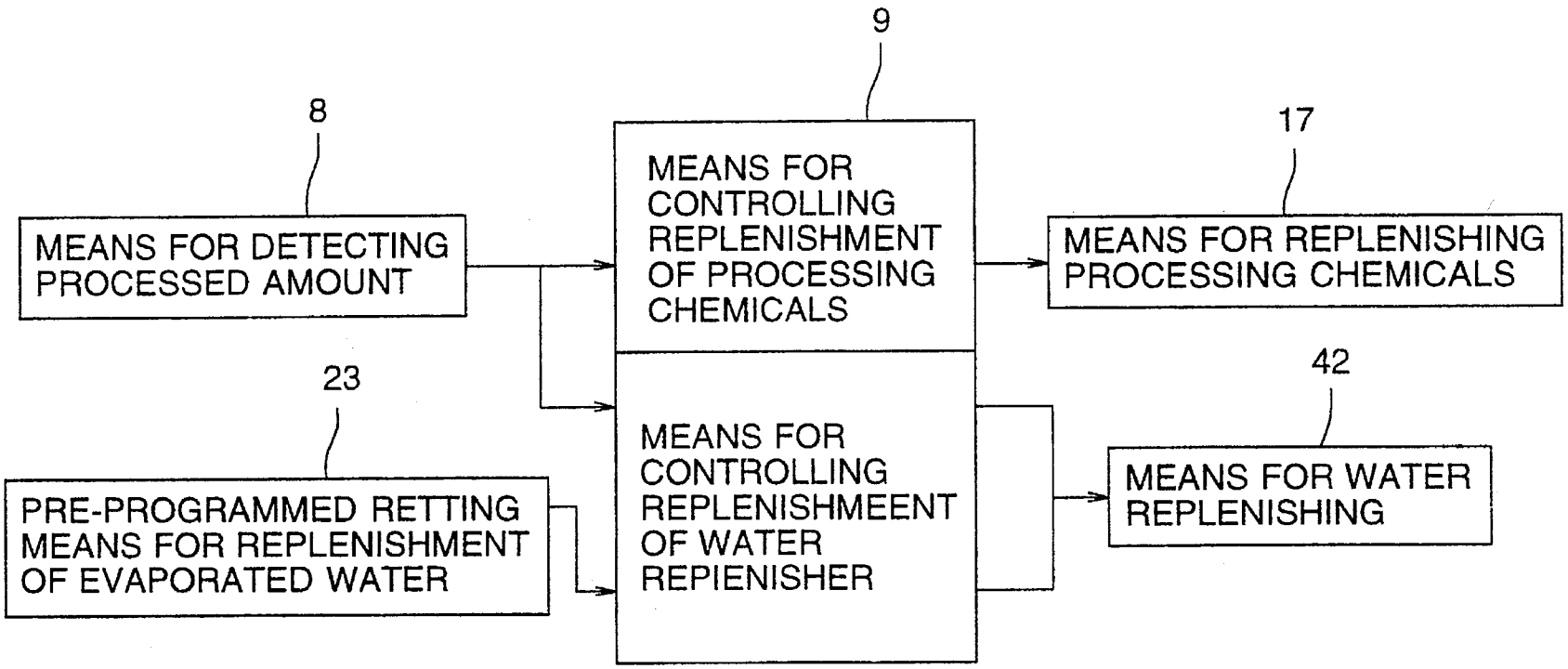
FIG. 5 is a block diagram showing the control means for an automatic processing machine.
Figure 6:
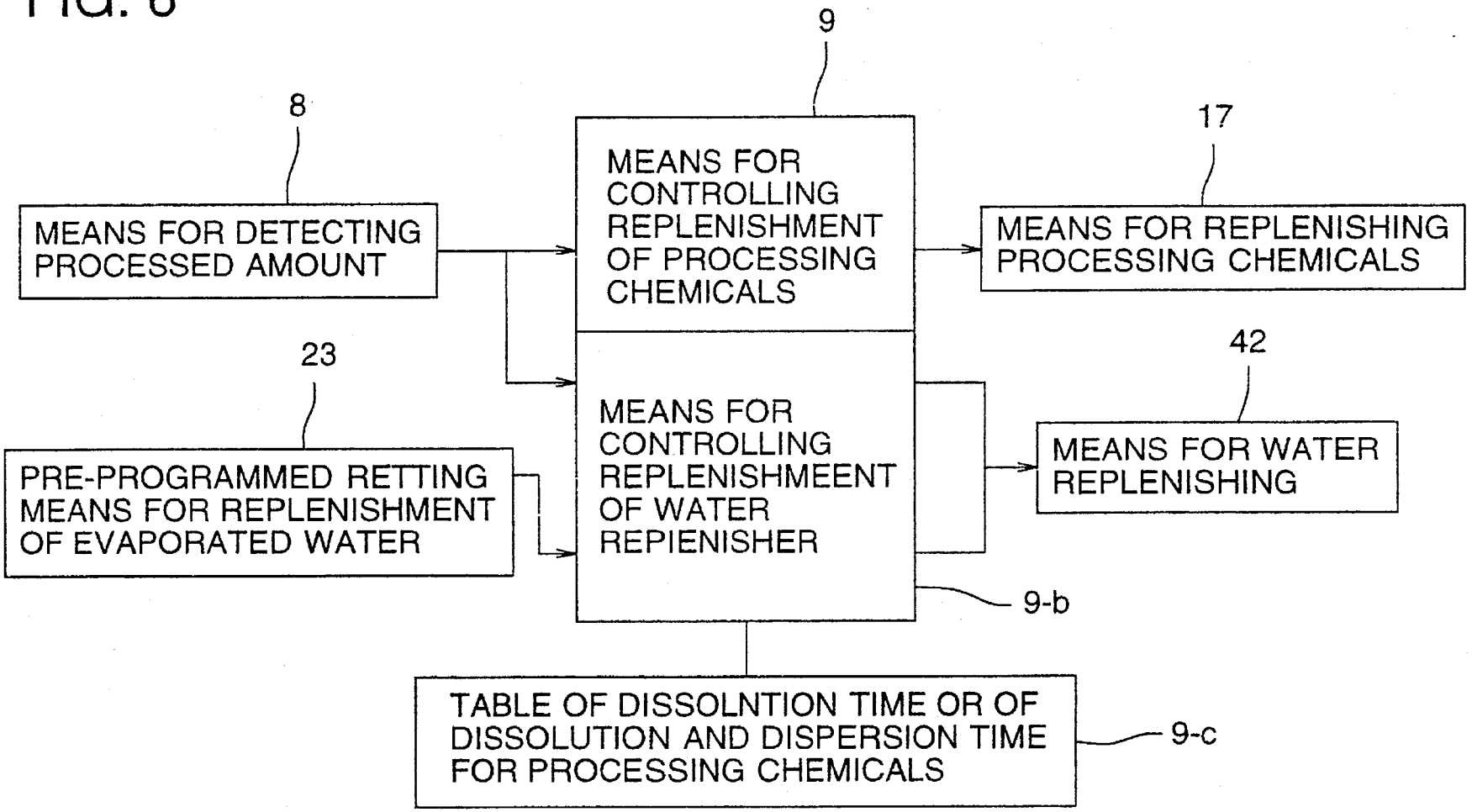
FIG. 6 is a block diagram showing the control means with a dissolution table of an automatic processing machine.

As another embodiment of the present invention, FIG. 3 shows a schematic diagram of color developing tank 1A of automatic processing machine A of FIG. 1, as viewed on the I—I cross-section. FIG. 4 is a schematic diagram of automatic processing machine A of FIG. 1, as viewed from above (for the sake of explanation, the path for the replenishing water supplying means is illustrated). FIG. 5 is a block diagram of the control relating to this example. FIG. 6 is a block diagram of a combination of the controlling means and a programmed evaporated water replenishing setting means 23. FIGS. 3 and 4 illustrate replenishing water tank 43 for storing replenishing water. In this example, tablet 13 is used as a solid processing agent.

With respect to FIGS. 3 and 4, the parts different from FIG. 2 are first described below.

Replenishing water supplying means 42 is for supplying replenishing water from replenishing water tank 43 for storing replenishing water to processing agent receiving portion 11, having warm water supplying apparatus 32, which comprises a pump, a temperature controller, etc., electromagnetic valve 33 and replenishing water supplying pipe 36. This replenishing water supplying means 42 serves to dilute the accumulated inhibitory components which dissolve upon reaction while compensating the water loss due to carry-over by the photographic material and evaporation via the tank surface. Although processing tanks 1A, 1B, 1C, 1D and 1E may be each provided with a water replenishing tank and a water replenishing pump, size reduction in the automatic processing machine is possible when the same replenishing water is used for all tanks, i.e., a single water replenishing tank alone is used. It is more preferable to arrange only one water replenishing tank and one water replenishing pump and provide an electromagnetic valve in the water replenishing path (pipe etc.) so that the required amount is supplied to each processing tank where necessary, or adjust the diameter of the water replenishing pipe to regulate the replenishing rate, whereby further size reduction is realized with only one water replenishing tank and only one water replenishing pump provided in the automatic processing machine. With respect to stabilizing tanks 1C and 1D, it is possible to remove the replenishing water supplying means by supplying the stabilizer overflow from stabilizing tanks 1D and 1E, respectively. It is also preferable to warm the replenishing water in the water replenishing tank.

Waters for this replenishment include not only ordinary waters such as well water and tap water but also those containing fungicides such as isothiazoline and chlorine-releasing compounds, a small amount of sulfite chelating agent, and ammonia or inorganic salt, as long as it does not affect photographic performance.

This replenishing water supply control means controls the replenishing water supplying means 42 by programmed evaporated water replenishing setting means 23 and/or controls the replenishing water supplying means 42 according to the information on the amount of processing detected by processing amount information detecting means 8. The base of control by this replenishing water supply control means is not confined to the information on the amount of processing detected by processing amount information detecting means 8; it may be the information of supply of the processing agent by processing agent supplying means 17.

The parts of FIG. 3 different from FIG. 2, other than those described above, whose function etc. are the same as in FIG. 2, are described below.

Heater 7, arranged in the bottom portion of processing portion 2, heats the processing solution in processing portion 2, i.e., it is a means for temperature control for retaining the processing solutions in processing portion 2 and solid processing agent receiving portion 11 in an appropriate temperature range (e.g., from 20° to 55° C.).

As means for circulation, circulatory pipe 4 and circulatory pump 5 are provided in the same manner as in FIG. 2, but the direction of processing solution circulation is opposite, i.e., the processing solution is circulated in the cycle of processing portion 2→circulatory pump 5→solid processing agent receiving portion 11→communicating window→processing portion 2.

Processing agent supplying means 17 supplies solidified processing agent 13, enclosed in cartridge 15, to faltering means (section) 14 in solid processing agent receiving portion 11 by means of pusher claw 18. It is different from FIG. 2 in that cure 19 is driven by 1 axial rotation stopping mechanism to activate pusher claw 18, whereby waiting tablet 13 is supplied to processing tank 1, while the next tablet 13 quickly becomes in a waiting state since it is under pressure exerted by tablet pushing spring 26 from above to below. Processing agent supplying means 17 may also be based on the side or upward method; it may be any one, as long as it is capable of adding the solid processing agent to processing tank 1.

Next, the action of the present invention is described by means of FIGS. 1, 3, 4 and 8. With respect to the exposed light-sensitive material, information on the amount of processing is detected by processing mount information detecting means 8 at the inlet of automatic processing machine A. Processing agent supply controlling means 9 sends a supplying signal to processing agent supplying means 17 according to the information on the amount of processing detected by processing amount information detecting means 8 upon reach of the integral area of light-sensitive material processed to the preset level. Upon supplying signal reception, processing agent supplying means 17 pushes out and supplies tablet 13 by means of pusher 10 to filtering portion (section) 14 in solid processing agent receiving portion 11. Tablet 13 thus supplied is dissolved in the processing solution in solid processing agent receiving portion 11, wherein its dissolution is facilitated by the processing solution being circulated by the means for circulation in the cycle of processing portion 2→circulatory pump 5→solid processing agent receiving portion 11→communicating window→processing portion 2. On the other hand, the replenishing water supplying means passes a water replenishing signal to replenishing water supplying means 42 (warm water supplying apparatus 32 and electromagnetic valve 33) according to the information on the amount of processing detected by processing amount information detecting means 8 upon reach of the integral area of light-sensitive material processed to the preset level. Upon water replenishing signal reception, replenishing water supplying means 42 controls warm water supplying apparatus 32 and electromagnetic valve 33 to supply a given or required amount of replenishing water, stored in replenishing water tank 43, to each or an appropriate processing tank. In this ease, the given area is equal to that for processing agent supply controlling means 9, but this is not limitative; the given areas may be different from each other. The detected light-sensitive material is sequentially transported through color developing tank 1A, bleach-fixing tank 1B and stabilizing tanks 1C, 1D and 1E by means of a transporting roller.

A control unit stops circulation of processing solutions in color developing tank 3 and others after the predetermined period of time from the moment when the control unit stops pressure-contact transport rollers. As the predetermined period of time, there is adopted a fixed period of time during which processing agents replenished simultaneously in processing solutions can be dissolved completely, or a time period that varies corresponding to replenishing time for the processing agent to be replenished last so that a time period from the last replenishment of processing agents to the stop of circulation of processing solutions may be the same as that during which processing agents replenished simultaneously can be dissolved completely. Owing to this, it can be avoided that circulation of processing solutions is stopped before replenished processing agents are dissolved completely.

An automatic processing machine equipped with various kinds of processing tanks has been described above. It should be noted, however, that an automatic processing machine for color negative films equipped with a developer tank, a bleacher tank, a bleach-fixer tank, a fixer tank and a stabilizer tank wherein at least the above stocking means and/or immobilizing means, the above supplying means and the above controlling means are provided for each of the above processing tanks, and an automatic processing machine for black-and-white silver halide photographic light-sensitive materials equipped with a developer tank and a fixer tank wherein at least the above stocking means and/or immobilizing means, the above supplying means and the above controlling means are provided for each of the above processing tanks, proved to have the effect of the present invention.

Example 2

Tables 1, 2 and 3 show example kit elements of conventional processing agents.

TABLE 1

(1) Color developer replenisher (for minilab use)
Per liter of replenisher (12.35 $m^2$ to be processed)

| Part | Ingredients | Amount of addition | Finished quantity | pH/specific gravity |
|---|---|---|---|---|
| A | Water | 30 g | 53 g | 11.0/1.058 |
| | Brightening agent | 2.5 g | (50 ml) | |
| | Diethylhydroxylamine | 5.5 g | | |
| | 40% solution of pentasodium diethylenetriamine pentaacetate | 1.0 g | | |
| B | Water | 23 g | 61 g | 0/1.2200 |
| | p-toluenesulfonic acid | 28 g | (51 ml) | |
| | 50% solution of potassium sulfite | 0.75 ml | | |
| | CD-3 | 9.3 g | | |
| C | Water | 16.0 g | 104 g | 14/1.405 |

TABLE 1-continued (1) Color developer replenisher (for minilab use)
Per liter of replenisher (12.35 $m^2$ to be processed)

| Part | Ingredients | Amount of addition | Finished quantity | pH/specific gravity |
|---|---|---|---|---|
| | KBr | 0.05 g | (74 ml) | |
| | 40% solution of pentasodium diethylenetriamine pentaacetate | 6.1 g | | |
| | 50% $K_2CO_3$ | 63.0 g | | |
| | 50% KOH | 19.0 g | | |
| | Total weight | | 218 g | |

TABLE 2

(2) Bleach-fixer replenisher (for color printing paper)
Per liter of replenisher(18.5 $m^2$ to be processed)

| Part | Ingredients | Amount of addition | Finished quantity | ph/specific gravity |
|---|---|---|---|---|
| A | Water | 334 g | 558 g | 5.70/1.250 |
| | Ammonium thiosulfate | 164 g | (450 ml) | |
| | Ammonium sulfite | 40 g | | |
| | Ammonium metabisulfite | 20 g | | |
| B | Water | 184 g | 438.5 g | 6.80/1.1450 |
| | 50% EDTA—FE salt | 250 g | (380 ml) | |
| | EDTA-4H | 4.5 g | | |
| C | Water | 96 g | 178 g | 0.70/1.050 |
| | Acetic acid | 82 g | (170 ml) | |
| | Total weight | | 1174.5 g | |

In the table above, the EDTA-Fe salt is ammonium ferric ethylenediaminetetraacetate, and DETA-4H is ethylenediaminetetraacetic acid.

TABLE 3

(3) Superstabilizer (for color printing paper)
Per liter of replenisher (4 $m^2$ to be processed)

| Part | Ingredients | Amount of addition | Finished quantity | ph/specific gravity |
|---|---|---|---|---|
| A | Water | 29 g | 30.5 g | 11.0/1.022 |
| | 48.5% KOH | 0.07 g | (30 ml) | |
| | 50% potassium sulfite | 0.32 g | | |
| | Antifungal agent | 0.10 g | | |
| | Brightening agent | 1.00 g | | |
| B | Water | 9.00 g | 22.6 g | 7.00/1.140 |
| | $ZnSO_4/7H_2O$ | 0.10 g | (20 ml) | |
| | 40% ammonium sulfite | 6.00 g | | |
| | 40% solution of 1-hydroxyethylidene-1,1-diphosphonic acid | 3.00 g | | |
| | Total weight | | 53.1 g | |

Tables 4, 5 and 6 show the kit elements of processing agents of the present invention.

TABLE 4

| (1) Color developer replenisher (for color printing paper) Per unit of solid processing agent | | | | |
|---|---|---|---|---|
| Part | Ingredients | Amount of addition | Solid weight/diameter | Number of units required (for comparison with conventional products) |
| A | Brightening agent (diaminostilbene) | 0.244 g | 3.20 g/ 15 mm | 12.35 $m^2$ to be processed |
| | Sodium sulfite | 0.030 g | | 12.3 |
| | KBr | 0.0024 g | | |
| | Diethylenetriaminepenta acetic acid | 0.203 g | | |
| | Sodium p-toluenesulfonate | 2.439 g | | |
| | KOH | 0.163 g | | |
| | PEG-6000 | 0.119 g | | |
| B | Disodium N,N-bis(sulfonatoethyl) hydroxylamine | 0.974 | 1.00 g/ 15 mm | 12.3 |
| | PEG-6000 | 0.026 g | | |
| C | CD-3 | 0.974 g | 1.00 g/ 15 mm | 12.3 |
| | PEG-6000 | 0.026 g | | |
| D | $K_2CO_3$ | 2.845 g | 3.00 g/ 15 mm | 12.3 |
| | PE-6000 | 0.154 g | | |
| | Total weight | | | 100.96 |

TABLE 5

| (2) Bleach-fixer replenisher (for color printing paper) | | | | |
|---|---|---|---|---|
| Part | Ingredients | Amount of addition | Solid weight/diameter per unit of solid processing agent | |
| A | EDTA—FE salt | 3.38 g | 4.29 g/20 mm | 18.5 $m^2$ to be treated |
| | Ethylenediaminetetraacetic acid | 0.12 g | | 24.8 |
| | Maleic acid | 0.67 g | | |
| | Laurylsarcosine sodium | 0.12 g | | |
| B | Ammonium thiosulfate | 2.22 g | 3.45 g/20 mm | 49.6 |
| | Sodium sulfite | 1.01 g | | |
| | Potassium bromide | 0.05 g | | |
| | p-toluenesulfinic acid | 0.07 g | | |
| | Laurylsarcosine sodium | 0.10 g | | |
| | Aqueous ammonia | 3.00 g | | |
| | EDTA-4H | 1.50 g | | |
| | Total weight | | | 277.5g |

In the table above, the EDTA-FE salt is ammonium ferric ethylenediaminetetraacetate.

TABLE 6

| Part | Ingredients | Amount of addition | Solid weight/diamter per unit of solid processing agent | Number of units required (for comparison with conventional products) |
|---|---|---|---|---|
| | (3) Superstabilizer (for color printing paper) | | | |
| A | $Na_2CO_3H_2O$ | 0.025 g | 3.13 g/ 20 mm | 4 $m^2$ to be processed |
| | 1-hydroxy-ethylidene-1,1-diphosphonic acid | 0.50 | | 4 |
| | Brightening agent | 0.375 g | | |
| | Sodium sulfite | 0.75 g | | |
| | $ZnSO_47H_2O$ | 0.50 g | | |
| | EDTA-2Na2$H_2O$ | 0.375 g | | |
| | $(NH_4)_2SO_4$ | 0.50 g | | |
| | Antifungal agent orthophenylphenol | 0.025 g | | |
| | PEG-6000 | 0.087 g | | |
| | Total weight | | | 12.52 g |

Processing agents according to the present invention are described with reference to Tables 7 and 8.

TABLE 7

| | Process | | Form | Amount of addition: Tank solution | Amount of addition: Replenisher | Replenisher/ Tank solution ratio | Replenishing agent kit pH | Replenishing agent kit concentration (%) | Corrosivity | Transport safety |
|---|---|---|---|---|---|---|---|---|---|---|
| Conventional | Color development | Mini-lab type | Solution A | 3.95 | 5.5 | 1.43 | 11.10 | 104.5 | Good | Good |
| | | | Solution B | 5.60 | 8.0 | 1.43 | 1.23 | 107 | Bad | Bad |
| | | | Solution C | 30.0 | 30.0 | 1.00 | more than 14 | 142 | Bad | Bad |
| | | Mini-lab quick type | Solution A | 3.25 | 5.5 | 1.69 | 11.00 | 106.8 | Good | Good |
| | | | Solution B | 5.50 | 9.3 | 1.69 | 1.05 | 117 | Bad | Bad |
| | | | Solution C | 30.0 | 30.0 | 1.00 | more than 14 | 143 | Bad | Bad |
| | | Large-lab low replenishing rate type | Solution A | 3.64 | 5.6 | 1.54 | 13.18 | 112 | Bad | Bad |
| | | | Powder B | 5.50 | 9.3 | 1.54 | — | — | Good | Good |
| | | | Powder C | 33.0 | 33.0 | 1.00 | — | — | Good | Good |
| | Bleach-fixation | Mini-lab type | Solution A | 67 | 72 | 1.08 | 6.65 | 121.6 | Good | Good |
| | | | Solution B | 48 | 52 | 1.08 | 6.64 | 112.8 | Bad | Bad |
| | | | Solution C | 12 | 13 | 1.08 | 1.29 | 105.4 | Bad | Bad |
| | | Mini-lab quick type | Solution A | 95 | 164 | 2.18 | 5.70 | 124 | Good | Good |
| | | | Solution B | 60 | 125 | 2.08 | 6.90 | 115 | Bad | Bad |
| | | | Solution C | Is | 27 | 1.90 | 2.02 | 105 | Bad | Bad |
| | | Large-lab low replenishing rate type | Solution A | 90 | 190 | 1.99 | 5.97 | 126.2 | Good | Good |
| | | | Powder B | 66 | 125 | 1.99 | — | — | Good | Good |
| | | | Powder C | 10 | 20 | 1.89 | — | — | Good | Good |
| | Super-stabilizer | Mini-lab type/Large-lab type | Solution A | 1.0 | 1.0 | 1.00 | 12.15 | 101 | Good | Good |
| | | | Solution B | 3.0 | 3.0 | 1.00 | 7.28 | 112.7 | Good | Good |
| | | | Powder A | 1.0 | 1.0 | 1.00 | — | — | Good | Good |

TABLE 8

| | Process | | Form | Amount of addition: Tank solution | Amount of addition: Replenisher | Replenishing rate | Corrosivity | Transport safety |
|---|---|---|---|---|---|---|---|---|
| Inventive | Color development | Mini-lab type/ large-lab type | Solid A | 15 | No replenishing solution present | 1 piece of 3.2 g solid processing agent per $m^2$ added | ○ | ○ |
| | | | Solid B | 8 | | 1 piece of 1.0 g solid processing agent per $m^2$ added | ○ | ○ |
| | | | Solid C | 55 | | 1 piece of 1.0 g solid processing agent per $m^2$ added | ○ | ○ |
| | | | Solid D | 30 | | 1 piece of 3.0 g solid processing agent per $m^2$ | ○ | ○ |

TABLE 8-continued

| Process | | Form | Amount of addition: Tank solution | Amount of addition: Replenisher | Replenishing rate | Corrosivity | Transport safety |
|---|---|---|---|---|---|---|---|
| | | | | | added | | |
| Bleach-fixation | Mini-lab type/ large-lab type | Solid A | 90 | | 1 piece of 4.2 g solid processing agent 0.5 $m^2$ added | ○ | ○ |
| | | Solid B | 60 | | 2 pieces of 3.45 g solid processing agent per 0.5 $m^2$ added | ○ | ○ |
| Super-stabilizer | Mini-lab type/Large-lab type | Solid A | 1.0<br>3.0 | | 1 piece of 3.13 g solid processing agent per $m^2$ added | ○<br>○ | ○<br>○ |

Processing agents for color printing paper are described. To prepare a conventional processing agent, concentrated components are used in liquid parts for the purpose of simplifying dissolution operation at mini-labs. In this case, long stable materials are used in combination to form several parts.

These kits are subject to limitation by the solubility of the chemical even if they are concentrated, so that water must be added in addition to the essential chemical components.

Adding unnecessary water results in increased transport cost.

In contrast, the processing agent of the present invention is solidified, requiring no water, and can comprise the essential chemicals only. Therefore, as seen in the comparison of Tables 1 through 3 and Tables 4 through 6, the weight of replenishing agent relative to the same processing mount of light-sensitive material can be reduced to 46% for color developer replenishing agents and to 23% for bleach-fixer replenishing agent, and to 23% for superstabilizer.

Table 7 gives features of the processing agent of the present invention. It is a common practice to form a part configuration as shown in Table 7 with a mini-lab processing agent, a mini-lab quick processing agent and a large-lab processing agent.

In conventional processing agents, particularly mini-lab quick processing agents and large-lab type processing agents, which are added as replenishing solutions according to the mount of processing of light-sensitive material, the concentration difference between the tank solution and the replenishing solution has widened steadily with the trend toward lower replenishing rates.

There is limitation in increasing the concentration of a replenisher. Upper limits are about 1.7 times the tank solution concentration for color developers, and about 2.2 times the tank solution concentration for bleach-fixers (the same applies to solutions capable of bleaching for negative film processing), posed by solubility limits.

If the concentration exceeds the above level, the replenisher will undergo undesirable phenomena, such as color developing agent crystal separation in the color developer replenisher or ferric ethylenediaminetetraacetate crystal separation in the bleach-fixer, during storage. These are susceptible to temperature; troubles occur particularly in winter when ambient temperature is under 10° C.

Also, since the kit parts are configured in view of liquid kit storage stability, pH is extremely low or high in some cases, necessitating care ha handling the kit solutions by the operator.

Kit solution spillage, cloth contact and skin contact can cause serious accidents. Specifically, spillage of a low or high pH kit solution can cause rust in metal portions; cloth contact damages the contacted area; skin contact causes skin poisoning or eczema.

Also, processing agent transportation is subject to legal regulation.

Specifically, in accordance with the rules specified by the United Nations Codes, the Ship Safety and Hygiene Law and the Civil Aeronautics Law should be observed. For some types of parts in aircraft transport, the IATA Rules should also be observed. The items marked with "X" for corrosivity and transport safety in the table above must not be transported, unless they are packaged in containers meeting the requirements of a container test etc.

Also, as a solid, the processing agent of the present invention requires no dissolution for a replenisher, and can be supplied to the tank solution according to the amount of processing of light-sensitive material; therefore, it is free of component crystal separation and other troubles, since it can take an advantageous configuration free of solubility limitation solely by increasing the ratio of consumed components even at low replenishing rates.

Because of the non-liquid kit form, weight reduction is possible and transport cost reduction is also possible. Moreover, consideration of corrosivity and transport safety is unnecessary.

Example 3

Figure 17:
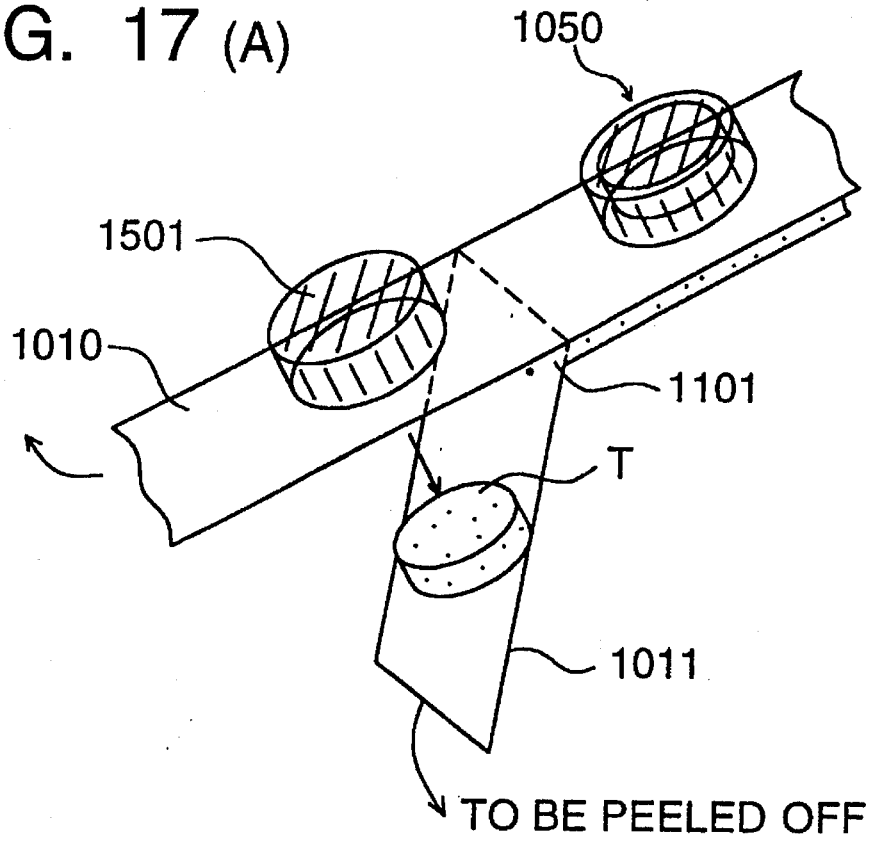
FIGS. 17(A) through (F) show examples of a supplying apparatus for a solid processing agent which is housed in a jointed portion of a package.
Figure 17:
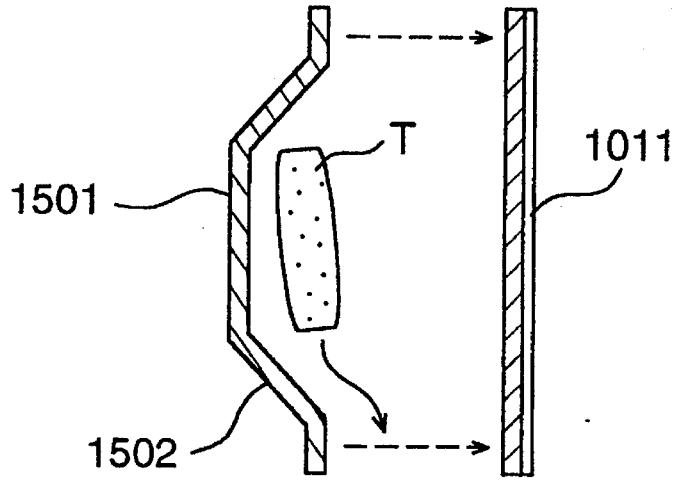
Figure 17:
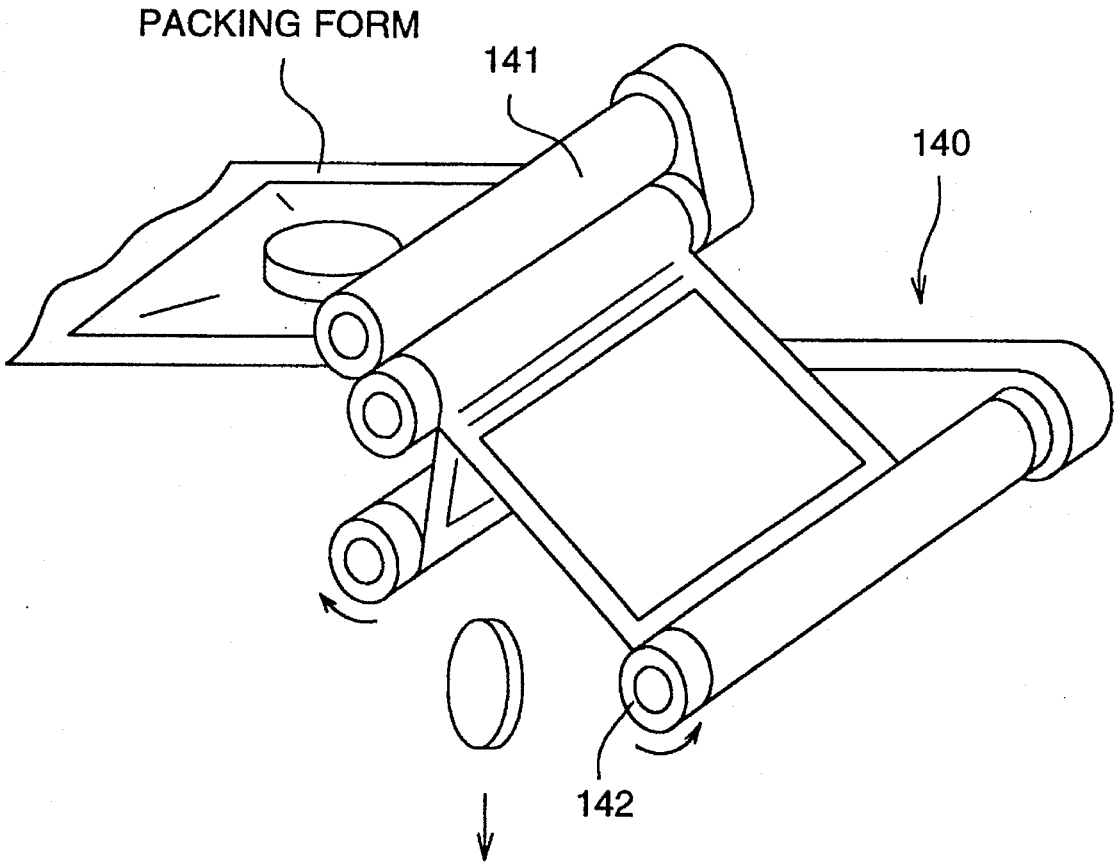
Figure 17:
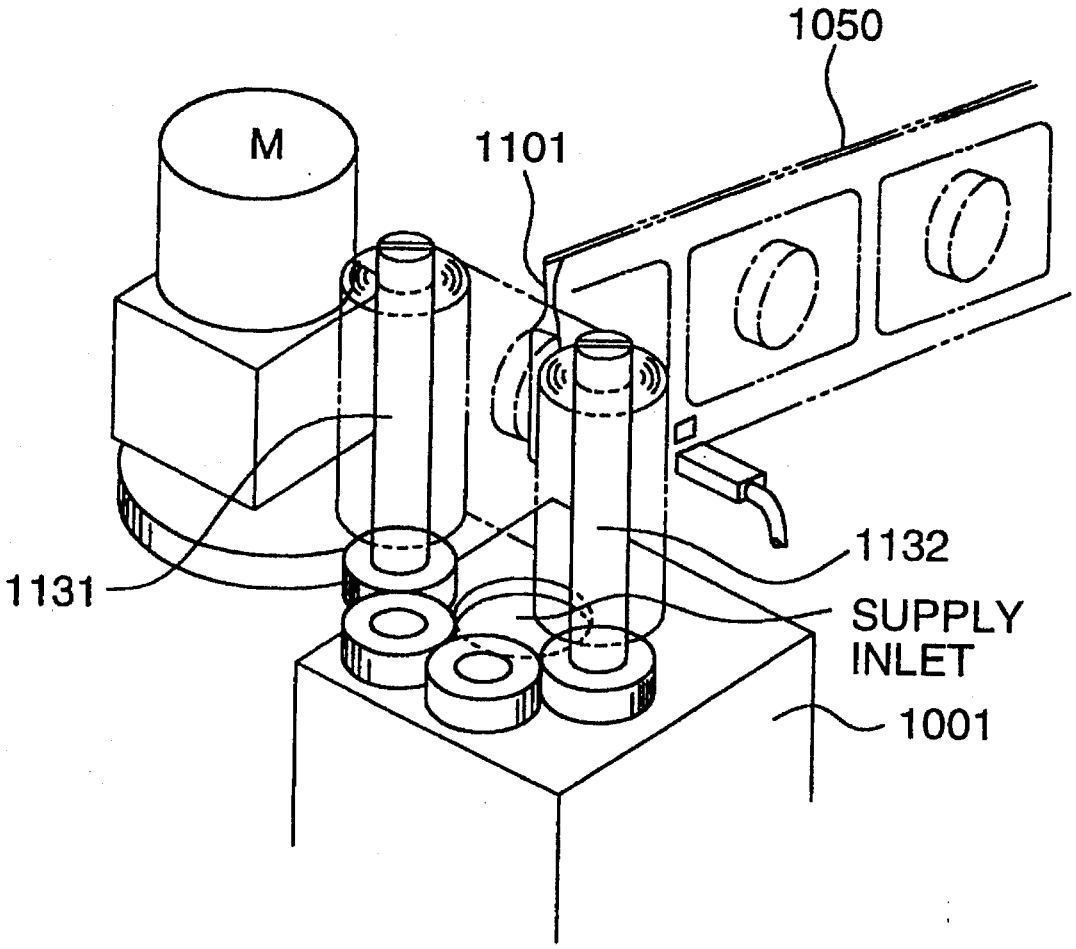
Figure 17:
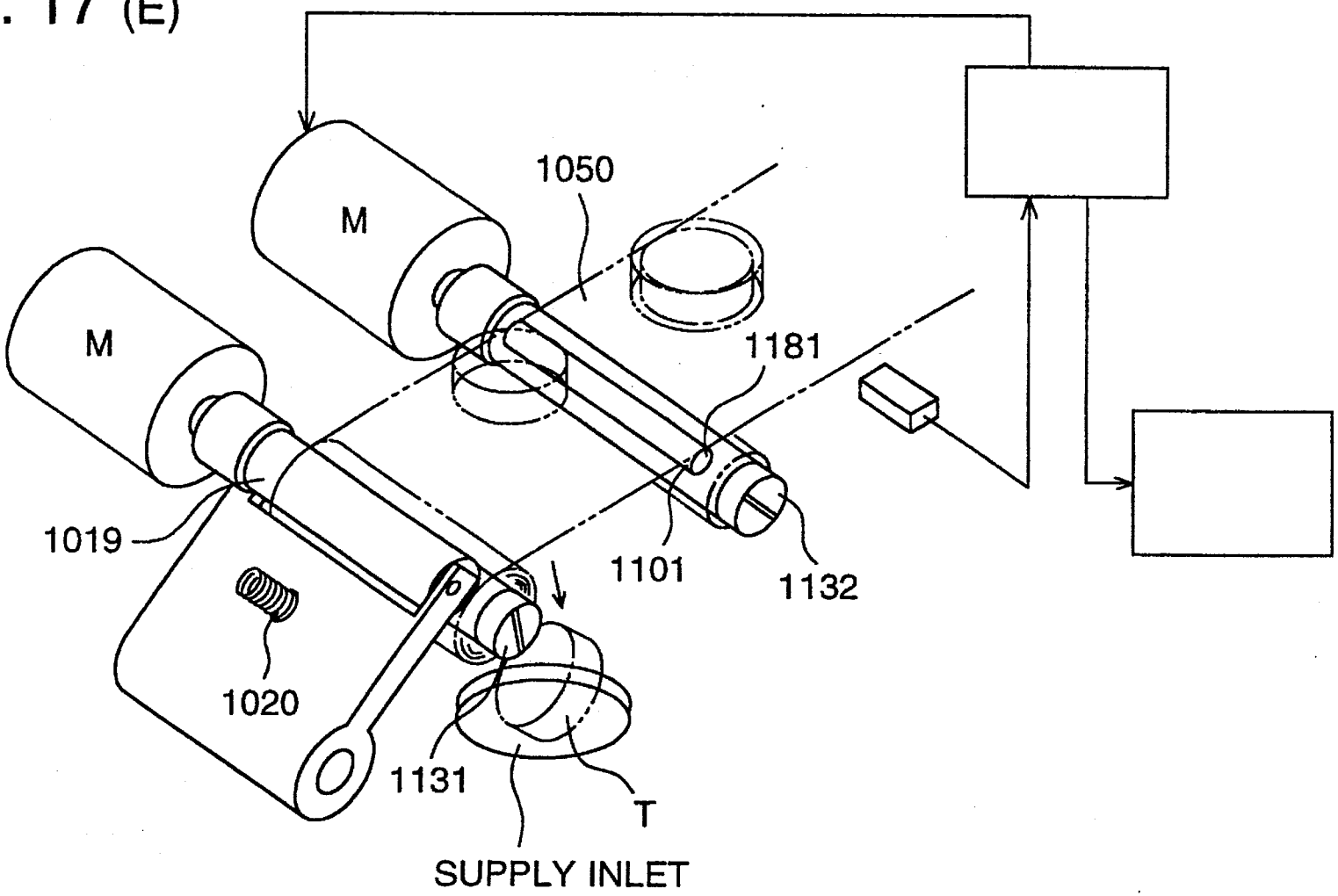
Figure 17:
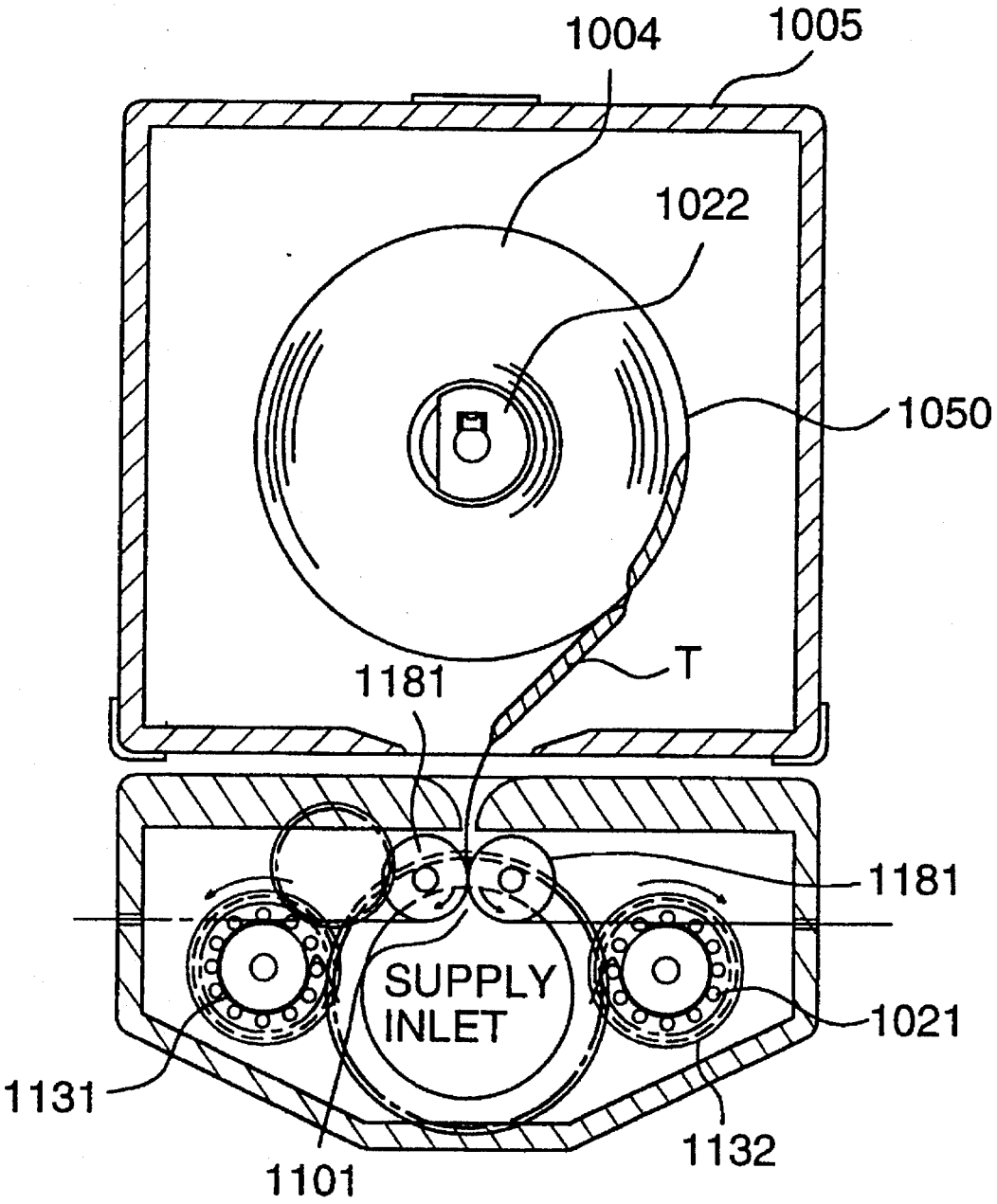

After imagewise exposure, the Konica QA paper type A5 (produced by-konica Corporation) was continuously processed using the Konica Big Mini-lab BM-101 (produced by Konica Corporation), modified to allow the use of the peel open method illustrated in FIG. 17 and to allow the processes shown in Table 9.

In the water supply tank, there was used mold-preventing water wherein Bio-sure SGD (made by Kinki Pipe Lab.) in quantity of 1 g/l was added.

TABLE 9

| Processing step | Processing time | Processing temperature | Aperture area |
|---|---|---|---|
| Color developing | 27 seconds | 37.5° C. | 10 $cm^2$/l |
| Bleach-fixing | 27 seconds | 37.5° C. | 10 $cm^2$/l |
| Stabilizing-1 | 27 seconds | 35° C. | 10 $cm^2$/l |
| Stabilizing-2 | 27 seconds | 35° C. | 10 $cm^2$/l |
| Stabilizing-3 | 27 seconds | 35° C. | 10 $cm^2$/l |
| Drying | 50 seconds | | |

Stabilization was achieved by the counterflow method from 3 to 1. The entire overflow from stabilization 1 was allowed to enter the bleach-fixing bath. Carry-over per $m^2$ of light-sensitive material was 50 ml/$m^2$ in all baths.

The water loss due to evaporation was compensated at 9.0 ml/hr, 7.2 ml/hr and 14.1 ml/hr for color development, bleach-fixation and stabilization, respectively, while warming the solution. The non-warming hours were summed and multiplied by 3.8 ml/hr, 3.1 ml/hr and 6.1 ml/hr, and the respective cumulative amounts were added at a time upon initiation of warming.

Starting tank solutions were prepared using the Konica Color QA paper color developing starter 82P-1B, the Konica Color QA paper bleach-fixing starter 82P-2B and the Konica Color QA paper stabilizing starter 82P-3B, all produced by Konica Corporation.

Circulatory volume was set to 1.5 rotations/min for all processing tanks.

Next, processing tablets for color printing paper were prepared in accordance with procedures A through G as follows:

1) Color Developer Replenisher Tablets for Color Printing Paper

Procedure (A)

1200 g of the developing agent CD-3 [4-amino-3-methyl-N-ethyl-N-[ β-(methanesulfonamido)ethyl]aniline sulfate] was milled in a commercially available bandamu? mill to a final average grain size of 10 μm. The fine powder thus obtained was granulated in a commercially available mixer granulator at room temperature for about 7 minutes while adding 50 ml of water. The granulation product was then dried in a fluidized bed dryer at 40° C. for 2 hours to remove almost all the water therefrom. To the granulation product, 150 g of polyethylene glycol 6000 was added, followed by uniform mixing for 10 minutes in a room kept at 25° C. and under 40% RH using a mixer. Next, 4 g of N-lauloylalanine sodium was added, followed by mixing for 3 minutes. The resulting mixture was subjected to compressive tableting using a tableting machine, a modification of Tough Press Correct 1527HU, produced by Kikusui Seisakusho, at a packing rate of 3.2 g per tablet, to yield 400 tablets of color developer replenisher tablet agent A for color printing paper.

Procedure (B)

120 g of disodium disulfoethylhydroxylamine was milled, mixed and granulated in the same manner as procedure (A). The amount of water added was 6.0 ml. The granulation product was then dried at 50° C. for 30 minutes to remove almost all the water therefrom. To the granulation product, 4 g of N-lauloylalanine sodium was added, followed by uniform mixing for 3 minutes in a room kept at 25° C. and under 40% RH using a mixer. The resulting mixture was subjected to compressive tableting using a tableting machine, a modification of Tough Press Correct 1527HU, produced by Kikusui Seisakusho, at a packing rate of 1.0 g per tablet, to yield 100 tablets of color developer replenisher tablet agent B for color printing paper.

Procedure (C)

30.0 g of Tinopal SFP (produced by Ciba-Geigy), 3.7 g of sodium sulfite, 0.3 g of potassium bromide, 25 g of diethylenetriaminepentaacetic acid, 280 g of sodium p-toluenesulfonate, 20 g of potassium hydroxide and 10.6 g of mannitol were milled in the same manner as procedure (A) and then uniformly mixed in a commercially available mixer, after which the mixture was granulated in the same manner as procedure (A). The amount of water added was 20 ml. Granulation was followed by drying at 60° C. for 30 minutes to remove almost all the water from the granulation product. To the granulation product, 4 g of N-lauloylalanine sodium was added, followed by uniform mixing for 3 minutes in a room kept at 25° C. and under 40% RH using a mixer. The resulting mixture was subjected to compressive tableting using a tableting machine, a modification of Tough Press Correct 1527HU, produced by Kikusui Seisakusho, at a packing rate of 1.0 g per tablet, to yield 100 tablets of color developer replenisher tablet agent C for color printing paper.

Procedure (D)

350 g of potassium carbonate was milled and granulated in the same manner as procedure (A). After granulation while adding 20 ml of water, the granulation product was dried at 700° C. for 30 minutes to remove almost all the water therefrom. To the granulation product, 15 g of polyethylene glycol 6000 was added and mixed uniformly therein for 10 minutes in a room kept at 25° C. and under 40% RH using a mixer. Next, 4 g of N-lauloylalanine sodium was added, followed by mixing for 3 minutes. The resulting mixture was subjected to compressive tableting using a tableting machine, a modification of Tough Press Correct 1527HU, produced by Kikusui Seisakusho, at a packing rate of 3.0 g per tablet, to yield 110 tablets of color developer replenisher tablet agent D for color printing paper.

2) Bleach-fixer Replenisher Tablets for Color Printing Paper

Procedure (E)

1250 g of ammonium ferric diethylenediaminepentaacetate monohydrate, 25 g of ethylenediaminetetraacetic acid, 250 g of maleic acid and 46 g of Pineflow (Matsutani Chemical Industry Co., Ltd.) were milled, mixed and granulated in the same manner as procedure (C). After granulation while adding 80 ml of water, the granulation product was dried at 60° C. for 2 hours to remove almost all the water therefrom. To the granulation product, 15 g of N-lauloylsalcosine sodium was added, followed by uniform mixing for 3 minutes in a room kept at 25° C. and under 40% RH using a mixer. The resulting mixture was subjected to compressive tableting using a tableting machine, a modification of Tough Press Correct 1527HU, produced by Kikusui Seisakusho, at a packing rate of 8.6 g per tablet, to yield 170 tablets of bleach-fixer replenisher tablet agent A for color printing paper.

Procedure (F)

1640 g of ammonium thiosulfate, 750 g of sodium sulfite, 40 g of potassium bromide and 50 g of p-toluenesulfinic acid were milled, mixed and granulated in the same manner as procedure (C). After granulation while spraying 100 ml of water, the granulation product was dried at 60° C. for 120 minutes to remove almost all the water therefrom. To the granulation product, 20 g of N-lauloylsalcosine sodium was added, followed by uniform mixing for 3 minutes in a room kept at 25° C. and under 40% RH using a mixer. The resulting mixture was subjected to compressive tableting using a tableting machine, a modification of Tough Press Correct 1527HU, produced by Kikusui Seisakusho, at a packing rate of 13.4 g per tablet, to yield 180 tablets of bleach-fixer replenisher tablet agent B for color printing paper.

3) Stabilizer Replenisher Tablets for Color Printing Paper

Procedure (G)

10 g of sodium carbonate monohydrate, 200 g of disodium 1-hydroxyethane-1,1-diphosphonate, 150 g of Tinopal SFP, 300 g of sodium sulfite, 20 g of zinc sulfate heptahydrate, 150 g of disodium ethylenediaminetetraacetate, 200 g of ammonium sulfate, 10 g of o-phenylphenol and 25 g of Pineflow were milled, mixed and granulated in the same manner as procedure (C). After granulation while adding 60 ml of water, the granulation product was dried at 70° C. for 60 minutes to remove almost all the water therefrom. To the granulation product, 10 g of N-lauloylsalcosine sodium was added, followed by uniform mixing for 3 minutes in a room kept at 25° C. and under 40% RH using a mixer. The resulting mixture was subjected to compressive tableting using a tableting machine, a modification of Tough Press Correct 1527HU, produced by Kikusui Seisakusho, at a packing rate of 3.1 g per tablet, to yield 360 tablets of stabilizer replenisher tablet agent for color printing paper.

Next, with respect to the above tablet agents, a total of four tablets, i.e., one tablet of each of agents A, B, C and D, were packaged for 1 unit; successive 20 units were packaged in a four-side sealed package of peel open packaging material formed with polyethyleneterephthalate/polyethylene/aluminum/polyethylene laminated film having oxygen permeability of 10 ml/m$^2$·24 hr·1 atm (20° C., 65 RH %) and moisture permeability of 2.0 g·mm/m$^2$·24 hr·1 atm. For the bleach-fixer replenishing tablet agents, one tablet of agent A and two tablets of agent B were packaged for 1 unit; successive 20 units were packaged in the same manner as for the above color developer replenishing tablets.

For the stabilizer replenishing tablet agents, each tablet was packaged for 1 unit in the same manner as above.

The peel open package material used was the sealant film Tocello CMPSO11C laminated with a non-stretched polypropylene/stretched polypropylene film with the non-stretched polypropylene film surface in contact with the sealant film.

The peel open film and non-stretched polypropylene/stretched polypropylene film were heat sealed to package the above tablets.

For comparison, the tablets and a corresponding amount of replenishing water were placed in the replenishing tank to yield 10 liter of a replenisher.

In this case, the replenisher was used to compensate the water loss due to evaporation in the comparative processing.

Processing rate was 5 m$^2$ of color printing paper daily, continued until the overflow reached 2 times the tank solution volume, whereafter the days until sulfation in the bleach-fixing tank were counted, and a sample subjected to exposure through an optical wedge was developed and the maximum reflective blue color density was determined.

The color developing agent content in the color developer was changed to 1.2 times for a replenishing rate of 50 ml/m$^2$, to 1.45 times for 25 ml/m$^2$ and to 0.9 times for 150 ml/m$^2$, to compensate the consumption.

In preparing the bleach-fixer, the maleic acid content was increased to compensate the pH rise due to entry of the color developer when the replenishing rate was low. Table 10 compares these methods.

TABLE 10

| | Color development | | | Bleach-fixation | | | Stabilization | | |
|---|---|---|---|---|---|---|---|---|---|
| | Replenishing rate (ml/m$^2$) | Timing of addition of 1 package (m$^2$/package) | Amount of replenishing water per package (ml) | Replenishing rate (ml/m$^2$) | Timing of addition of 1 package (m$^2$/package) | Amount of replenishing water per package (ml) | Replenishing rate (ml/m$^2$) | Timing of addition of 1 package (m$^2$/package) | Amount of replenishing water per package (ml) |
| 1) Peel open method | Equivalent to 25 ml | 1 | 19.6 | Equivalent to 15 ml | 0.80 m$^2$ | 1.68 ml | Equivalent to 50 ml | 1 | 47.2 |
| 2) Peel open method | Equivalent to 50 ml | 1 | 44.6 | Equivalent to 20 ml | 0.75 m$^2$ | 4.18 ml | Equivalent to 100 ml | 1 | 97.6 |
| 3) Peel open method | Equivalent to 100 ml | 1 | 94.6 | Equivalent to 50 ml | 0.52 m$^2$ | 21.2 ml | Equivalent to 200 ml | 1 | 169.6 |
| 4) Replenishing solution method | 25 ml | — | — | 15 ml | — | — | 50 ml | — | — |
| 5) Replenishing solution method | 50 ml | — | — | 20 ml | — | — | 100 ml | — | — |
| 6) Replenishing solution method | 100 ml | — | — | 50 ml | — | — | 200 ml | — | — |

Continuous processing was carried out at various replenishing rates and exchange rates to compare the inventive solid processing agent adding method and the conventional replenisher preparation method. The degree of bleach-fixer concentration was also determined. The concentration rate was calculated from the iron ion concentration in the tank solution determined by atomic absorption spectrometry.

The solid processing agent was dissolved in the color developing agent to prepare a replenisher and observed for the dissolution state.

TABLE 11

| | Color developing agent | | | |
|---|---|---|---|---|
| | Bleach-fixer sulfation | Replenisher solubility | Maximum blue color density Dmax (B) | Remark |
| Start | — | — | 2.30 | |
| 1 | No sulfation | — | 2.28 | Inventive |
| 2 | No sulfation | — | 2.28 | Inventive |
| 3 | No sulfation | — | 2.29 | Inventive |
| 4 | Sulfation occurred in 2 weeks | Poor dissolution | 1.75 | Comparative |

TABLE 11-continued

| | Bleach-fixer sulfation | Color developing agent: Replenisher solubility | Maximum blue color density Dmax (B) | Remark |
|---|---|---|---|---|
| 5 | Sulfation occurred in 3 weeks | Poor dissolution | 1.81 | Comparative |
| 6 | Sulfation occurred in 7 weeks | No problem | 2.16 | Comparative |

From Table 11 above, it is seen that in the conventional replenisher preparation method, replenishing rate reduction necessitates increasing the replenisher solution concentration, resulting in the residence of insoluble matter after preparation of the replenisher. Another drawback is that low replenishing rates lead to oxidative deterioration of the replenisher as well, hampering the obtainment of sufficient photographic density.

In contrast, the direct addition method of the present invention undergoes neither dissolution failure nor deterioration because no replenisher is prepared.

Another finding was that the bleach-fixer is low in storage stability due to the low pH of the replenisher to be added at low replenishing rates so that it undergoes sulfation in several weeks. On the other hand, the present method undergoes no bleach-fixer sulfation because it is unnecessary to prepare a replenisher.

In addition, the conventional replenisher preparation method results in a significantly concentrated bleach-fixer at low replenishing rates. Particularly, the concentration rate increases when the replenisher is used to compensate the water loss due to evaporation when the replenishing rate is lower than the evaporation rate.

Figure 9:
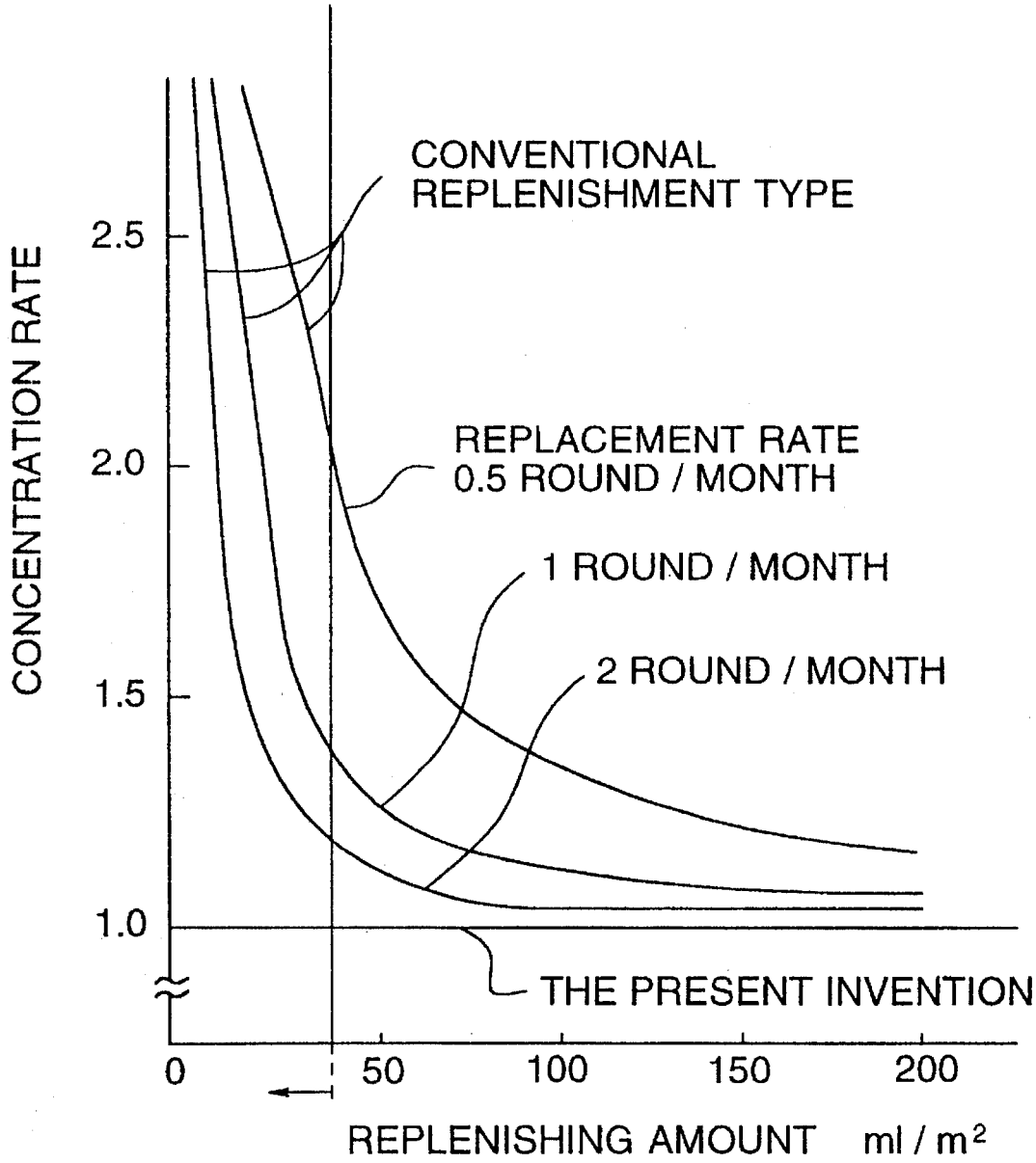
FIG. 9 is a characteristic curve of the relationship between replenishing rate and concentration rate.

In contrast, the present invention undergoes no such concentration, since compensation for the water loss due to evaporation is separately achieved. FIG. 9 shows characteristic curves of replenishing rates versus concentration rate to compare the prior art and the present invention.

Example 4

After imagewise exposure, the Konica QA paper type A5 (produced by konica Corporation) was continuously processed using the NPS-808 (produced by Konica Corporation), modified to have the configuration illustrated in FIG. 1. The replenishing water in the replenishing tank was deionized water.

| Process | Processing time | Processing temperature | Tank capacity |
|---|---|---|---|
| Color development | 22 seconds | 38.0° C. | 12 l |
| Bleach-fixation | 22 seconds | 37.5° C. | 12 l |
| Stabilization 1 | 22 seconds | 35° C. | 12 l |
| Stabilization 2 | 22 seconds | 35° C. | 12 l |
| Stabilization 3 | 22 seconds | 35° C. | 12 l |
| Drying | 50 seconds | 55° C. | |

Stabilization was achieved by the counterflow method from 3 to 1. The entire overflow from stabilization 1 was allowed to enter the bleach-fixing bath. Carry-over per $m^2$ of light-sensitive material was 45 ml from the color developing tank to the bleach-fixing tank, 50 ml from the bleach-fixing tank to the stabilizing tank and 40 ml from stabilization 1 to 2, from stabilization 2 to 3 and from stabilization 3 to drying.

The opening area of each of the color developing, bleach-fixing and stabilizing tanks was 4.5 $cm^2$ per liter of processing solution.

Circulatory volume was set to 1.5 rotations/min for all processing tanks.

The ambient conditions for the automatic processing machine were 27° C. temperature and 60% RH, and replenishing water was supplied upon the water loss due to evaporation reached 100 ml.

The amount of replenishing water was calculated using the equation (1) shown in Japanese Patent O.P.I. Publication No. 280042/1991. The light-sensitive material was processed constantly at 2.0 $m^2$ per day for 2 months.

The compositions of the processing solutions used are as follows:

| Color developer | |
|---|---|
| Potassium bromide | 0.02 g |
| Potassium chloride | 3.2 g |
| Potassium carbonate | 30 g |
| Potassium sulfite | 0.2 g |
| Sodium diethylenetriaminepentaacetate | 2 g |
| Sodium nitrilotrimethylenephosphonate | 2 g |
| Tinopal SFP | 2 g |
| Disodium N,N-bis(sulfonatoethyl)hydroxylamine | 5 g |
| 4-amino-3-methyl-N-ethyl-N-(β-methanesulfonamidoethyl)aniline sulfate CD-3 | 7 g |

Water was added to make a total quantity of 1 l, and pH was adjusted to 10.10.

| Bleach-fixer | |
|---|---|
| Ammonium ferric diethylenetriaminepentaacetate | 100 g |
| Diethylenetriaminepentaacetic acid | 2 g |
| Ammonium thiosulfate | 120 g |
| Ammonium sulfite | 40 g |
| Sulfinic acid | 5 g |
| Ammonium bromide | 10 g |

Water was added to make a total quantity of 1 l, and pH was adjusted to 7.0.

| Stabilizer | |
|---|---|
| Water | 800 g |
| 1,2-benzisothiazolin-3-one | 0.1 g |
| 1-hydroxyethylidene-1,1-diphosphonic acid | 5.0 g |
| Ethylenediaminetetraacetic acid | 1.0 g |
| Tinopal SFP (produced by Ciba-Geigy) | 2.0 g |
| Ammonium sulfate | 2.5 g |
| Zinc chloride | 1.0 g |
| Magnesium chloride | 0.5 g |
| o-phenylphenol | 1.0 g |
| Sodium sulfite | 2.0 g |

Water was added to make a total quantity of 1 l, and 50% sulfuric acid or 25% aqueous ammonia was added to obtain a pH of 8.0.

The processing tablets used were identical with those prepared in Example 2.

Figure 18:
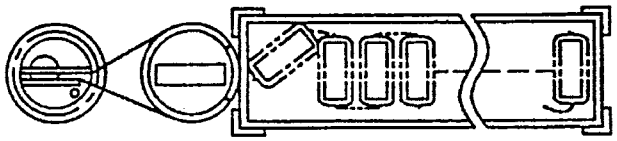
FIGS. 18(A) through (D) are plans and an oblique view of a supplying apparatus and a plan of a solid processing agent whose 4 sides have been sealed.
Figure 18:
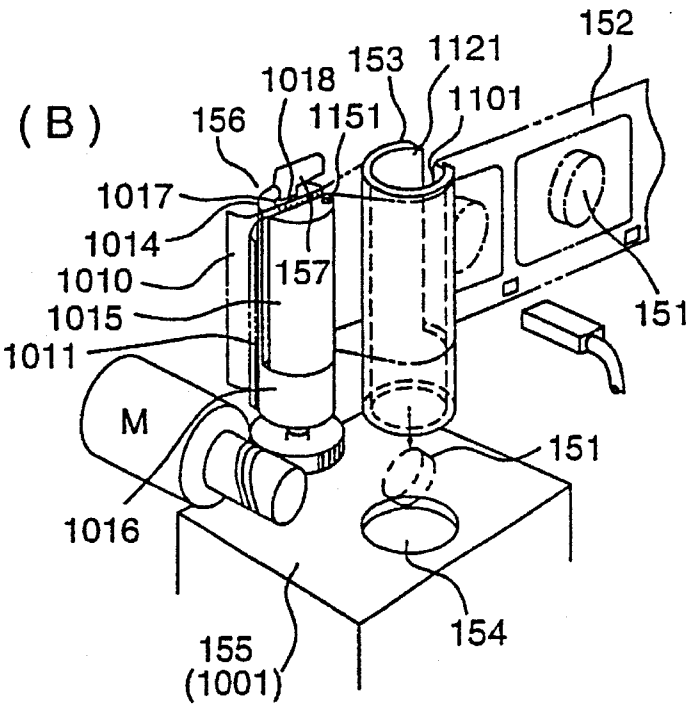
Figure 18:
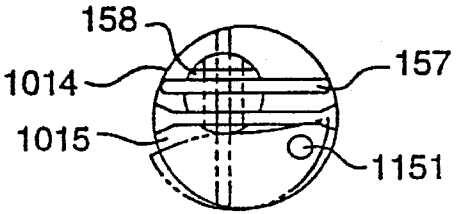
Figure 18:
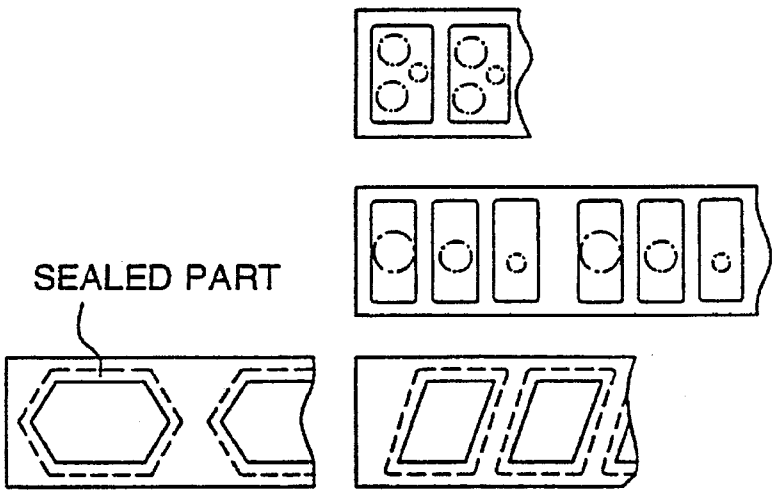

Next, each tablet was sealed in a laminated polymeric resin film of PET/polyvinyl alcohol-ethylene copolymer/polyethylene, and added using the supplying apparatus illustrated in FIG. 18. The setting was such that one tablet was added upon processing of 1 $m^2$ of color printing paper, and 76 ml of replenishing water for the color developing bath, 42 ml of replenishing water for the bleach-fixing bath and 247 ml of replenishing water for the stabilizing bath would be supplied from the replenishing water tank simultaneously.

For comparison, the same running test was conducted in which water was added to the color developing, bleach-fixing and stabilizing baths until the overflow outlet level was reached once every morning and every evening.

It was found that the sensitivity fluctuation was ±1% in the present invention, while it was ±4% in the case where replenishing water was added until the overflow outlet level was reached once every morning and evening. This finding demonstrates that the evaporated water compensating method of the present invention offers stable photographic performance.

Example 5

Processing tablets for color printing paper were prepared as follows:

1) Color Developer Replenisher Tablets for Color Printing Paper

Procedure (A)

1200 g of the developing agent CD-3 [4-amino-3-methyl-N-ethyl-N-[ β-(methanesulfonamido)ethyl]aniline sulfate] was milled in a commercial bandamu mill to a final average grain size of 10 μm. The fine powder thus obtained was granulated in a commercially available mixer granulator at room temperature for about 7 minutes while adding 50 ml of water. The granulation product was then dried in a fluidized bed dryer at 40° C. for 2 hours to remove almost all the water therefrom. To the granulation product, 150 g of polyethylene glycol 6000 was added, followed by uniform mixing for 10 minutes in a room kept at 25° C. and under 40% RH using a mixer. Next, 4 g of N-lauloylalanine sodium was added, followed by mixing for 3 minutes. The resulting mixture was subjected to compressive tableting using a tableting machine, a modification of Tough Press Correct 1527HU, produced by Kikusui Seisakusho, at a packing rate of 3.2 g per tablet, to yield 400 tablets of color developer replenisher tablet agent A for color printing paper.

Procedure (B)

120 g of disodium disulfoethylhydroxylamine was milled and granulated in the same manner as procedure (A). After granulation while adding 6.0 ml of water, the granulation product was dried at 50° C. for 30 minutes to remove almost all the water therefrom. To the granulation product, 4 g of N-lauloylalanine sodium was added, followed by uniform mixing for 3 minutes in a room kept at 25° C. and under 40% RH using a mixer. The resulting mixture was subjected to compressive tableting using a tableting machine, a modification of Tough Press Correct 1527HU, produced by Kikusui Seisakusho, at a packing rate of 1.0 g per tablet, to yield 100 tablets of color developer replenisher tablet agent B for color printing paper.

Procedure (C)

30.0 g of Tinopal SFP (produced by Ciba-Geigy), 3.7 g of sodium sulfite, 0.3 g of potassium bromide, 25 g of diethylenetriaminepentaacetic acid, 280 g of sodium p-toluenesulfonate, 20 g of potassium hydroxide and 10.6 g of mannitol were milled in the same manner as procedure (A) and then uniformly mixed in a commercially available mixer, after which the mixture was granulated in the same manner as procedure (A), while adding 20 ml of water. Granulation was followed by drying at 60° C. for 30 minutes to remove almost all the water from the granulation product. To the granulation product, 4 g of N-lauloylalanine sodium was added, followed by uniform mixing for 3 minutes in a room kept at 25° C. and under 40% RH using a mixer. The resulting mixture was subjected to compressive tableting using a tableting machine, a modification of Tough Press Correct 1527HU, produced by Kikusui Seisakusho, at a packing rate of 1.0 g per tablet, to yield 100 tablets of color developer replenisher tablet agent C for color printing paper.

Procedure (D)

350 g of potassium carbonate was milled and granulated in the same manner as procedure (A). After granulation while adding 20 ml of water, the granulation product was dried at 700° C. for 30 minutes to remove almost all the water therefrom. To the granulation product, 15 g of polyethylene glycol 6000 was added, followed by uniform mixing for 10 minutes in a room kept at 25° C. and under 40% RH using a mixer. Next, 4 g of N-lauloylalanine sodium was added, followed by mixing for 3 minutes. The resulting mixture was subjected to compressive tableting using a tableting machine, a modification of Tough Press Correct 1527HU, produced by Kikusui Seisakusho, at a packing rate of 3.0 g/tablet, to yield 110 tablets of color developer replenisher tablet agent D for color printing paper.

2) Bleach-fixer Replenisher Tablets for Color Printing Paper

Procedure (E)

1250 g of ammonium ferric diethylenetriaminepentaacetate monohydrate, 25 g of ethylenediaminetetraacetic acid, 250 g of maleic acid and 46 g of Pineflow (Matsutani Chemical Industry, Co. Ltd.) were milled, mixed and granulated in the same manner as procedure (C). After granulation while adding 80 ml of water, the granulation product was dried at 60° C. for 2 hours to remove almost all the water therefrom. To the granulation product, 15 g of N-lauloylsalcosine sodium was added, followed by uniform mixing for 3 minutes in a room kept at 25° C. and under 40% RH using a mixer. The resulting mixture was subjected to compressive tableting using a tableting machine, a modification of Tough Press Correct 1527HU, produced by Kikusui Seisakusho, at a packing rate of 3.45 g per tablet, to yield 340 tablets of bleach-fixer replenisher tablet agent A for color printing paper.

Procedure (F)

1640 g of ammonium thiosulfate, 750 g of sodium sulfite, 40 g of potassium bromide and 50 g of p-toluenesulfinic acid were milled, mixed and granulated in the same manner as procedure (C). After granulation while spraying 100 ml of water, the granulation product was dried at 60° C. for 120 minutes to remove almost all the water therefrom. To the granulation product, 20 g of N-lauloylsalcosine sodium was added, followed by uniform mixing for 3 minutes in a room kept at 25° C. and under 40% RH using a mixer. The resulting mixture was subjected to compressive tableting using a tableting machine, a modification of Tough Press Correct 1527HU, produced by Kikusui Seisakusho, at a packing rate as shown in Table 1, to yield bleach-fixer replenisher tablet agent B for color printing paper.

3) Stabilizer Replenisher Tablets for Color Printing Paper

Procedure (G)

10 g of sodium carbonate monohydrate, 200 g of disodium 1-hydroxyethane-l,l-diphosphonate, 150 g of Tinopal SFP, 300 g of sodium sulfite, 20 g of zinc sulfate heptahydrate, 150 g of disodium ethylenediaminetetraacetate, 200 g of ammonium sulfate, 10 g of o-phenylphenol and 25 g of Pineflow were milled, mixed and granulated in the same manner as procedure (C). After granulation while spraying 60 ml of water, the granulation product was dried at 70° C. for 60 minutes to remove almost all the water therefrom. To the granulation product, 10 g of N-lauloylsalcosine sodium was added, followed by uniform mixing for 3 minutes in a room kept at 25° C. and under 40% RH using a mixer. The resulting mixture was subjected to compressive tableting using a tableting machine, a modification of Tough Press Correct 1527HU, produced by Kikusui Seisakusho, at a packing rate of 3.1 g/tablet, to yield 340 stabilizer replenisher tablets for color printing paper.

Each tablet of the above replenishing tablet agents for color printing paper was packaged in a four-side sealed package of laminated polymer resin film of PET/polyvinyl alcohol-ethylene copolymer/polyethylene in amounts as shown in Tables 7 and 8. Also, tableting was carried out for each part of each replenishing agent, so that the total amount would correspond to the same composition ratio for a single tablet, as shown in Table 2, and four-side sealed packaging was carried out in the same manner as above. The number of units per cartridge was 20.

Next, after imagewise exposure, the Konica QA paper type 5 (produced by Konica Corporation) was continuously processed using the NPS-808 (produced by Konica Corporation), modified to have the configuration illustrated in FIG. 1. The replenishing water in the replenishing tank was water containing 0.1 g/liter benzisothiazoline.

| Process | Processing time | Processing temperature | Tank capacity |
|---|---|---|---|
| Color development | 22 seconds | 38.0° C. | 12 1 |
| Bleach-fixation | 22 seconds | 37.5° C. | 12 1 |
| Stabilization 1 | 22 seconds | 35° C. | 12 1 |
| Stabilization 2 | 22 seconds | 35° C. | 12 1 |
| Stabilization 3 | 22 seconds | 35° C. | 12 1 |
| Drying | 50 seconds | 55° C. | |

Stabilization was achieved by the counterflow method from 3 to 1. Carry-over per $m^2$ of light-sensitive material was 45 ml from the color developing bath to the bleach-fixing bath, 50 ml from the bleach-fixing bath to the stabilizing bath and 40 ml from stabilization 1 to 2, from stabilization 2 to 3 and from stabilization 3 to drying.

The opening area of each of the color developing, bleach-fixing and stabilizing baths was 4.5 $cm^2$ per liter of processing solution.

Circulatory volume was set to 1.5 rotations/min for all processing tanks.

The compositions of the processing solutions are as follows:

| Color developer | |
|---|---|
| Potassium bromide | 0.02 g |
| Potassium chloride | 3.2 g |
| Potassium carbonate | 30 g |
| Potassium sulfite | 0.2 g |
| Sodium diethylenetriaminepentaacetate | 2 g |
| Sodium nitrilotrimethylenephosphonate | 2 g |
| Tinopal SFP | 2 g |
| Disodium N,N-bis(sulfonatoethyl)hydroxylamine | 5 g |
| 4-amino-3-methyl-N-ethyl-N-[β-(methanesulfonamidoethyl] aniline sulfate CD-3 | 7 g |

Water was added to make a total quantity of 1 l, and pH was adjusted to 10.10.

| Bleach-fixer | |
|---|---|
| Ammonium ferric diethylenetriaminepentaacetate | 100 g |
| Diethylenetriaminepentaacetic acid | 2 g |
| Ammonium thiosulfate | 120 g |
| Ammonium sulfite | 40 g |

-continued

| Bleach-fixer | |
|---|---|
| Sulfinic acid | 5 g |
| Ammonium bromide | 10 g |

Water was added to make a total quantity of 1 l, and pH was adjusted to 7.0.

| Stabilizer | |
|---|---|
| Water | 800 g |
| 1,2-benzisothiazolin-3-one | 0.1 g |
| 1-hydroxyethylidene-1,1-diphosphonic acid | 5.0 g |
| Ethylenediaminetetraacetic acid | 1.0 g |
| Tinopal SFP (produced by Ciba-Geigy) | 2.0 g |
| Ammonium sulfate | 2.5 g |
| Zinc chloride | 1.0 g |
| Magnesium chloride | 0.5 g |
| o-phenylphenol | 1.0 g |
| Sodium sulfite | 2.0 g |

Water was added to make a total quantity of 1 l, and 50% sulfuric acid or 25% aqueous ammonia was added to obtain a pH of 8.0.

A running experiment was conducted in which 50 rolls of 24-EXP color film per hour were processed for 3 hours to obtain 3750 prints of size E. Tablet solubility, photographic performance, handling quality, etc. were evaluated.

Table 12 shows the amounts of tablets and the amounts of replenishing water.

TABLE 12

| Amount of tablets (g) | | 0.3 g | 0.5 g | 10 g | 30 g | 50 g |
|---|---|---|---|---|---|---|
| Replenishing water (ml) | CD | 3.1 | 5.2 | 103.2 | 309.6 | 516.0 |
| | BF | 15.1 | 25.2 | 50.4 | 151.2 | 252 |
| | STB | 28.9 | 48.1 | 916.5 | 2884.5 | 4807.5 |

Note: CD denotes a color developer; BF, a bleach-fixer; STB, a stabilizer.

Timing of entry of tablets and replenishing water was such that 80 ml of replenishing water for 7.85 g of color developer replenisher tablets, 200 ml of replenishing water for 39.7 g of bleach-fixer replenisher tablets and 250 ml of replenishing water for 2.6 g of stabilizer replenisher tablets were supplied upon 1 $m^2$ of color printing paper was processed. Using these amounts as a basis, adding time (Table 13) was varied according to the amount of tablets, and 80 ml, 200 ml and 250 ml of replenishing water were supplied upon the above amounts of tablets were reached.

TABLE 13

| | Amount (g) of each tablet | 0.3 g | 0.5 g | 10 g | 30 g | 50 g |
|---|---|---|---|---|---|---|
| CD | Number of tablets added | 961 | 577 | 29 | 10 | 6 |
| | Number of tablets added per min | 5.4 | 3.2 | 0.7 | 0.06 | 0.03 |
| BF | Number of tablets added | 4864 | 2918 | 146 | 49 | 30 |
| | Number of tablets added per min | 27 | 16.2 | 0.8 | 0.27 | 0.17 |
| STB | Number of tablets added | 319 | 192 | 10 | 4 | 2 |
| | Number of tablets added per min | 1.8 | 1.1 | 0.06 | 0.02 | 0.01 |
| Total cartridge exchange frequency per min | | 1.7 | 1.0 | 0.05 | 0.02 | 0.01 |

From the viewpoint of tablet cartridge exchange operation, tablet adhesion to the packaging material, tablet solubility and processing stability, 0.5 to 30 g is particularly preferable when the entire replenisher is in a solid form and supplied separately from replenishing water.

Example 6

Tablets for fixing were prepared as follows:

2500 g of ammonium thiosulfate, 150 g of sodium sulfite, 150 g of potassium carbonate and 20 g of disodium ethylenediaminetetraacetate were milled and granulated. The amount of water sprayed was 30 ml. Granulation was followed by drying at 60° C. for 60 minutes, and the granulation product was further dried in a vacuum at 40° C. for 8 hours to remove almost all the water therefrom.

The resulting granulation product was uniformly mixed for 10 minutes in a room kept at 25° C. and under 40% RH using a mixer. The resulting mixture was subjected to compressive tableting using a tableting machine, a modification of Tough Press Correct 1527HU, produced by Kikusui Seisakusho, at a packing rate of 9.0 g per tablet, to yield 200 tablets of a fixer replenisher tablet agent for color negative films.

10 liter of the following fixer was prepared.

| Fixer composition | per liter |
|---|---|
| Ammonium thiosulfate | 250 g |
| Sodium sulfite | 15 g |
| Potassium carbonate | 15 g |
| EDTA-2Na | 2 g |

Figure 7:
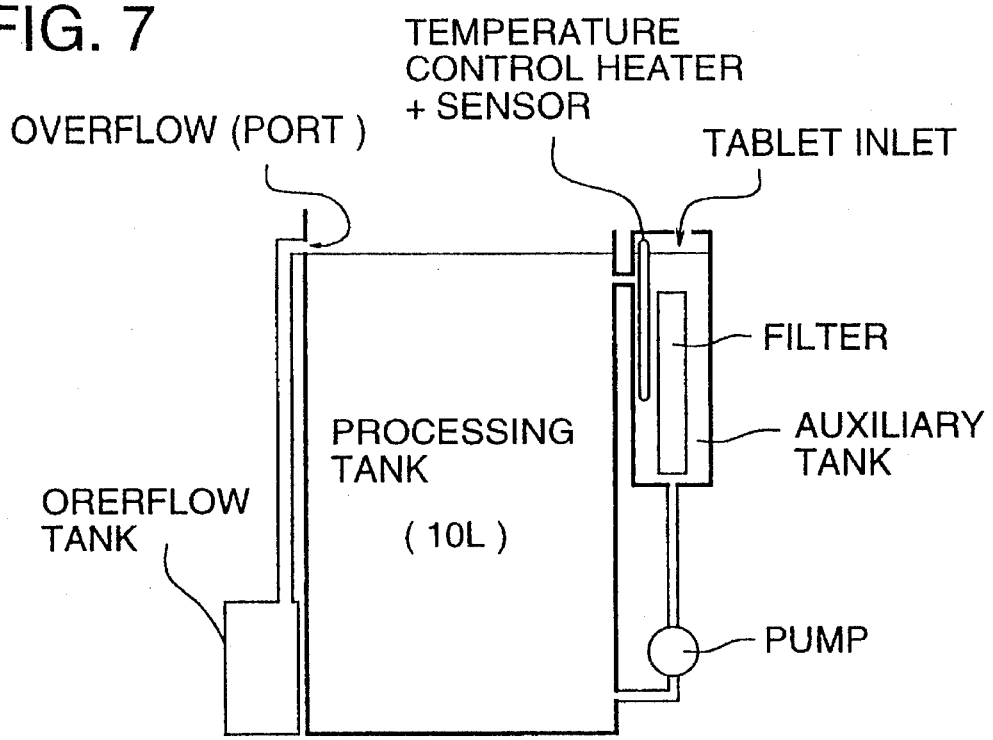
FIG. 7 is a construction diagram of a dissolution testing unit.

This fixer was placed in the processing tank of dissolution test unit (A) illustrated in FIG. 7 below, and while circulating it using the magnet pump MD-5, produced by Iwaki, the above tablets were added to the auxiliary tank at 1 tablet per minute. 20 ml of tap water was simultaneously add to the processing tank.

Using a warming unit, the temperatures of the processing solutions in the processing tank and auxiliary tank were varied as shown in Table 14 below, and 100 tablets were continuously added. The tablet dissolution state in the auxiliary tank was observed.

Figure 8:
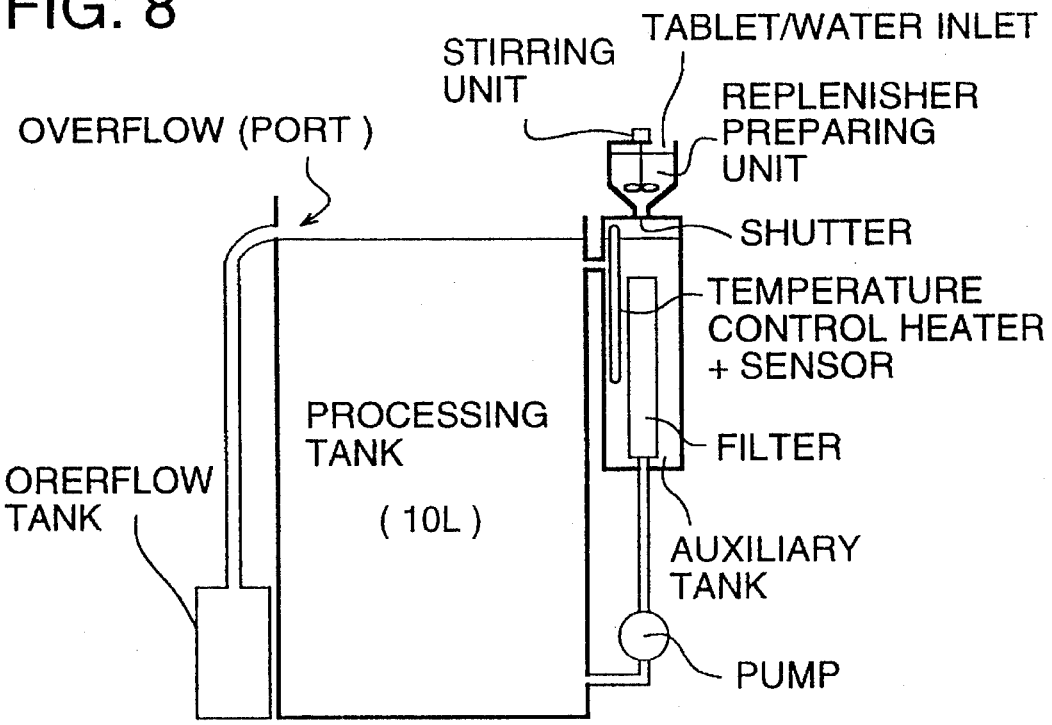
FIG. 8 is another construction diagram of a dissolution testing unit.

For comparison, using dissolution test unit (B) illustrated in FIG. 8, the same tablets as above and 20 ml of solvent water were simultaneously added at 1 tablet per minute to the replenisher preparing unit, followed by stirring in a stirring unit for 30 seconds, after which the mixture was added to the auxiliary tank. The temperature of the solvent water (tap water) was 25° C.

TABLE 14

| | Temperature | State of residual tablets | Remark |
|---|---|---|---|
| Unit | 20° C. | Δ | Invention |
| (A) | 25° C | ○ (12 pc. remaining) | Invention |
| | 30° C. | ⊙ (8 pc. remaining) | Invention |
| | 35° C. | ⊙ (6 pc. remaining) | Invention |
| | 38° C. | ⊙ (3 pc. remaining) | Invention |
| | 40° C. | ⊙ (3 pc. remaining) | Invention |
| Unit | 20° C. | X | Comparative |
| (B) | 25° C. | X | Comparative |
| | 30° C. | X | Comparative |
| | 35° C. | X | Comparative |
| | 38° C. | X | Comparative |
| | 40° C. | X | Comparative |

⊙: Not more than 10 tablets remained undissolved
○: 10 to 20 tablets remained undissolved, auxiliary tank full
Δ: 10 to 20 tablets remained undissolved, auxiliary tank full and insoluble components (trace amount)
X: Not dissolved within 1 minute in the replenisher preparing unit, activation impossible This experiment was conducted to test high speed dissolution on condition that the replenishing rate was equivalent to 60 rolls per hour of film processed by an automatic processing machine, wherein evaluations were made with a fixing agent, which ranks highest in the frequency of dissolution among the processing solutions.

From Table 14 above, it is seen that the dissolution method of the present invention, wherein the processing agent is added directly to the processing solution, makes it possible to dissolve the processing agent free of insoluble matter residence at processing tank temperatures of over 25° C. and allows control of dissolution speed by temperature.

Also, at 20° C., a small amount of insoluble matter remained, but it is of almost no concern for practical use.

In contrast, in the method using a replenisher preparing filter to dissolve the processing agent as illustrated in unit (B) illustrated in FIG. 8, the entire processing agent clogged the filter because it did not dissolve within the specified time, causing action failure.

Also, to test the case where tablets are added before completion of warming with the heater, addition was started 10 minutes before completion of warming, but dissolution had no problem when unit A was used.

Example 7

After imagewise exposure, the Konica Color Negative Film Super DD-100 film was continuously processed using the color negative film processor CL-KP-50QA, modified to allow the use of peel open package material, according to processing steps shown in Table 15.

TABLE 15

| Processing step | Processing time | Processing temperature |
|---|---|---|
| Color developing | 3 min 15 sec | 38° C. |
| Bleaching | 45 sec | 38° C. |
| Fixing-1 | 45 sec | 38° C. |
| Fixing-2 | 45 sec | 38° C. |
| Stabilizing-1 | 20 sec | 38° C. |
| Stabilizing-2 | 20 sec | 38° C. |
| Stabilizing-3 | 20 sec | 38° C. |
| Drying | 80 sec | 55° C. |

Fixation and stabilization were achieved by the counter-flow method from 2 to 1 for fixation and from 3 to 2 and from 2 to 1 for stabilization. The bleaching bath was aerated using an air pump.

The water loss due to evaporation was compensated by adding 10 ml, 6.5 ml, 7 ml, 7 ml, 8.6 ml, 8.6 ml and 9.3 ml of replenishing water, per hour, to the color developing tank, bleaching tank, fixing tank 1, fixing tank 2, stabilizing tank 1, stabilizing tank 2 and stabilizing tank 3, respectively while warming the solution. Non-warming hours were summed and multiplied by 7.5 ml, 5 ml, 6 ml, 6 ml, 5 ml, 5 ml and 5 ml of replenishing water, per hour, were added to the color developing tank, bleaching tank, fixing tank 1, fixing tank 2, stabilizing tank 1, stabilizing tank 2 and stabilizing tank 3, respectively, at a time upon initiation of warming. Starting tank solutions were prepared using a replenisher and a starter for the Konica color negative film processing agent CNK-4-52.

Processing tablets for color negative films were prepared as follows:

1) Color Developer Replenisher Tablets for Color Negative Films

Procedure (1)

150 g of the developing agent CD-4 [4-amino-3-methyl-N-ethyl-β-(hydroxyethyl)aniline sulfate] was milled in a commercially available bandamu mill to a final average grain size of 10 μm. The fine powder thus obtained was granulated in a commercially available mixer granulator at room temperature for about 7 minutes while adding 10 ml of water. The granulation product was then dried in a fluidized bed dryer at 40° C. for 2 hours to remove almost all the water therefrom. To the granulation product, 0.3 g of N-lauloylalanine sodium and 1.9 g of polyethylene glycol 6000 were added, followed by uniform mixing for 10 minutes in a room kept at 25° C. and under 40% RH using a mixer. Next, the resulting mixture was subjected to compressive tableting using a tableting machine, a modification of Tough Press Correct 1527HU, produced by Kikusui Seisakusho, at a packing rate of 1.1 g per tablet, to yield 120 tablets of color developer replenisher tablet agent A for color negative films.

Procedure (2)

69.4 g of hydroxylamine sulfate and 4 g of Pineflow (Matsutani Chemical Industry Co., Ltd.) were milled, mixed and granulated in the same manner as procedure (1). The amount of water added was 3.5 ml. The granulation product was dried at 60° C. for 30 minutes to remove almost all the water therefrom. To the granulation product, 0.3g of N-lauloylalanine sodium was added, followed by uniform mixing for 3 minutes in a room kept at 25° C. and under 40% RH using a mixer. The resulting mixture was subjected to compressive tableting using a tableting machine at a packing rate of 0.56 g per tablet in the same manner as procedure (1), to yield 120 tablets of color developer replenisher tablet agent B for color negative films.

Procedure (3)

15 g of disodium 1-hydroxyethane-l,l-diphosphonate, 72.8 g of potassium sulfite, 375 g of potassium carbonate, 3 g of sodium hydrogen carbonate, 3.7 g of sodium bromide and 22 g of mannitol were milled and mixed in the same manner as procedure (1), after which they were granulated while adding 40 ml of water. The granulation product was then dried at 70° C. for 60 minutes to remove almost all the water therefrom. To the granulation product, 2 g of N-lauloylalanine sodium was added, followed by mixing for 3 minutes in a room kept at 25° C. and under 40% RH using a mixer. The resulting mixture was subjected to compressive tableting using a tableting machine at a packing rate of 3.9 g per tablet in the same manner as procedure (1), to yield 120 tablets of color developer replenisher tablet agent C for color negative films.

2) Bleacher Replenisher Tablets for Color Negative Films

Procedure (4)

175 g of ammonium ferric 1,3-propanediaminetetraacetate monohydrate, 2 g of 1,3-propanediaminetetraacetic acid and 17 g of Pineflow (Matsutani Chemical Industry Co., Ltd.) were milled, mixed and granulated in the same manner as procedure (1). The amount of water added was 8 ml. The granulation product was then dried at 60° C. for 30 minutes to remove almost all the water therefrom.

Procedure (5)

133 g of succinic acid, 200 g of ammonium bromide and 10.2 g of Pineflow were milled, mixed and granulated in the same manner as procedure (1). The amount of water added was 17 ml. The granulation product was then dried at 70° C. for 60 minutes to remove almost all the water therefrom.

Procedure (6)

66.7 g of potassium sulfate, 60 g of potassium hydrogen carbonate and 8 g of mannitol were milled, mixed and granulated in the same manner as procedure (1). The amount of water added was 13 ml. The granulation product was then dried at 60° C. for 60 minutes to remove almost all the water therefrom.

Procedure (7)

The granulation products obtained in the above procedures (4) through (6) were uniformly mixed in a mixer for about 10 minutes in a room conditioned at 25° C. temperature and under 40% RH. To this mixture, 6 g of N-lauloylsalcosine sodium was added, followed by mixing for 3 minutes. The resulting mixture was subjected to compressive tableting at a packing rate of 6.5 g per tablet using a tableting machine, a modification of Tough Press Correct 1527HU, produced by Kikusui Seisakusho, to yield 80 tablets of a bleacher replenisher tablet agent for color negative films.

3) Fixer Replenisher Tablets for Color Negative Films

Procedure (8)

2500 g of ammonium thiosulfate, 150 g of sodium sulfite, 150 g of potassium carbonate, 20 g of disodium ethylenediaminetetraacetate and 65 g of Pineflow (Matsutani Chemical Industry Co., Ltd. ) were milled, mixed and granulated in the same manner as procedure (1). The amount of water added was 50 ml. Granulation was followed by drying at 60° C. for 120 minutes to remove almost all the water from the granulation product.

Procedure (9)

The granulation product prepared in the above procedure (8) and 13 g of N-lauloylsalcosine sodium were mixed in a mixer for about 3 minutes in a room conditioned at 25° C. temperature and under 40% RH. The mixture was subjected to compressive tableting at a packing rate of 9.3 g per tablet using a tableting machine, a modification of Tough Press Correct 1527HU, produced by Kikusui Seisakusho, to yield 280 tablets of a fixer replenisher tablet agent for color negative films.

4) Stabilizer Replenisher Tablets for Color Negative Films

Procedure (10)

150 g of m-hydroxybenzaldehyde, 20 g of sodium laulyl sulfate, 60 g of disodium ethylenediaminetetraacetate, 65 g of lithium hydroxide monohydrate and 10 g of Pineflow were milled, mixed and granulated in the same manner as procedure (1). The amount of water added was 10 ml. Granulation was followed by drying at 50° C. for 2 hours to remove almost all the water from the granulation product.

Procedure (11)

The granulation product prepared in the above procedure (10) was subjected to compressive tableting at a packing rate of 0.48 g per tablet using a tableting machine, a modification of Tough Press Correct 1527HU, produced by Kikusui Seisakusho, in a room conditioned at 25° C. temperature and under 40% RH. to yield 280 tablets of a stabilizer replenisher tablet agent for color negative films.

Next, with respect to the above tablet agents, two tablets of each of agents A, B and C, two tablets of the bleach-fixer replenisher tablet agent, three tablets of the fixer replenisher tablet agent and one tablet of the stabilizer replenisher tablet agent were packaged for 1 unit; successive 20 units were packaged in a four-side sealed package of peel open packaging material. The peel open packing material used was a packing material having oxygen permeability and moisture permeability both shown in Table 17.

Timing of tablet and replenishing water addition is as shown in Table 16.

Processing was carried out so that the overflow from the color developing tank would be 5% of the tank solution per day.

Circulatory volume was set to 1.5 rotations/min.

TABLE 16

| | Replenishing interval for one individual pack of tablet and one replenishment of water | Amount of one replenishment of water |
|---|---|---|
| Color developing | Every 8 rolls of film (24 EX) | 161.4 |
| Bleaching | Every 8 rolls of film (24 EX) | 235.5 |
| Fixing | Every 8 rolls of film (24 EX) | 223.6 |
| Stabilizing | Every 8 rolls of film (24 EX) | 320 |

For comparison, 10 liter of each of the above tablet replenishers, dissolved in replenishing water in a replenisher tank, was supplied from the replenisher tank at the same replenishing rate as above.

The water loss due to evaporation was compensated every morning until the overflow outlet level was reached. Photographic densities at the maximum density portion were compared 2 months after initiation of processing.

The results are given in Table 17.

TABLE 17

| | Oxygen transmission ($mg/m^2 \cdot 24$ hr · tatm, 20° C. · 65% RH) | Moisture transmission ($mg/m^2 \cdot 24$ hr · tatm) | Maximum density | | | | | | Minimum density | | | | | |
|---|---|---|---|---|---|---|---|---|---|---|---|---|---|---|
| | | | Start of processing | | | After 2 months | | | Start of processing | | | After 2 months | | |
| | | | B | G | R | B | G | R | B | G | R | B | G | R |
| (1) | 15 | 3.0 | 3.02 | 2.40 | 2.01 | 3.00 | 2.39 | 2.00 | 0.01 | 0.01 | 0.01 | 0.02 | 0.02 | 0.02 |
| (2) | 20 | 15.0 | 3.02 | 2.40 | 2.01 | 2.99 | 2.37 | 1.92 | 0.01 | 0.01 | 0.01 | 0.05 | 0.04 | 0.05 |
| (3) | 70 | 4.8 | 3.02 | 2.40 | 2.01 | 2.94 | 2.34 | 1.99 | 0.01 | 0.01 | 0.01 | 1.05 | 0.06 | 0.07 |
| (4) | 90 | 20.0 | 3.02 | 2.40 | 2.01 | 2.43 | 2.34 | 1.91 | 0.01 | 0.01 | 0.01 | 0.07 | 0.08 | 0.09 |
| (5) | — | — | 3.01 | 2.39 | 2.02 | 2.37 | 2.30 | 1.86 | 0.01 | 0.01 | 0.01 | 0.20 | 0.20 | 0.30 |

From Table 17, it is seen that the color developer deteriorated and photographic density reduction occurred when using the comparative conventional processing method, while no such change occurred when using the method of the present invention.

Also, similar results were obtained when using the following solution for each package in place of the above stabilizer replenisher tablet agent in the method of the present invention.

| | |
|---|---|
| Diethylene glycol | 2.9 g |
| m-hydroxybenzaldehyde | 0.65 g |
| Emulgen 810 (Kao Corporation) | 0.2 g |

Example 8

An example control of the supply of replenishing water is given below to describe the relationship between the continuity of processing and the dissolution state of the solid processing agent.

Information on the amount of processing is an indirectly detected index of the state of reduction in the processing agent components in the processing solution according to the amount of processing. Therefore, if the processing agent components in the processing solution in the processing tank decrease rapidly due to continuous processing so that the shortage of the processing agent components cannot be compensated in time by dissolving the replenishing processing agent, supply of replenishing water based solely on the information on the amount of processing will result in the replenishing water to be added in advance of the supplementation of the processing agent components so that replenishing water will be present in excess transiently; this leads to disposal of the processing agent components as an overflow in dilution with the replenishing water in the case of the use of the overflow method to maintain a liquid surface level in the processing tank, which results in an undesirable reduction in the processing agent components. Considering this situation, in the present example, in view of the dissolution time of the processing agent added or the dissolution-dispersion time of the processing agent added, sequential supply of replenishing water is prevented while the processing agent remains dissolved or dissolved-dispersed by controlling the supply of replenishing water by a controlling means.

FIG. 6 is a block diagram of the above example.

Information on the amount of processing is generated by detecting means 8 and enters processing agent supply controlling means 9 and replenishing water supply controlling means 9-*b*, and replenishing water supply means 42 is controlled with reference to the data on the table 9-*c* as to processing agent dissolution time or processing agent dissolution-dispersion time with respect to processing agent supply controlling means 9 and replenishing water supply controlling means 9-*b*. As stated above, when the processing agent components of the processing solution in the processing tank decrease rapidly due to continuous processing, replenishing water is supplied after dissolution or dissolution-dispersion of the processing agent completes.

Next, four comparative examples and another example of embodiment of the present invention are given below. FIGS. 10 through 13 show the supplying apparatuses of the comparative examples.

Figure 10:
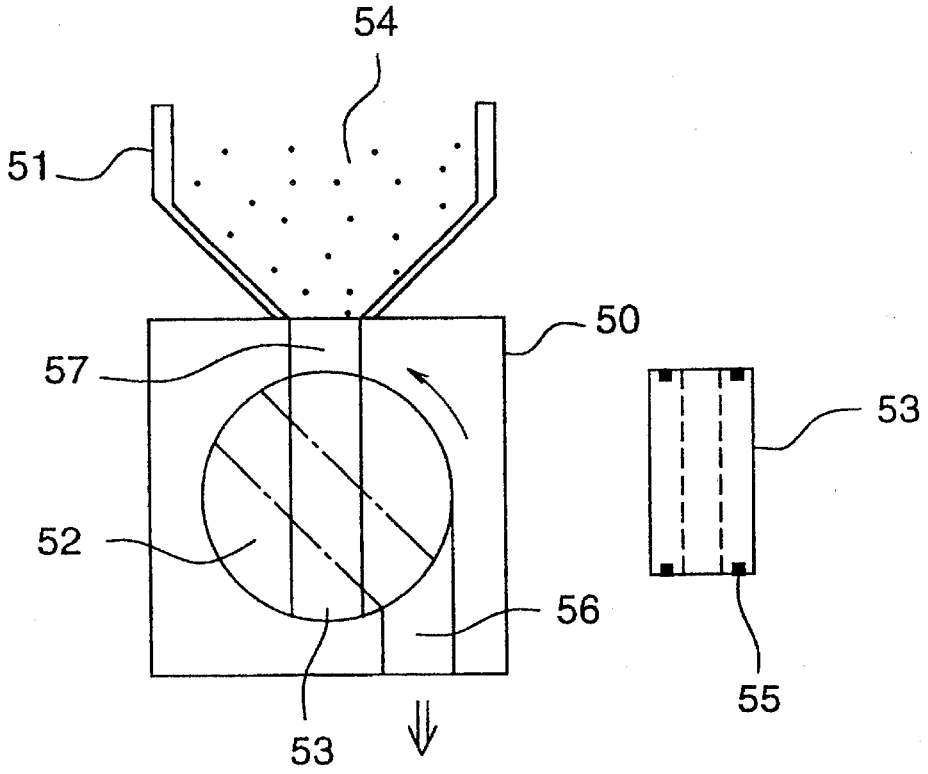
FIGS. 10(A) AND (B) show respectively a cross-sectional view of a comparative powdery processing agent supplying apparatus and an oblique view of the package thereof.
Figure 10:
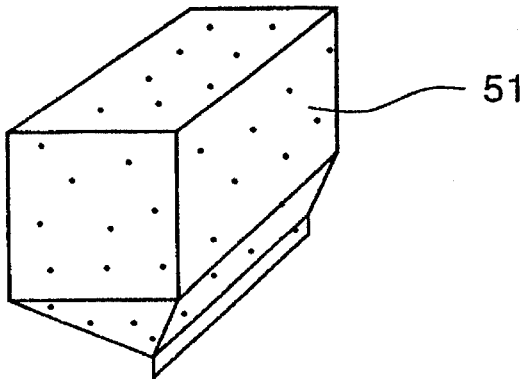

FIG. 10 shows Comparative Example 1. FIG. 10 (A) is a cross-sectional view of a powdery processing agent supplying apparatus, and FIG. 10 (B) is an oblique view of the package thereof. Supplying apparatus 50 comprises a hopper or package 51 for containing a granular processing agent, measuring hole 53 for calculating the amount of powdery processing agent, and rotary drum 52 for addition at constant rate. Rotary drum 52 is constructed moisture-resistant by a positional difference of measuring hole 53 and discharge portion 56. When package 51 was opened and set to the upper portion of the supplying apparatus, fine powder dust occurred and hampered operation. A given amount of the powdery chemical is measured at measuring hole 53, and upon communication with discharge portion 56 as a result of rotation of drum 52 by direction of the detecting means for the amount of processing of light-sensitive material, it stops and passes through discharge portion 56, so that a given amount of powdery chemical is supplied to the constant temperature chamber (filter tank) of the automatic processing machine. After completion of supply, drum 52 rotates, and it stops when measuring hole 53 and supplying portion 57 communicate with each other, and measurement of the powdery chemical begins.

This supplying apparatus was attached to the above automatic processing machine and a running test was carried out in the same manner as above. Stable photographic performance could not be obtained, since measuring accuracy for each run was bad due to difference in grain size distribution between moistened and non-moistened portions in package 51 due to insufficient prevention of moisturizing, or the amount of chemical entering measuring hole 53 fluctuated according to the amount of the powdery chemical residing in hopper 51, so that measuring accuracy was bad. In some cases, the powdery chemical failed to enter measuring hole 53 because it solidified. Another drawback is that fine powder moves downward while relatively large powder remains in the upper portion, which results in an imbalanced composition. Still another drawback is that dust entering drum gaps causes rotation failure and hampers the realization of maintenance-free quality.

Figure 11:
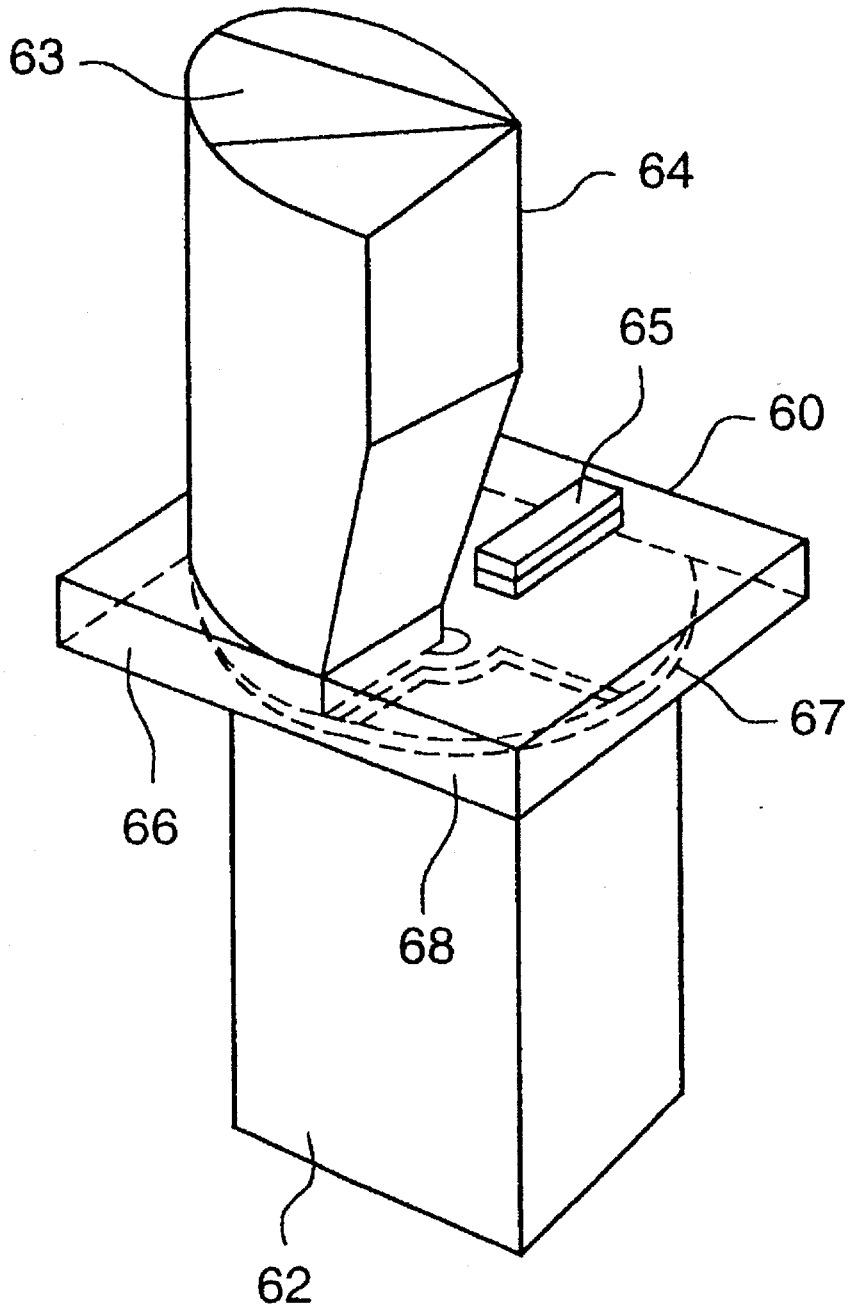
FIG. 11 is an oblique view of a powdery processing agent supplying apparatus.

FIG. 11 is an oblique view of the powdery processing agent supplying apparatus of Comparative Example 2.

Supplying apparatus 60 is designed to contain the processing agent in a plurality of units of powdery chemical stocking portion 63 as with conventional concentrated kits. Demoisteurizer 65 is provided to improve powdery chemical storage stability in the stocking portion.

According to the information on the processing of light-sensitive material, rotor 67 transfers the powdery processing agent received on table 66 to discharge portion 68 at constant rate.

Using this supplying apparatus, a running test was carried out. Exactly the same problems as in Comparative Example 1 arose.

Specifically, operation was hampered by the dust formed upon charging the powdery processing agent to hopper 64, and precision was poor. In addition, the problem of caking in the stocking portion remains unsolved, though storage stability is good owing to the presence of a demoisteurizer and owing to separation by part.

Another major problem is apparatus instability due to adhesion of powdery processing agent dust to the rotor, which results in considerably poor maintenance quality.

Figure 12:
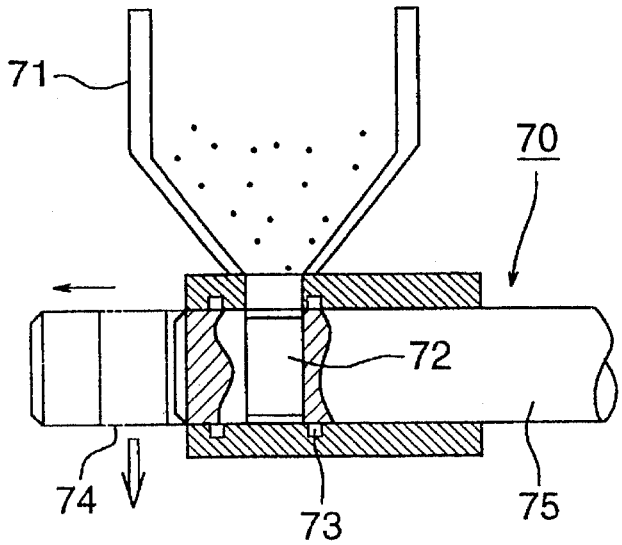
FIG. 12 is a cross-sectional view of another powdery processing agent supplying apparatus.

FIG. 12 is a cross-sectional view of the powdery processing agent supplying apparatus of Comparative Example 3.

The action of supplying apparatus 70 is as follows: The powdery processing agent is added to hopper 71, piston 75 moves horizontally (to the right) according to the amount of processing of light-sensitive material, a given amount of the powdery processing agent enters measuring hole 72, piston 75 moves in the opposite direction (to the left), and a given amount of the powdery processing agent is supplied to the constant temperature chamber (filter tank) via discharge portion 74.

Using this supplying apparatus, a running test was carried out. Exactly the same problems as in Comparative Example 1 occurred.

Figure 13:
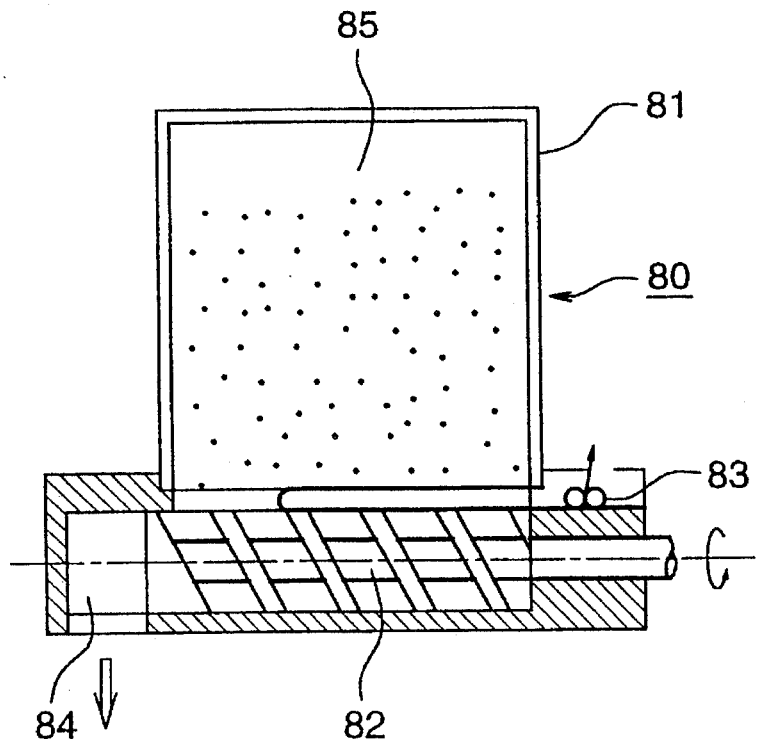
FIG. 13 is a cross-sectional view of another powdery processing agent supplying apparatus.

FIG. 13 is a cross-sectional view of the powdery processing agent supplying apparatus of Comparative Example 4.

With package 81, containing powdery processing agent 88, attached (charged) thereto, and with capability of automatically opening the package by means of roller 83, supplying apparatus 80 serves to supply the powdery chemical via discharge portion 84 by controlling the rotation rate of screw 82.

This apparatus proved to have the same drawback as in Comparative Example 1 because of separate weighing of the powdery chemical according to the amount of processing of light-sensitive material, though it is free of dusting upon package opening and charging, since it is capable of automatically opening the package. A particular drawback is that measuring accuracy is affected by the screw pitch size (crest/valley) so that uncontrollable dust is preferentially discharged. Another drawback is that measuring accuracy lowers as the screw rotation rate decreases due to deterioration of the powder attached to the screw by moisture.

Also, maintenance quality is poor.

Figure 14:
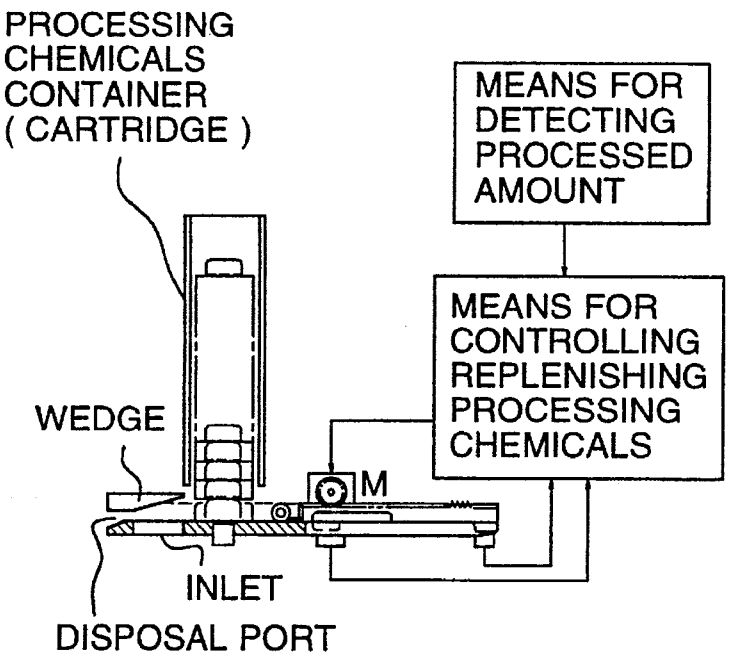
FIGS. 14(A), (B), (C) and (D) respectively show a cross-sectional view and an oblique view of a PTP-packed processing agent supplying apparatus relating to the present invention.
Figure 14:
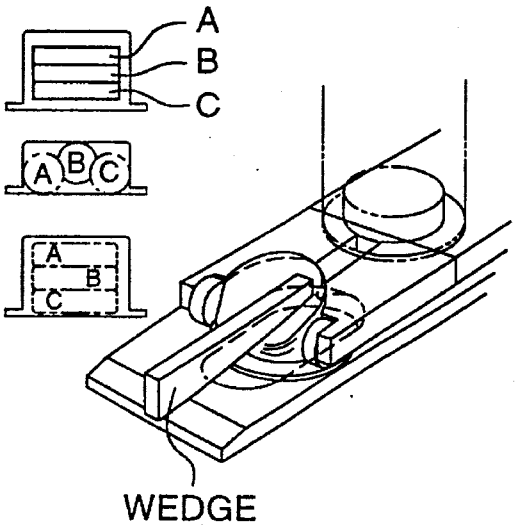
Figure 14:
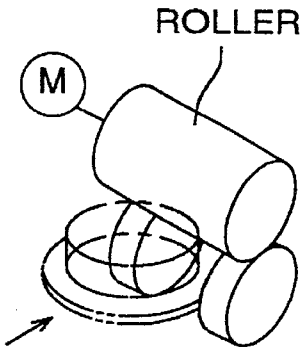
Figure 14:
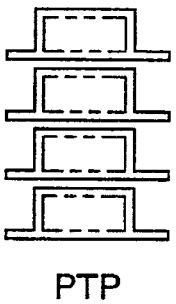

FIG. 14 shows a charging apparatus for a PTP (pressure through package) packaged solid processing agent relating to the present invention, wherein panel (A) is a cross-sectional view of the processing agent supplying apparatus, panel (B) is an oblique view of the package cutting means, panel (C) is another oblique view of the package cutting means, and panel (D) is a cross-sectional view showing the state of loading of a PTP-packaged solid processing agent.

The processing agent stocking container contains a PTP-packaged solid processing agent, and it may be of the separate stocking type or the cartridge type wherein the solid processing agent is contained in a cartridge. A known material can be used for PTP packaging, and it is preferable to package the solid processing agent in a tablet form.

The PTP-packaged solid processing agent is supplied from the lower portion of the stocking container. Upon a given amount of light-sensitive material has been processed, information from the processing amount detecting means is sent to the processing agent supply controlling means, and the PTP-packaged solid processing agent is pushed out to, and crushed on, the fixed wedge-shaped plate by the motor, whereby the lower part of the PTP package (mainly of aluminum) is broken and the solid processing agent is added to the processing tank via the adding port. The PTP package, now empty after addition, is further pushed out to be disposed via the disposal port. In addition to the use of a wedge, a roller may be used as a crushing means, which may be optionally selected.

Figure 15:
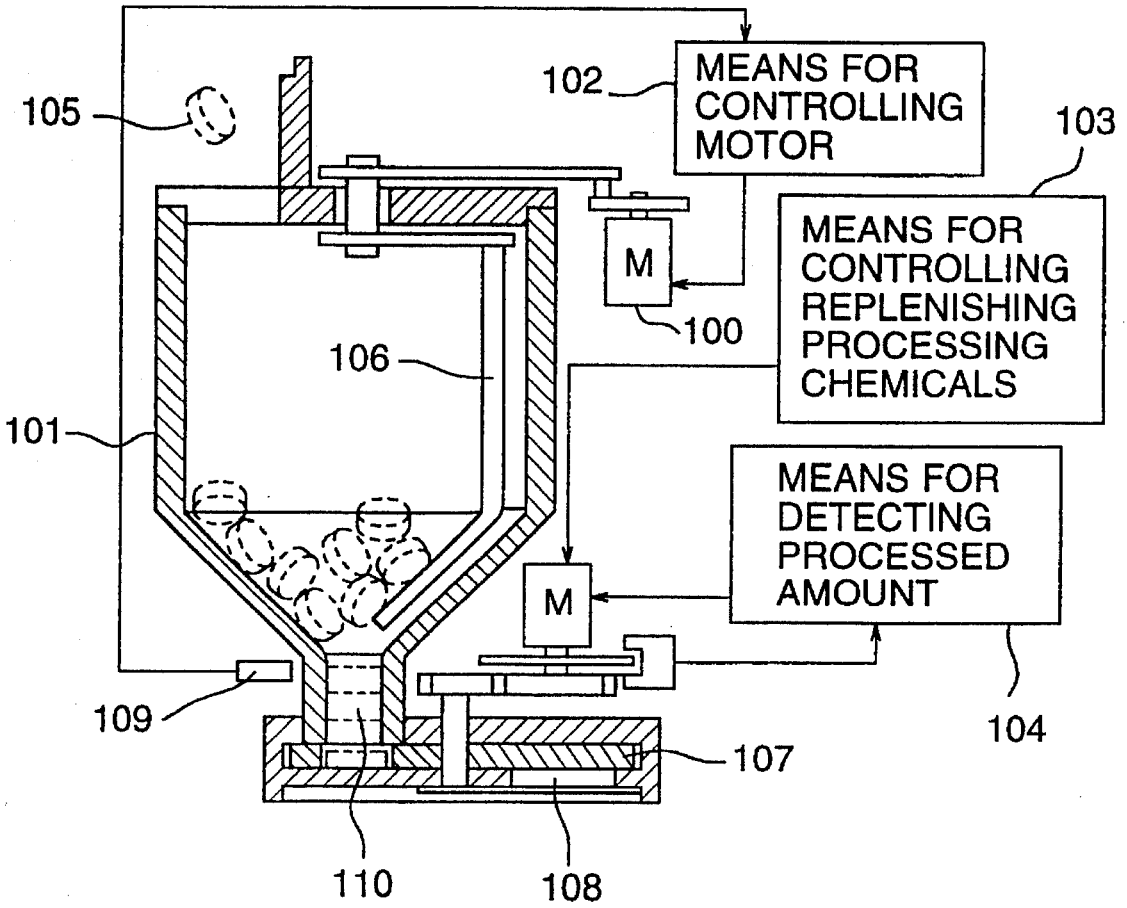
FIGS. 15(A), (B) and (C) show examples of the supplying apparatus for a solid processing agent.
Figure 15:
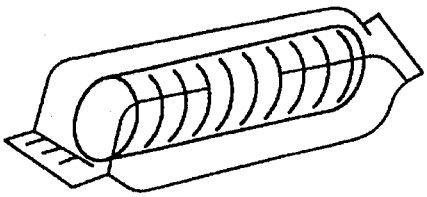
Figure 15:
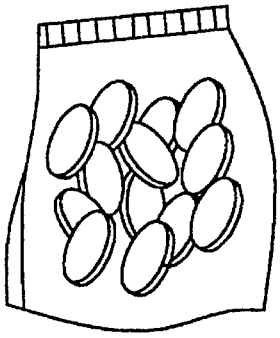

FIG. 15 shows an example of a supplying apparatus based on the part feeder method for bulk-packaged tablets (separately weighed in advance) relating to the present invention.

Package A or B was opened, and the bulk-packaged tablet chemical was placed in hopper 101. At this operation, handling was easy with no dust formation nor caking. Upon signal reception from residual amount detecting means 109, stirrer 106 begins to start, and tablets 105 are arranged in tablet arranging portion 110. According to the amount of light-sensitive material processed, processing agent supply controlling means 103 acts, and turn table 107 transports the tablets from discharge portion 108 to the adding portion. After one rotation, turn table 107 stops upon direction from the turn table controlling means (several times of tablet supply by a single direction is also possible). The tablet enters the opening of turn table 107.

The advantages are that the packaging material is not expensive and easily handlable, that accurate addition is possible, and that the presence of tablet arranging portion 110 prevents faulty supply by the turning table, thus offering high efficiency. Reduction in the use of plastic containers is desirable from the viewpoint of environmental conservation. Freedom of dust formation ensures maintenance-free quality because of no stain in the supplying apparatus.

FIG. 16 shows an example of supplying apparatus 120 based on the parts feeder method for bulk-packaged tablets (separately weighed in advance) relating to the present invention.

Package A or B of the bulk-packaged tablet chemical was opened and the tablets were placed in hopper 133. In this operation, handling was easy with no dust formation nor caking. Upon signal reception from residual amount detecting means 125, mobile element 124 begins to rotate, and a given units of the tablet chemical are arranged in tablet arranging portion 129. When a given number of units have been arranged, mobile element 124 stops. Upon this action, sweeper 123 is very effective for the tablets to enter pocket 122 of mobile element 124 and be arranged in arranging portion 125.

According to the amount of processing of light-sensitive material, processing agent supplying means 126 acts to rotate shutter 131 and drop the tablet chemical. Next, first shutter 131 rotates in the opposite direction and inserts one tablet between shutters 131 and 132. Shutter 132 rotates, and the tablet chemical passes discharge portion 128 to the receiving portion. Next, shutter 132 rotates in the opposite direction, and shutter 131 closes.

The advantages are that the packaging material is not expensive and easily handlable, that accurate addition is possible, and that the presence of tablet arranging portion 129 prevents faulty supply by the turn table, thus offering high efficiency. Reduction in the use of plastic containers is desirable from the viewpoint of environmental conservation. Freedom of dust formation ensures maintenance-free quality because of no stain in the supplying apparatus.

Next explanation will be for a supply means for solid processing agents of the invention wherein packing materials are caused to face each other to be pasted to form a package that holds a solid processing agent, which is different from that in FIG. 14, namely for an embodiment of a replenishing means for processing agents. In the embodiment, the supply means is composed of an accepting/holding section and a winding/falling section.

The accepting/holding section is a portion which accepts either processing agent package 1050 (see FIG. 17 (A)) containing processing agent individual packages or processing agent housing object 1005 housing the processing agent packages 1050, and holds it temporarily so that laminated portion (border portion) 1101 of packing materials may be torn off and processing agents-may fall. The winding/falling section is a mechanism which causes a processing agent to fall through the clearance between separated two packing materials on a filtering means provided on a processing tank and grasps the tips of the separated two packing materials to take up.

The package to be explained here is one wherein a solid processing agent is housed in a small airtight chamber formed by laminating two packing materials having no air-permeability facing each other each having a swelled portion formed by transforming a sheet-shaped substance having no air-permeability or a part thereof. The packing material having no air-permeability which has a swelled portion formed by transforming a part of a sheet-shaped substance is one wherein a container-shaped swelled portion is formed on a part of the sheet-shaped substance by a specific means, and the plane other than the swelled portion is used as a portion to be laminated with other sheet-shaped substance. The aforementioned tearing in the embodiment means that the laminated portion mentioned above is separated. It is therefore preferable for easy separation that edges for laminating are not stuck together firmly.

In the form wherein a plurality of processing agent individual packages are arranged in the present embodiment, the processing agent individual packages are arranged to form a row, and two belt-shaped packing materials are laminated to form each processing agent individual package. By selecting an appropriate laminated strength between the above-mentioned two belt-shaped packing materials, it is possible to separate them continuously and to keep the airtightness between them for preventing moisture and oxygen from entering them.

In the embodiment mentioned above, processing agents are taken out after two packing materials are separated. In this way, the processing agents can be taken out and fallen simply and surely, and when the processing agent is in a shape of a tablet, the tablet is free from compulsory force and thereby is not broken, thus, scattering of processing agents can be prevented. Further, even when the processing agent is in a form of a granule or powder, there is an effect that scattering of processing agents can be prevented and processing agents are prevented from remaining in a package.

Next, the embodiment mentioned above employs an arrangement wherein two packing materials are separated and taken up. This arrangement contributes greatly to prevention of scattering of packing materials after taking out processing agents, and to miniaturization and simple handling for disposal.

FIG. 17 (A) is a perspective view of processing agent package 1050 and FIG. 17 (B) is a partial sectional view showing how processing agents fall.

The figures mentioned above show how processing agent housing object 1005 is separated and how processing agent T is fallen, and packing material 1010 is a nonpermeable packing material having swelled portion 1501 formed by transforming a part of a sheet-shaped substance, while the processing agent T is housed in the swelled portion 1501 on the processing agent package 1050. Therefore, the packing materials are separated with the swelled portion 1501 facing upward so that the processing agent can fall by gravity. It is therefore preferable that flat sheet-shaped packing material 1111 is positioned downward or obliquely downward to be peeled off. When the packing materials are separated toward both sides horizontally for the structure reason, however, fall of processing agent by gravity can be accelerated by an inclined plane 1502 provided on the cylindrical portion on the side of the swelled portion 1501.

FIG. 17 (*c*) is a perspective view of an example of the solid processing agent supplying apparatus 140 of the invention of a type wherein solid processing agents are added to processing tanks by peeling the aforementioned packages containing solid processing agents.

The tip of the four-side sealed package containing the solid processing agent is set on winding shaft 142, which is a means for immobilization, via roller 141. When a given amount of light-sensitive material has been processed, as detected by the processing amount information detecting means, the processing agent supply controlling means passes a signal to activate the motor of winding shaft 142 which is also a processing agent supplying means, whereby the package containing the solid processing agent is moved in a given distance and the required number of units of the solid processing agent are added. The package may be moved by any method, including the method in which a notch made in the package is detected, the method in which a printed pattern is detected and the method in which the processing agent in the package is detected; essentially, the required number of units of the solid processing agent are detected accurately and moved by means of roller 141 and winding shaft 142. Roller 141 is provided for immobilizing and positioning the package and for other purposes, having two winding shafts to peel the package and add the solid processing agent.

In this type, the solid processing agent may be in the form of granules, pills, tablets or powder, but the solid processing agent preferably in a tablet form, since it is advantageous that accurate addition is possible and stain is not likely because tablets do not adhere to the seal. After completion of winding, the package may be removed directly from the winding shaft, or may be rewound for .disposal along with the cartridge.

Each of FIGS. 17 (D) and 17 (E) shows a replenishing and supplying device of a biaxial take-up system wherein packing materials 1010 and 1011 are taken up separately, which is different from the embodiment shown in FIG. 17 (C). FIG. 17 (D) is a perspective view of a winding/falling section, FIG. 17 (E) is a perspective view of a winding/falling section wherein take-up shafts are inclined (being out of upright), and FIG. 17 (F) represents top views showing applied examples of those shown in FIGS. 17 (C) and 17 (D). Packing materials 1010 and 1011 are separately taken up by take-up shafts 1131 and 1132 respectively. In this case, as taking up of packing materials makes progress, separation border portion 1101 moves depending on a taken-up outside diameter and a falling point of processing agents changes accordingly. When an entrance through which processing agents are added to processing tank 1001 is required to be small, it is preferable to provide peeling roller 1181 as shown in FIG. 17 (F).

Next, FIG. 17 (E) shows an example of a biaxial take-up system wherein take-up shafts are inclined. This example is different from the previous example of a biaxial take-up system, and one packing material 1011 is started to be taken up first and the other packing material 1010 is taken up after the space for processing agent T to fall is prepared in the example shown in FIG. 17 (E). This system, when processing agent housed in swelled portion 1501 on packing material 1010 is a tablet, makes the tablet to fall smoothly and offers preferable effect for specifying a falling point of the tablet. It can also be applied to granular or powdery processing agent. In FIG. 17 (E) again, peeling roller 1181 is provided to prevent that an outside diameter is increased and border portion 1101 changes as taking up made by take-up shaft 1132 makes progress. Incidentally, no peeling roller is required to be provided on take-up shaft 1131 in a distant position, because it does not cause any change on border portion 1101. In the present example, however, roller 1019 that presses the circumferential surface of the take-up shaft is urged by spring 1020.

FIG. 17 (F) is a top view showing a developed type of the biaxial take-up system shown in FIG. 17 (D) wherein grid 1021 is provided to be in parallel with take-up shafts 1131 and 1132. Owing to the grid, tips of packing materials 1010 and 1011 are grasped on a cinching basis between the grid and take-up shaft or between the grids, and thereby the tips are not drawn out by take-up torque, while they can be released easily when unwinding. In the example in FIG. 17 (F), rewinding shaft 1022 capable of being driven by a rewinding means provided on processing agent housing object 1005 is affixed to the trailing edge of processing agent package 1050 so that the rewinding shaft 1022 may be engaged with the rewinding means after all processing agents are released and empty packing material may be wound back into the case which is a processing agent housing object for easy disposal of both the empty packing material and the case.

FIG. 18 represents an example of the supply apparatus of a mono-axial taking-up system that is a preferred embodiment of the invention, wherein (A) is a top view, (B) is a perspective view, (C) is a top view of a taking-up axis, and (D) represents top views of various packages.

Processing agent 151 is packaged in a four-side sealed package 152 as illustrated in FIG. 18 (D).

In the packaging style of FIG. 18 (D), the package material may be any commonly used polymer resin package, aluminum or composite material, as long as it possesses good moisture resistance and low oxygen permeability.

Package 152 housing the four-side sealed processing agent 151 is peeled via a cylinder 153 (semicylinder guide) and processing agent 151 is added to constant-temperature tank (processing tank 1001) via adding port 154, where cylinder 153 and winding shaft 156 serve as a processing agent supplying means. Package 152 is wound by winding shaft 156, wherein winding is controlled by the processing agent supplying means receiving a signal from the light-sensitive material processing amount detecting means. For winding, the dial is opened, and tip of package 151 is set on winding shaft 156 which is also an immobilizing means for the processing agent stocking package via the cylinder, and dial 157 is turned to immobilize the package to clamper 158 and wind it.

Operations of a device shown in FIG. 18 will be explained in a more detailed manner as follows. Processing agent package 152 peeled at its tip and thereafter are separated into packing materials 1010 and 1011 surrounding semicylinder guide 153 and they are put together by take-up shaft 156 to be sandwiched between fixed semicylinder member 1014, clamper 158 and semicylinder member 1015 capable of approaching and separating.. When the .clamper 158 is rotated while packing materials are sandwiched, a part of the clamper 158 is protruded from groove 1017 provided on the fixed semicylinder member 1014, and the distance from the semicylinder member 1015 capable of approaching and separating is narrowed, thus, the above-mentioned packing materials 1010 and 1011 are sandwiched. When the clamper 158 is further rotated, the semicylinder member 1015 capable of approaching and separating rotates around shaft 1151, thereby, a cylinder-shaped body formed by an external envelope between the fixed semicylinder member 1014 and the semicylinder member 1015 capable of approaching and separating swells.

Incidentally, there is established a limit of rotation for the semicylinder member 1015 capable of approaching and separating so that pressure for sandwiching packing materials 1010 and 1011 within a protrusion limit of clamper 158 may be sufficient.

Under the condition that the packing materials are sandwiched, the take-up shaft 156 is rotated to take up packing materials. Known means such as electric motor M or the like can be used for rotating the take-up shaft 156.

In FIG. 18, open portion 1121 of the semicylinder guide 153 is positioned to face the border portion 1101 where packing materials 1010 and 1011 separated from the processing agent package 152 are still sticking to each other, and the open portion is enough in size to accept a processing agent. Therefore, processing agent 151 housed hermetically between separated packing materials 1010 and 1011 can enter the open portion 1121 to fall along the inside of the semicylinder guide 153. The processing agent further falls to processing tank 1001 (constant temperature tank 155)through an opening provided at the lower end of the semicylinder guide 153.

When clamper 158 is rotated oppositely to its previous rotation direction so that packing materials 1010 and 1011 may be released from sandwiching and the semicylinder capable of approaching and separating may be released for returning, after all processing agents 151 in a series of the processing agent package 152 have fallen while packing materials 1010 and 1011 have been taken up, the cylinder-shaped body formed by an external envelope mentioned above shrinks to create a clearance between the cylinder-shaped body and an inside diameter of a cylinder formed by taken up packing materials. Thus, the packing materials taken up can be drawn out easily. How the clamper works is shown in FIG. 18 (C) in which semicylinder member 1015 in clamping is shown with two-dot chain lines.

Figure 19:
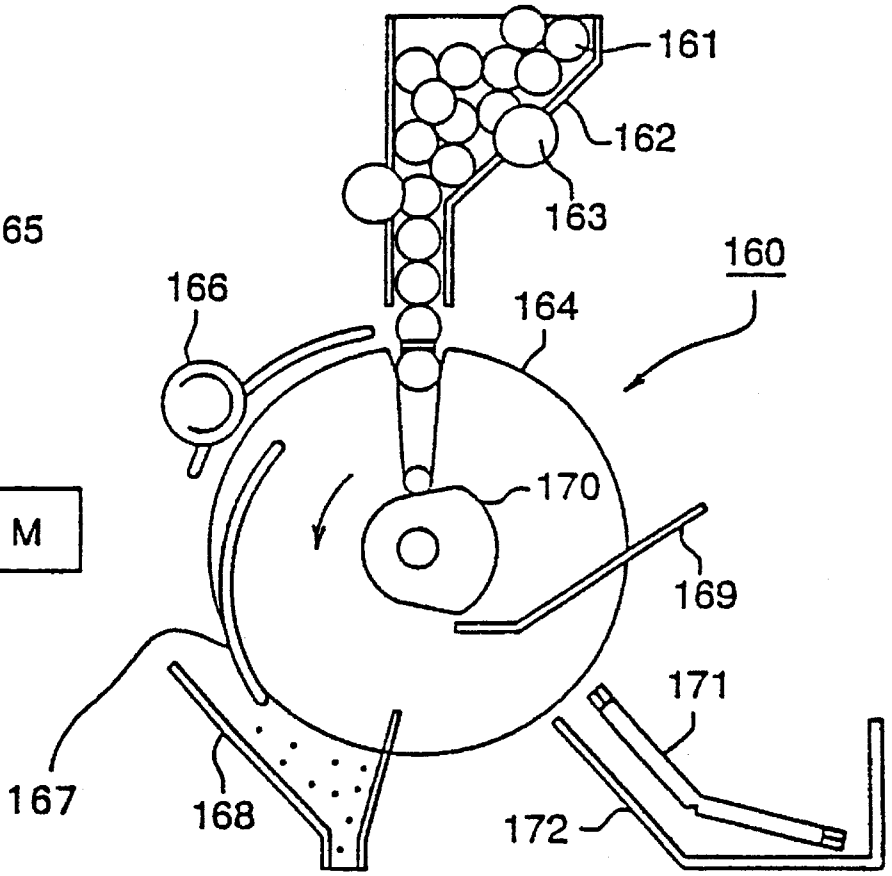
FIGS. 19(A) and (B) show a side cross-sectional view and a front cross-sectional view of a supplying apparatus.
Figure 19:
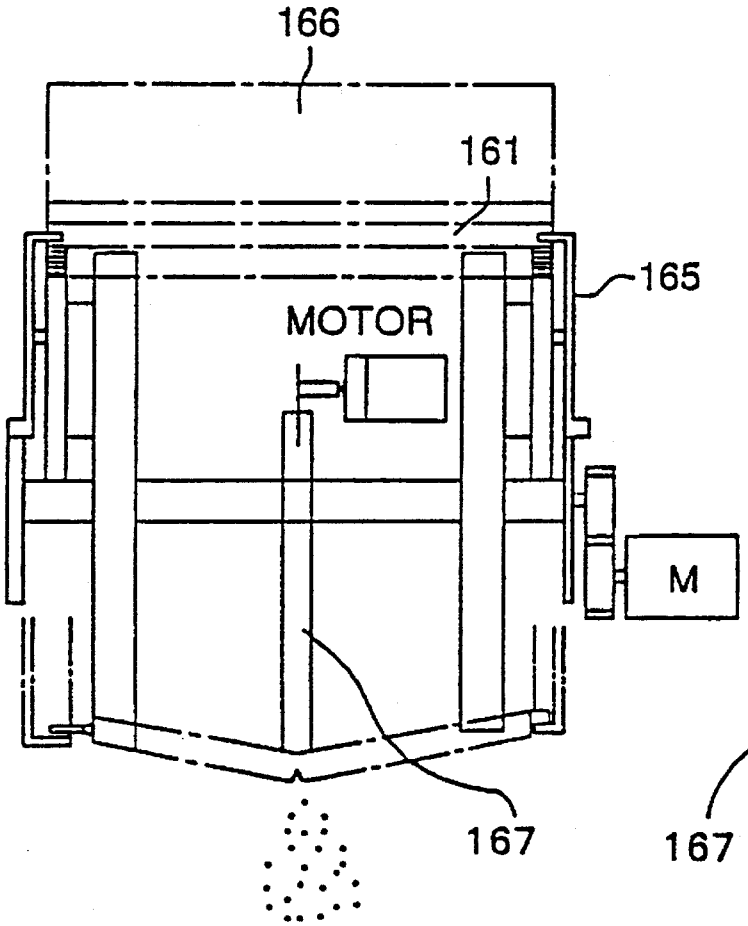

FIG. 19 shows an example of a supplying apparatus 160 wherein a solid processing agent 161 is in a stick package, wherein panel (A) is a side cross-sectional view, and panel (B) is a front cross-sectional view.

Solid processing agent 161 in a stick package is placed in stocking container 162. Stick-packaged solid processing agent 161 is then transferred to turret 164 by anti-bridging roller 163 and another roller serving to supply to the turret. Stick-packaged solid processing agent 161 is then immobilized at both ends by clamper 165 and then transferred to a cutter portion by rolling action, where the center of the stick-package is partially or completely cut by cutter 166 and transferred to two-fold plate 167 by rolling action, where stick-packaged solid processing agent 161 is bend and added to chute 168 packaged in the stick package via the cut made by rotary cutter 166. After addition, solid processing agent 161 is transferred to scrap drop bar 169, and clamper 165 is disabled by clamp switching cum 170 to dispose scrap 171 into recovery chute 172.

FIG. 20 is a cross-sectional view of a mode of embodiment of the present invention.

Processing portion 181 and receiving portion 185 in the constant temperature chamber 182 constituting the processing tank communicate mutually. The processing solution is forced to be circulated by circulatory pump 183 via the lower portion of the processing tank and discharged into filter portion 182 and then enters processing portion 181 via tablet receiving portion 185.

Upon processing of the light-sensitive material, the amount of processing is detected by processing amount detecting means 192. When a given level of processing amount has been detected, motor M2 is activated by processing amount supply controlling means to supply previously weighed tablets to receiving portion 185 in constant temperature chamber 182.

The tablets are added directly to stocking container 187, after which arranging means 188 is driven by motor M1 upon signal reception from arranging amount controlling means 186 to arrange the tablets and supplied to arranging portion 189. The tablets thus supplied to arranging portion 189 are transported to above the receiving portion by the rolling action of the supplying means upon drive of motor M2 upon signal reception from controlling means 190, and added to receiving portion 185. From the viewpoint of tablet moisture resistance, it is preferable to substantially separate processing agent supplying means 191 from constant temperature chamber 182.

The tablets are added to receiving container 187 after breaking its package as illustrated in FIGS. 20 (A) and (B). The packages illustrated in FIGS. 20 (A) and (B) may be of a known material such as paper, polymeric resin or aluminum, with preference given to a material possessing good moisture resistance and low oxygen permeability.

Figure 21:
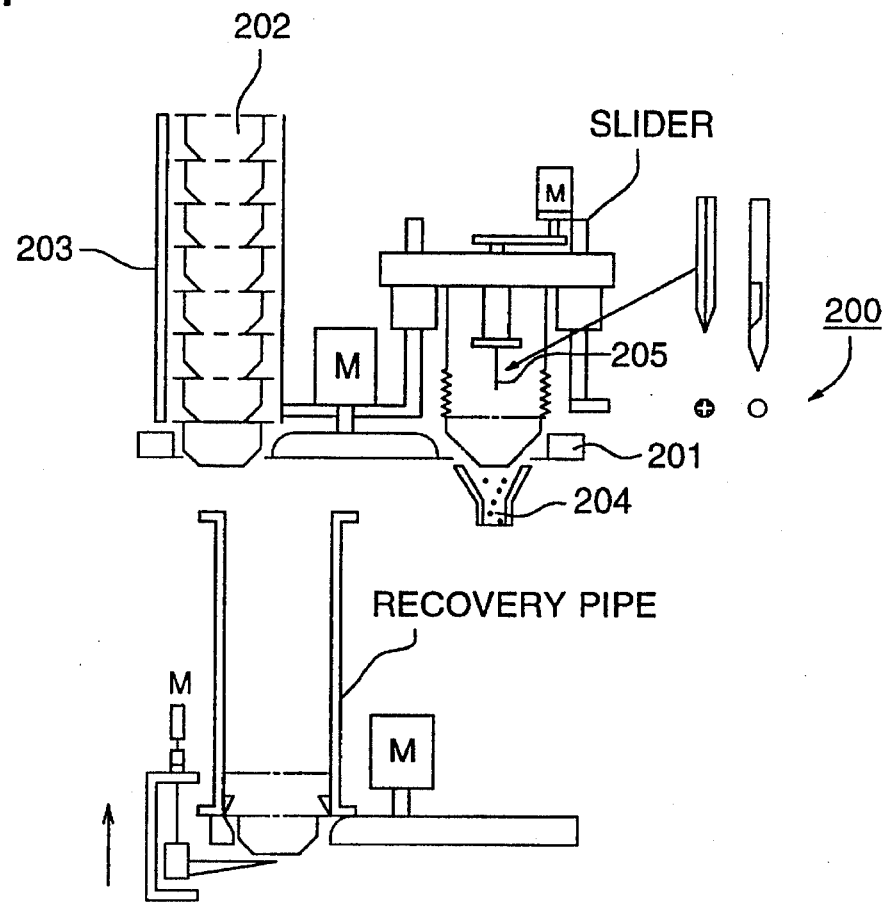
FIG. 21 is a cross-sectional view of a supplying apparatus for a blister-packaged solid processing agent.

FIG. 21 is a cross-sectional view of an example of supplying apparatus 200 for a solid processing agent in blister package.

Single package 202 containing the solid processing agent is set on stocking portion 203.

According to the amount of processing of light-sensitive material, disc 201 rotated over an angle of 180°, after which needle 205 penetrates single package 202 to reach discharge portion 204 in package 202 to supply the solid processing agent to the receiving portion. Emptied package 202 is disposed via the disposal port.

Although the solid processing agent may be in powder or granules, granules are preferred, since powder adheres to the container.

Advantages are easy handling and maintenance-free quality owing to the absence of dust stain of supplying apparatus 200.

Figure 22:
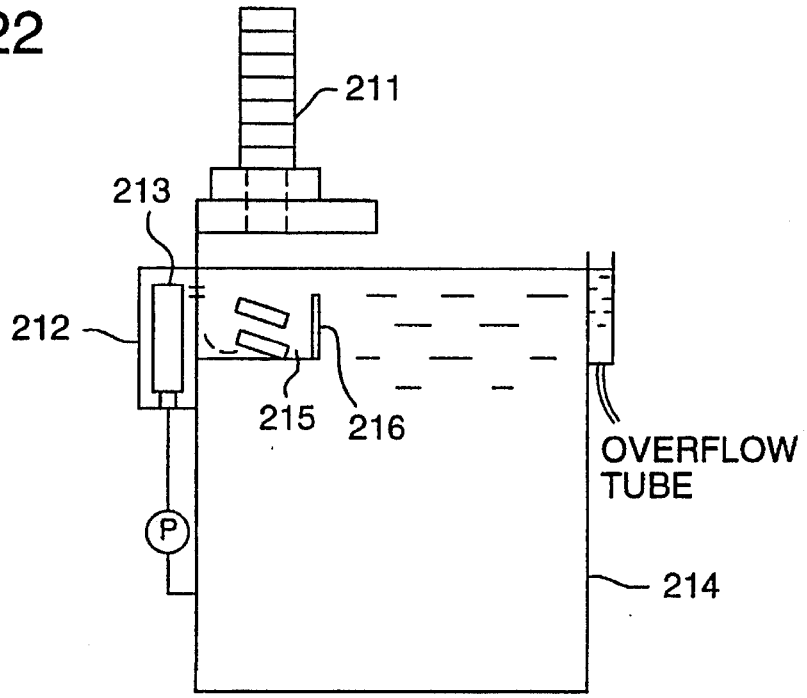
FIG. 22 is a cross-sectional view of an example of a supplying apparatus for adding a solid processing agent directly to a processing tank.

FIG. 22 is a cross-sectional view of an example of the present invention.

According to the amount of light-sensitive material processed, the solid processing agent is supplied directly to receiving portion 215 in the processing tank via tablet chemical stocking portion 211. Receiving portion 215 is equipped with a solid processing agent filter 216 to prevent the undissolved processing agent from adhering directly to the light-sensitive material. The material for this filter 216 is not subject to limitation. Although the mesh size is not subject to limitation, preference is given to 10 to 100 μm from the viewpoint of solution passage and filtering efficiency.

Nearly equivalent effect is obtained to the case where the solid processing agent is supplied to constant temperature chamber 212 constituting the processing tank. The only drawback is the inferior compactness due to the separation of receiving portion 215 in the processing tank.

Figure 24:
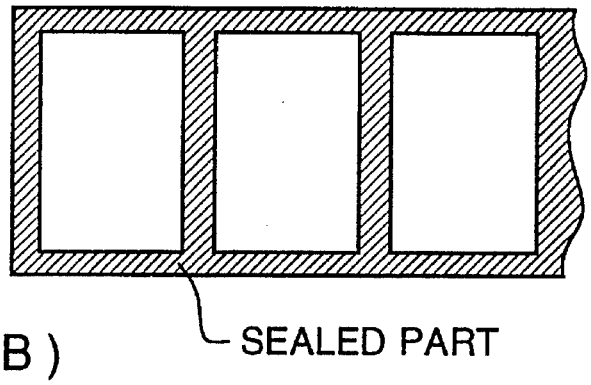
FIGS. 24(A) through (D) show examples of three-side and four-side seal packages.
Figure 24:
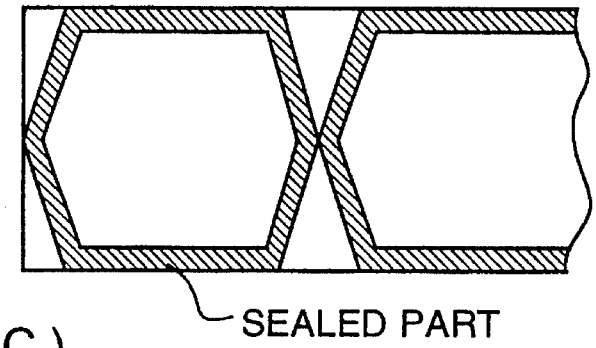
Figure 24:
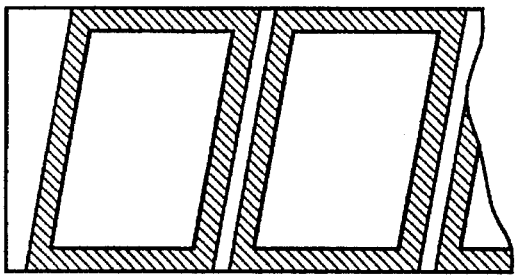
Figure 24:
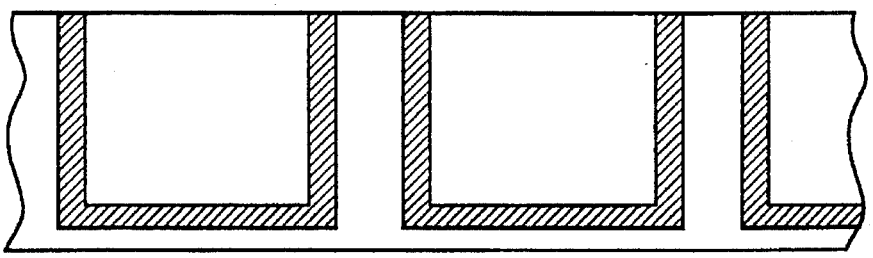

FIGS. 23 and 24 show examples of four-side sealed and three-side sealed packages, which are not to be construed as limitative. In the seal package illustrated in FIG. 23 (A), several kinds of tablets are contained in a single package unit. In the package of FIG. 23 (B), tablets of different sizes are separately contained. In the package of FIG. 23 (C), granules or powder is packaged. In the package of FIG. 23 (D), tablets of the same size are separately packaged. In the package of FIG. 23 (E), a plurality of small tablets of the same chemical of the same size are contained.

Figure 25:
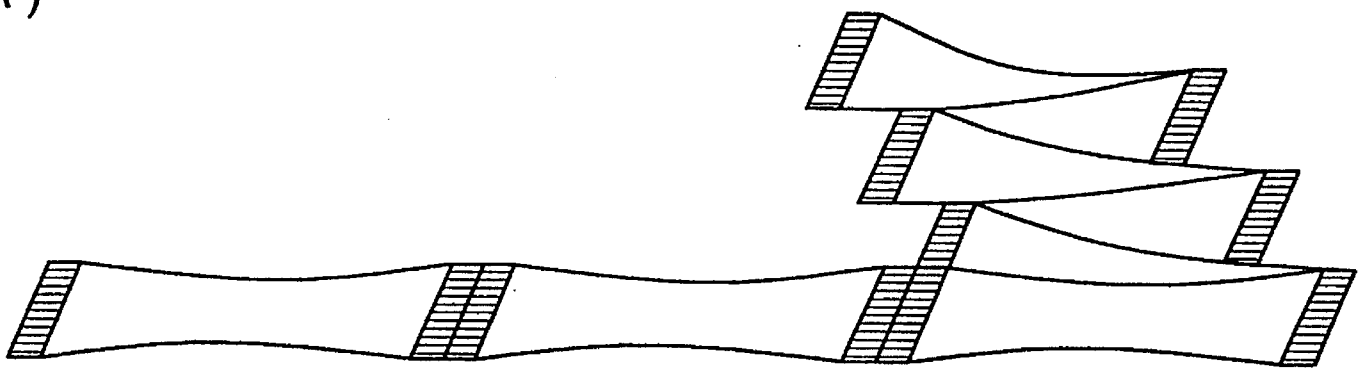
FIGS. 25(A) and (B) are plans of a stick package.
Figure 25:
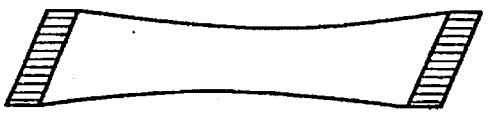

FIGS. 24 (A), (B) and (C) are plans of four-side sealed packages. FIG. 24 (D) shows an example of three-side package. FIGS. 25 (A) and (B) show examples of stick packages. Any of these examples is not to be construed as limitative.

Figure 26:
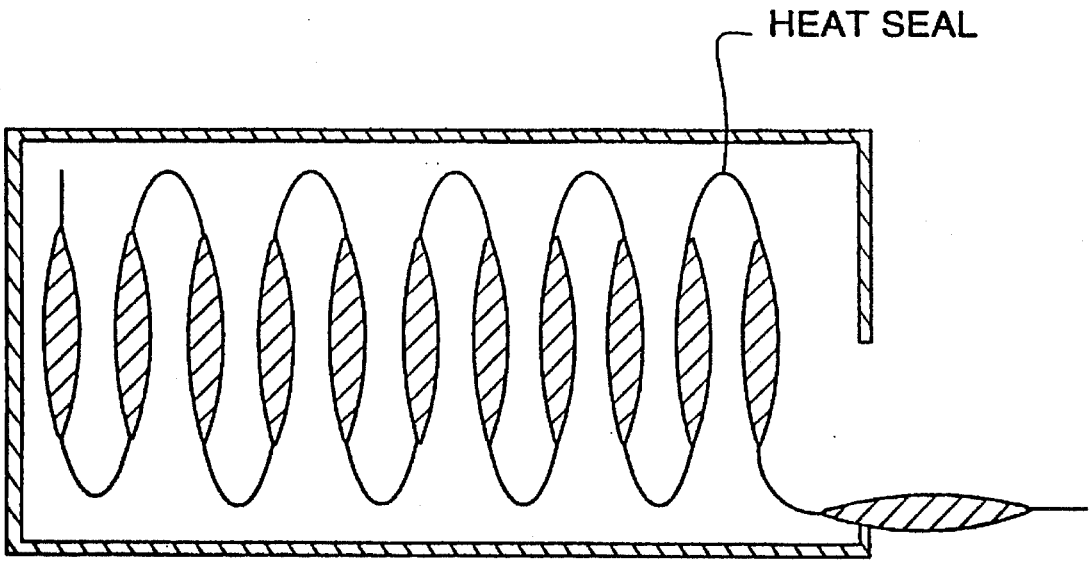
FIG. 26 is a cross-sectional view of another example of stick package.

FIG. 26 is a cross-sectional view showing tablets, granules or powder heat sealed and then folded and housed in the container.

Figure 27:
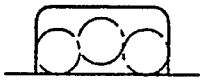
FIGS. 27(A) through (E) are examples of PTP packaging.
Figure 27:
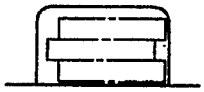
Figure 27:
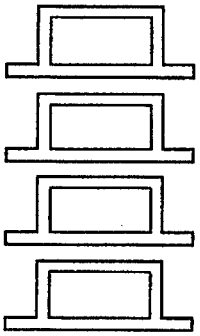
Figure 27:
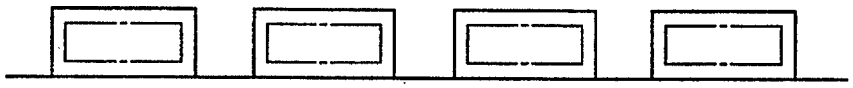
Figure 27:
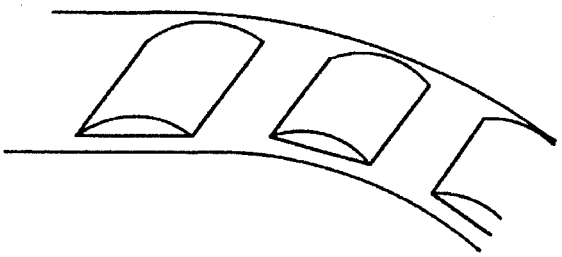

FIG. 27 shows examples of PTP package, which are not to be construed as limitative. FIG. 27 (A) shows a pill-formed solid processing agent in PTP package. FIG. 27 (B) shows a state of several tablets of processing agent in package. FIG. 27 (C) shows a state of longitudinal arrangement of packages containing tablets, granules or powder. FIG. 27 (D) shows a transversal arrangement of these packages. The blister package illustrated in FIG. 27 (E) is also acceptable.

Figure 28:
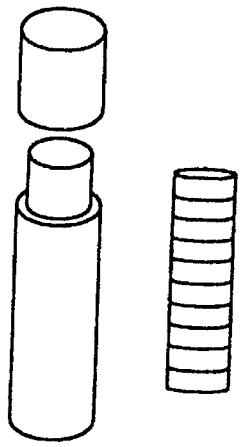
FIGS. 28(A) through (C) are examples of bulk packaging.
Figure 28:
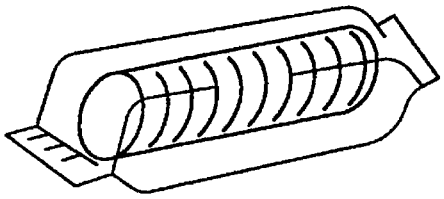
Figure 28:
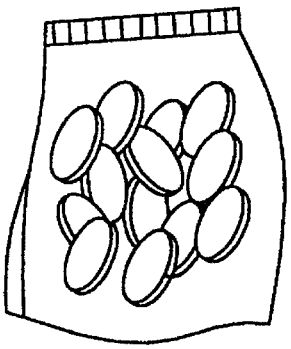

FIG. 28 shows examples of bulk packages, which are not to be construed as limitative. FIG. 28 (A) shows a solid processing agent contained in a cylindrical container. FIG. 28 (B) shows a solid processing agent contained in a soft two-side sealed or three-side sealed bag. FIG. 28 (C) shows a solid processing agent contained in a one-side sealed bag.

Figure 29:
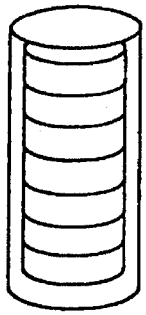
FIGS. 29(A) through (D) are examples of cartridge.
Figure 29:
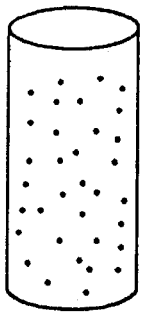
Figure 29:
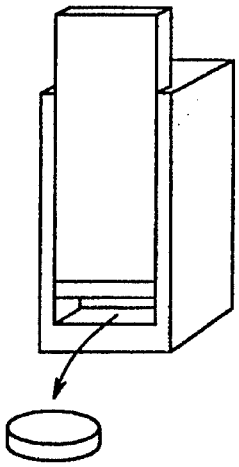
Figure 29:
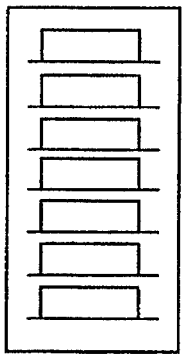
Figure 30:
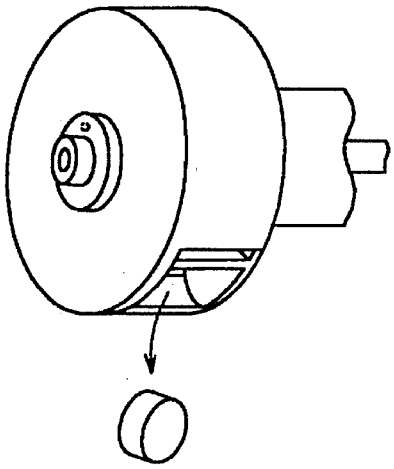
FIGS. 30(A) and (B) are examples of cartridge.
Figure 30:
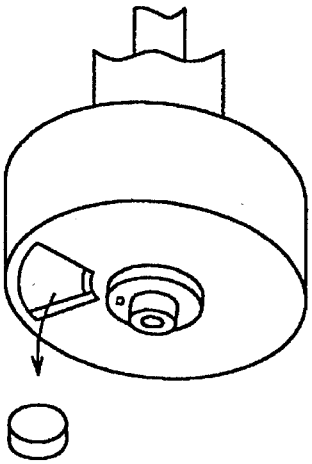

FIGS. 29 and 30 are oblique views of examples of cartridges.

These cartridges may be set onto the supplying apparatus of the automatic processing machine of the present invention as the package material containing the solid processing agent. Any of the above-mentioned compounds can be used as the material therefor, with preference given to a material sufficiently tough to avoid destruction hampering the supply in the case of a decrease in the solid processing agent.

FIG. 29 (A) shows tablets contained in a cylindrical cartridge. FIG. 29 (B) shows granules or powder contained in a cartridge.

FIGS. 29 (C) and (D) are an oblique view and a cross-sectional view showing a state of a solid processing agent contained in a box cartridge with a lid.

FIG. 30 shows states in which tablets, granules or powder is contained in a rotatable container equipped with a partition board, which container is contained in an outer cylinder, and a given amount is dropped via the opening. FIG. 30 (A) shows the type wherein the shaft is horizontally supported. FIG. 30 (B) shows the type wherein the shaft is vertically supported.

The present invention is by no means limited to these examples.

Other examples are described below with reference to FIGS. 31 (*a*) and (*b*), 32 (*a*) and (*b*), 33, 34 and 35.

Figure 31:
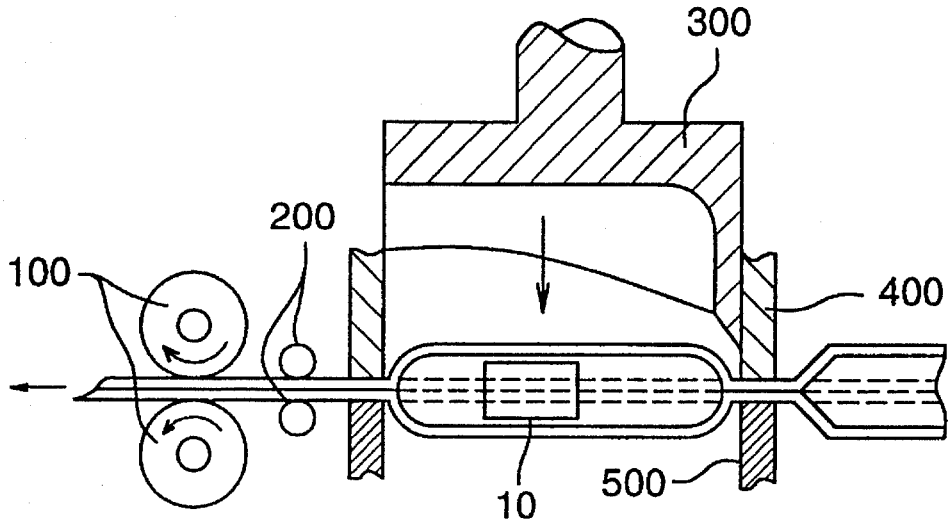
FIGS. 31 (A) and (B) are apparatuses for cutting a package in a "⊐" shape.
Figure 31:
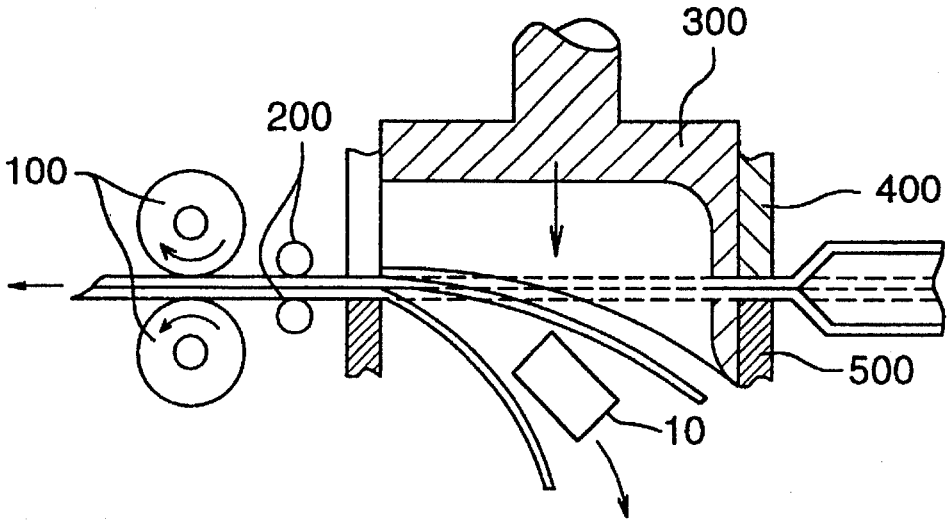

FIGS. 31 (*a*) and (*b*) show the "⊐"-shaped punching method.

When a given amount of light-sensitive material has been processed as detected by the processing amount information detecting means, the processing agent supply controlling means passes a signal to activate transport roller 100, whereby package 801 of FIG. 32 (*a*) containing solid processing agent 10 is moved to a position as shown in FIG. 31 (*a*) and stopped there. Package 801 may be moved by any method, including the method in which a notch made in package 801 is detected, the method in which a printed pattern or an eye mark is detected and the method in which processing agent 10 in package 801 is detected; essentially, the required number of units of solid processing agent 10 are detected accurately. Next, as illustrated in FIG. 31 (*b*), puncher 300 descends and cuts package 801, and solid processing agent 10 is added to the processing tank of the automatic processing machine via receiving portion 901 of FIG. 32 (*a*). The cut made by puncher 300 is of a "⊐" shape corresponding to punch shape 601, as illustrated in FIG. 32 (*b*).

In this type, solid processing agent 10 may be in the form of powder, granules or tablets, but solid processing agent 10 preferably has a tablet form, since the chemical is not likely to adhere to the puncher. Other advantages of the tablet form are that stain is not likely because tablets do not adhere to the package, and that tablets are safe in handling by the user. Used package 801 may be disposed in disposal box 102, which is preferably recycled package stocking box 701.

Figure 33:
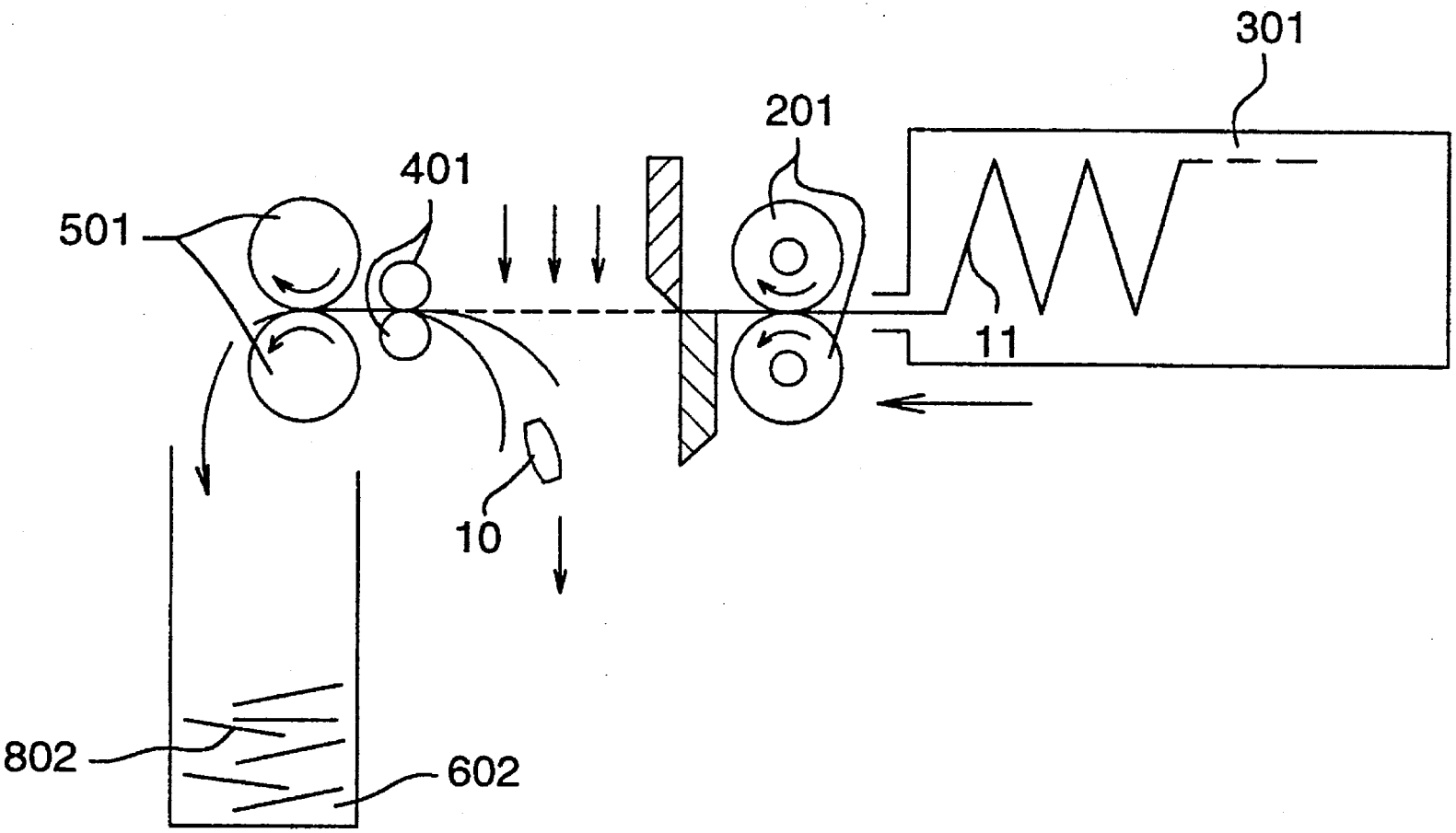
FIG. 33 shows an apparatus for cutting down a package.
Figure 34:
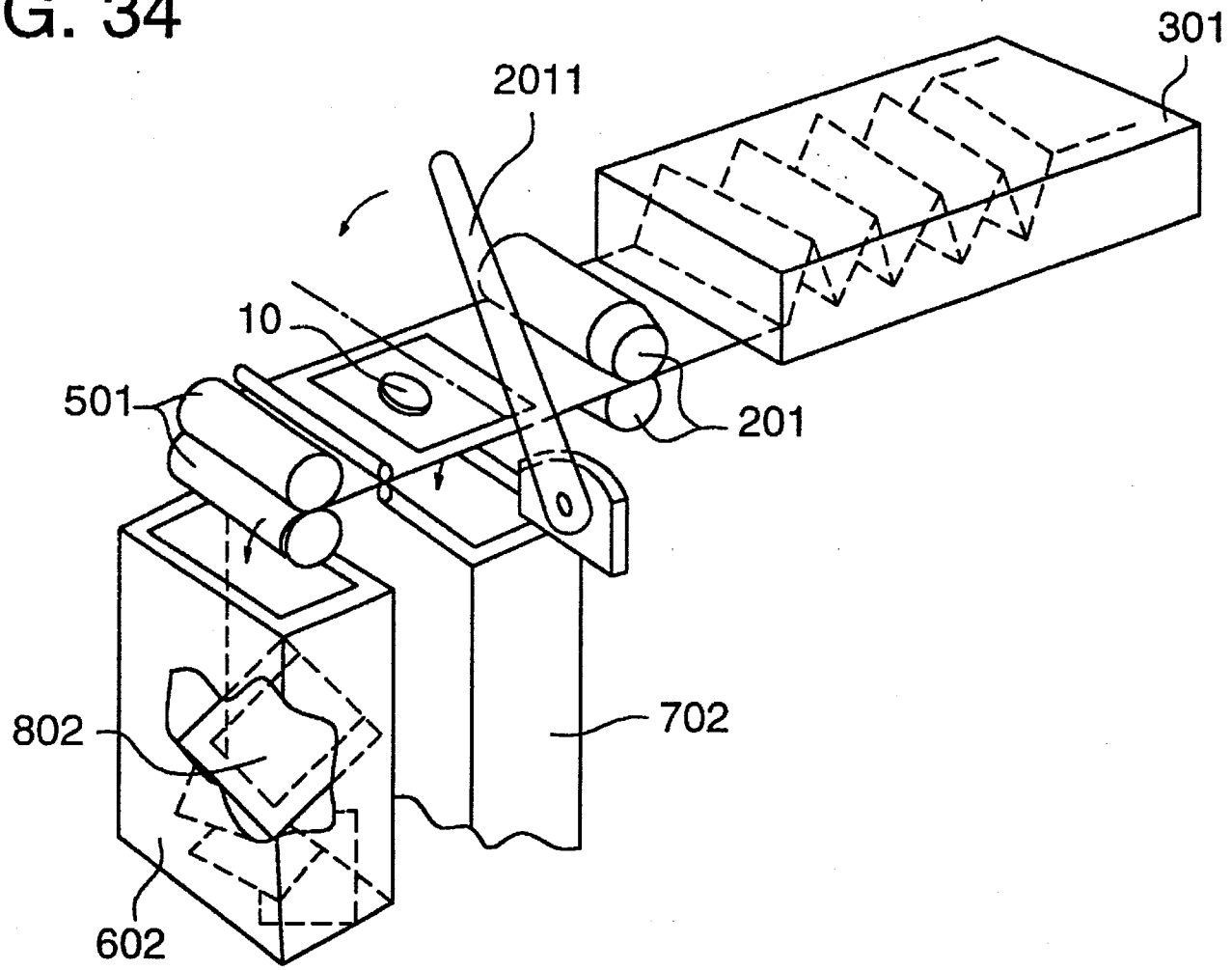
FIG. 34 is an oblique view of the apparatus for cutting down a package of FIG. 33.

FIGS. 33 and 34 show how to cut down package 11.

When a given amount of light-sensitive material has been processed as detected by the processing amount information detecting means, the processing agent supply controlling means passes a signal to activate transport roller 201, whereby package 11 containing solid processing agent 10 is moved to above processing tank filter portion 702 and stopped there. In this operation, the tip of package 11 is in squeezing roller 401.

The package may be moved by any method, including the method in which a notch made in package 11 is detected, the method in which a printed pattern is detected and the method in which the processing agent in package 801 is detected; essentially, the required number of units of solid processing agent 10 are detected accurately. Next, ceramic cutter 201 cuts package 11. Upon completion of cutting, squeezing roller 401 and transport roller 501 rotate, and solid processing agent 10 is passed through the discharge port and added to processing tank filter portion 702 of the automatic processing machine while being squeezed by squeezing roller 401. Cut waste package 802 is discharged via transport roller 501 into disposal box 602, which is preferably recycled package stocking box.

In this type, solid processing agent 10 may be in the form of powder, granules or tablets, but solid processing agent 10 is preferably in a tablet form, since the chemical is not likely to adhere to ceramic cutter 201. Another advantage of the tablet form are that stain is not likely because tablets do not adhere to package 11.

Used package 11 may be disposed in disposal box 602.

Figure 35:
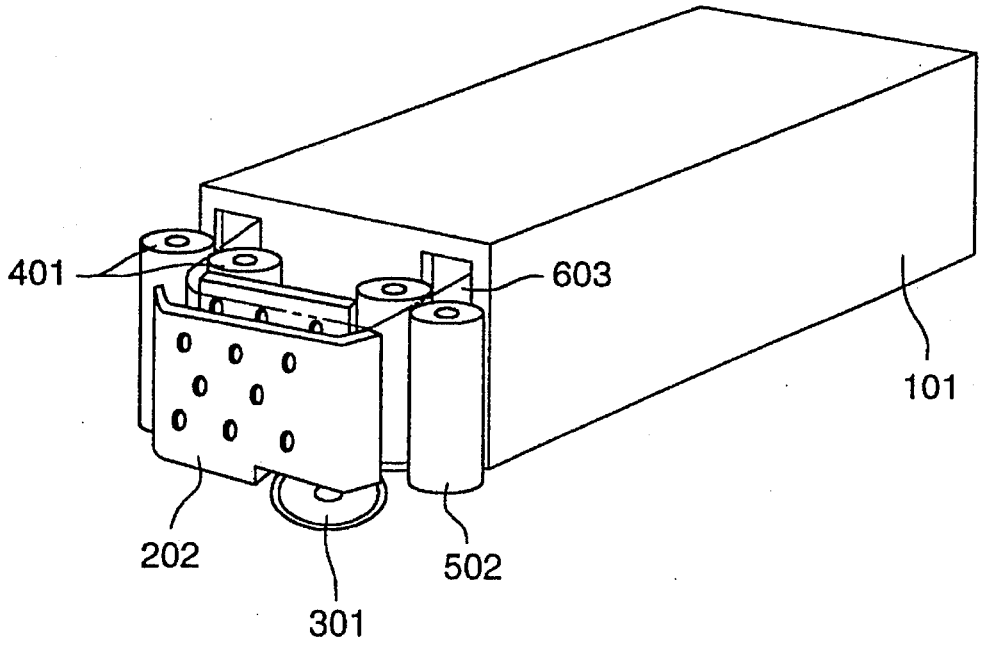
FIGS. 35(A) through (C) show apparatuses for cutting a series of packages in two steps.
Figure 35:
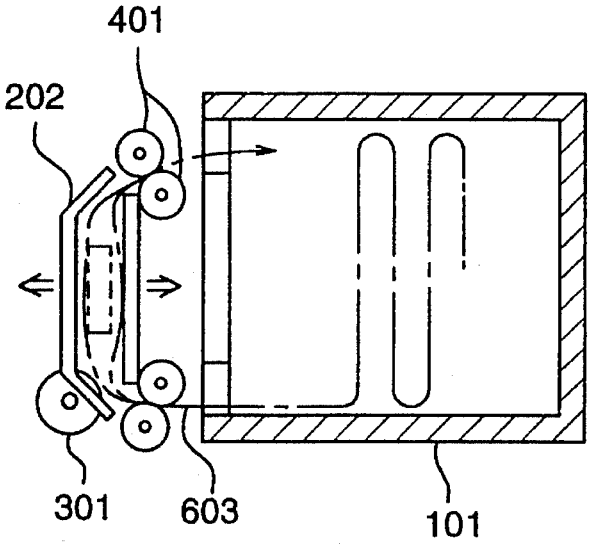
Figure 35:
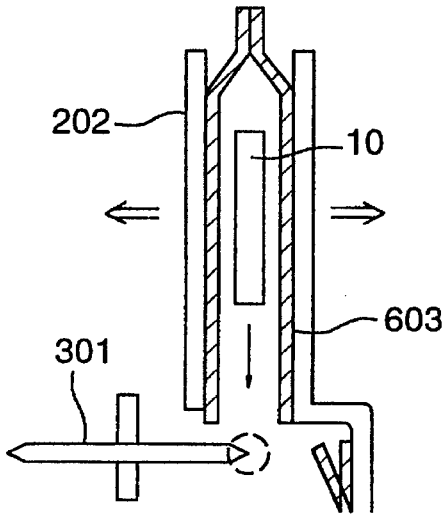

FIGS. 35 (*a*) and (*b*) show how to cut successive package 603 in two steps.

When a given amount of light-sensitive material has been processed as detected by the processing amount information detecting means, the processing agent supply controlling means passes a signal to activate transport roller 502 and simultaneously rotate ceramic or stainless steel round cutter 301 to cut the lower portion of successive package 603 into two portions and add solid processing agent 10. Double-divided package 603 is widened by suction by suction guide 202 to allow easy drop of solid processing agent 10. Emptied package 603 containing no solid processing agent 10 is then moved to package stocking box 101 by transport roller 401 upon addition of the next unit of solid processing agent 10.

For this double division, in addition to the above method, the successive package, provided with a notch etc., may be broken while being wound by a roller.

In this type, solid processing agent 10 may be in the form of powder, granules or tablets, but solid processing agent 10 is preferably in a tablet form, since the chemical is not likely to adhere to the seal of the package. Another advantage of the tablet form is that stain is not likely because tablets do not adhere to the package seal.

Used package 603 may be disposed in package disposal box 101.

Figure 36:
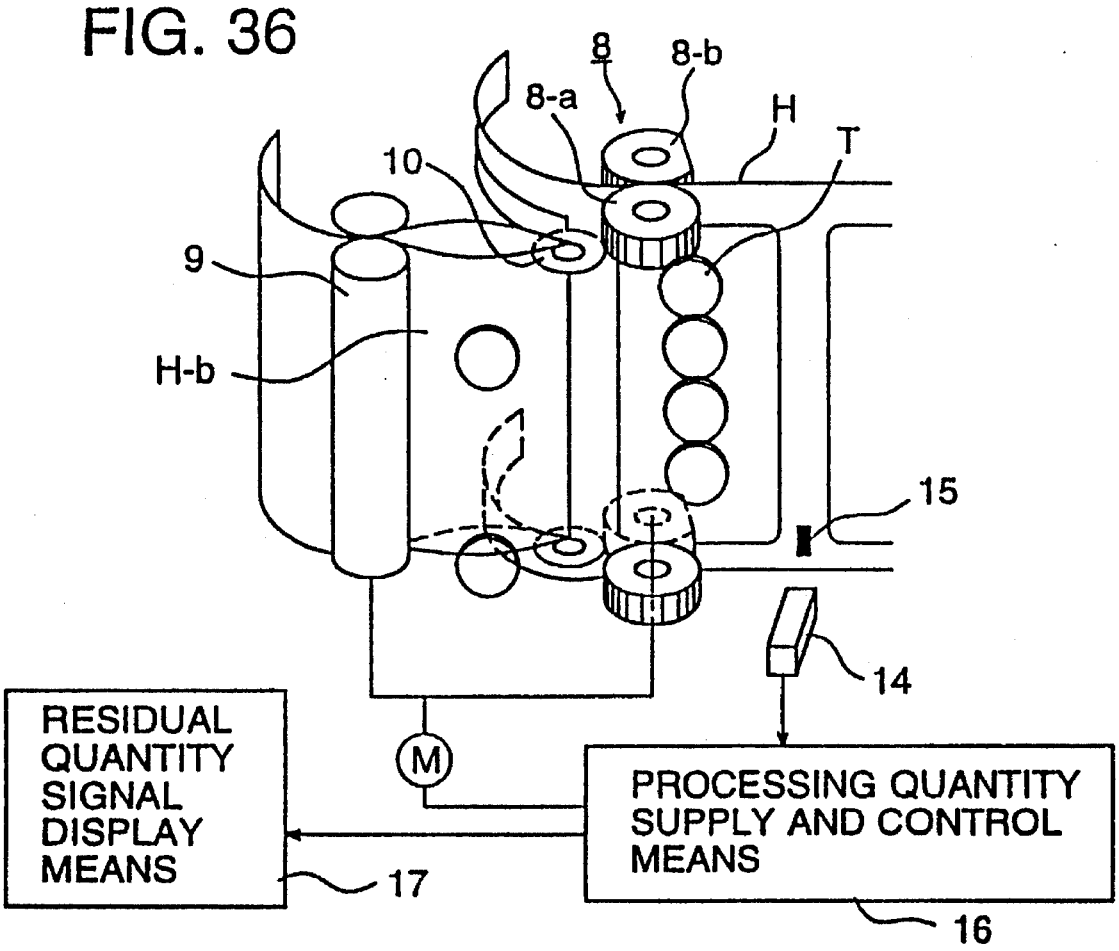
FIGS. 36, 37A, 37B, 38A, 38B and 39A and 39B show a supplying apparatus and a timing of operation of said supporting apparatus wherein each solid processing agent is dropped by cut off the seal portion of a package.

Next, FIG. 37 shows a method wherein processing agents fall preferably after the sealing portion of a package is peeled off. As shown in FIG. 36, swelling of individual packing portion H-b whose top and bottom portions in the figure are opened with their sealing portions separated is amplified to form a larger bulge because remaining beam-shaped sealed portions at both sides of the individual packing portion H-b are brought near to each other by the first transport means 8 and the second transport means 9 whose interrelationship is controlled. Thus, processing agent T is released from being sandwiched and it falls. Guide 12 in FIG. 3 guides belt-shaped processing agent package H when it advances and also regulates the position where the processing agent falls due to the aforementioned bulge. Owing to this, inlet 13 does not need to be extremely large.

In the present example, a disk-shaped rotary cutter is used as cutting means (cutter) 10. However, the invention is not limited only to this. Incidentally, it is preferable, from the viewpoint of safety, that a cutter blade is replaced on the basis of a set which is composed of cutter tip 11.

As shown in FIG. 36, a part of a cylinder of each of rollers 8-*b* and 9-*b* is cut off to form a cutout roller and the distance between two axes of the pair of cutout rollers is fixed. Therefore, when the cutout portion faces roller 8-*a* or roller 9-*a* in the course of rotation of a pair of rollers, nipping force between both rollers dies away and nipping pressure is lowered. Accordingly, the belt-shaped processing agent package H which has been sandwiched can move freely in its plane direction, and thereby it can return to its center when it is skewing.

Detecting means 14 in FIG. 36 detects portion to be detected 37 of each individual package recorded on the edge of processing agent package H and sends signals to processing quantity supply control means. 16, thus controls a motor to drive the first transport means 8 and the second transport means 9. It is also shown that it is used also as residual quantity indication.

Figure 37A:
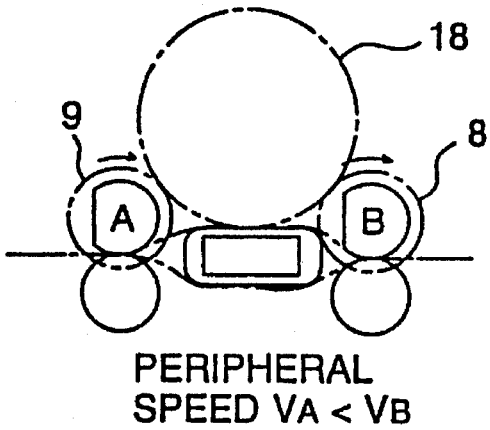

Next, there will be explained, referring to FIG. 37, how a bulge is formed in belt-shaped processing agent packages by the difference of transporting speed between the first and second transport means 8 and 9 wherein the transporting speed of the second transport means 9 is lower than that of the first transport means 8. In FIG. 37A, a gear affixed on the roller shaft of the first transport means 8 is the same as that affixed on the roller shaft of the second transport means, and these gears are engaged with common gear 18 to be driven simultaneously. Therefore, with regard to the rotation speed of the shaft, both transport means are the same. However, a diameter of each of rollers 9-*a* and 9-*b* in the second transport means 9 is smaller than that of the roller in the first transport means 8. Accordingly, the peripheral speed in the second transport means 9 is lower and the transporting speed is consequently lower than that in the first transport means 8.

Figure 37B:
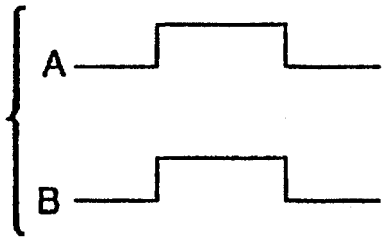

A timing chart in FIG. 37B shows that the first transport means and the second transport means are driven simultaneously.

Figure 38A:
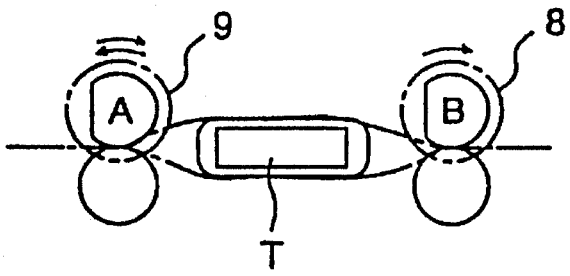
Figure 38B:
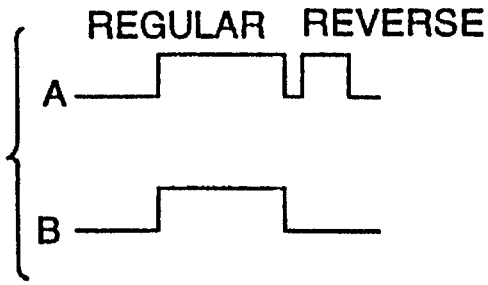

Next, FIG. 38A shows an example wherein the second transport means 9 is driven reversely temporarily after being driven simultaneously with the first transport means 8. In the example wherein the transporting speed of the first transport means 8 is the same as that of the second transport means 9, belt-shaped processing agent package H is returned to be slackened by the reverse rotation of the second transport means 9 that is driven reversely after suspension, and thereby a portion sandwiching processing agent T swells to release the processing agent T. FIG. 38B is a timing chart showing the timing of a temporary reverse driving of one of the transparent means in a direction.

Figure 39A:
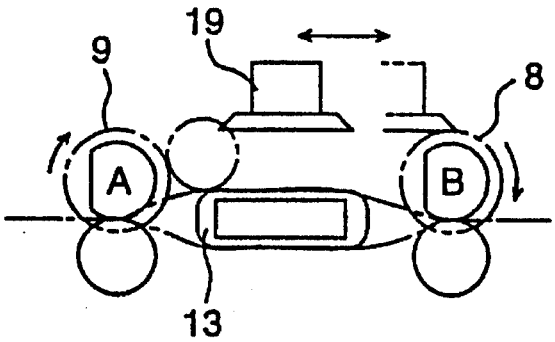
Figure 39B:
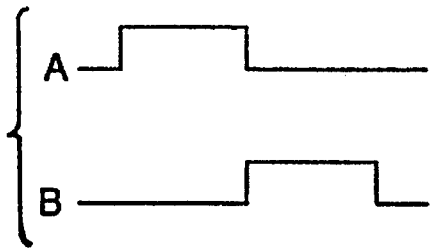

Next, FIG. 39A shows an example wherein phase of an action of the first transport means 8 is caused to be different from that of the second transport means 9 are changed. The first transport means 8 is first driven by movable driving source 19 and then the second transport means 9 is driven later as shown in FIG. 39B. Therefore, a preceding beam-shaped sealed portion of an individual packing portion in belt-shaped processing agent package H whose sealing portions at both sides have been peeled off arrives at and stopped by the second transport means 9 which is not driven yet. Therefore, the processing agent package H is slackened and an individual packing portion is swells to release processing agent T.

Figure 40:
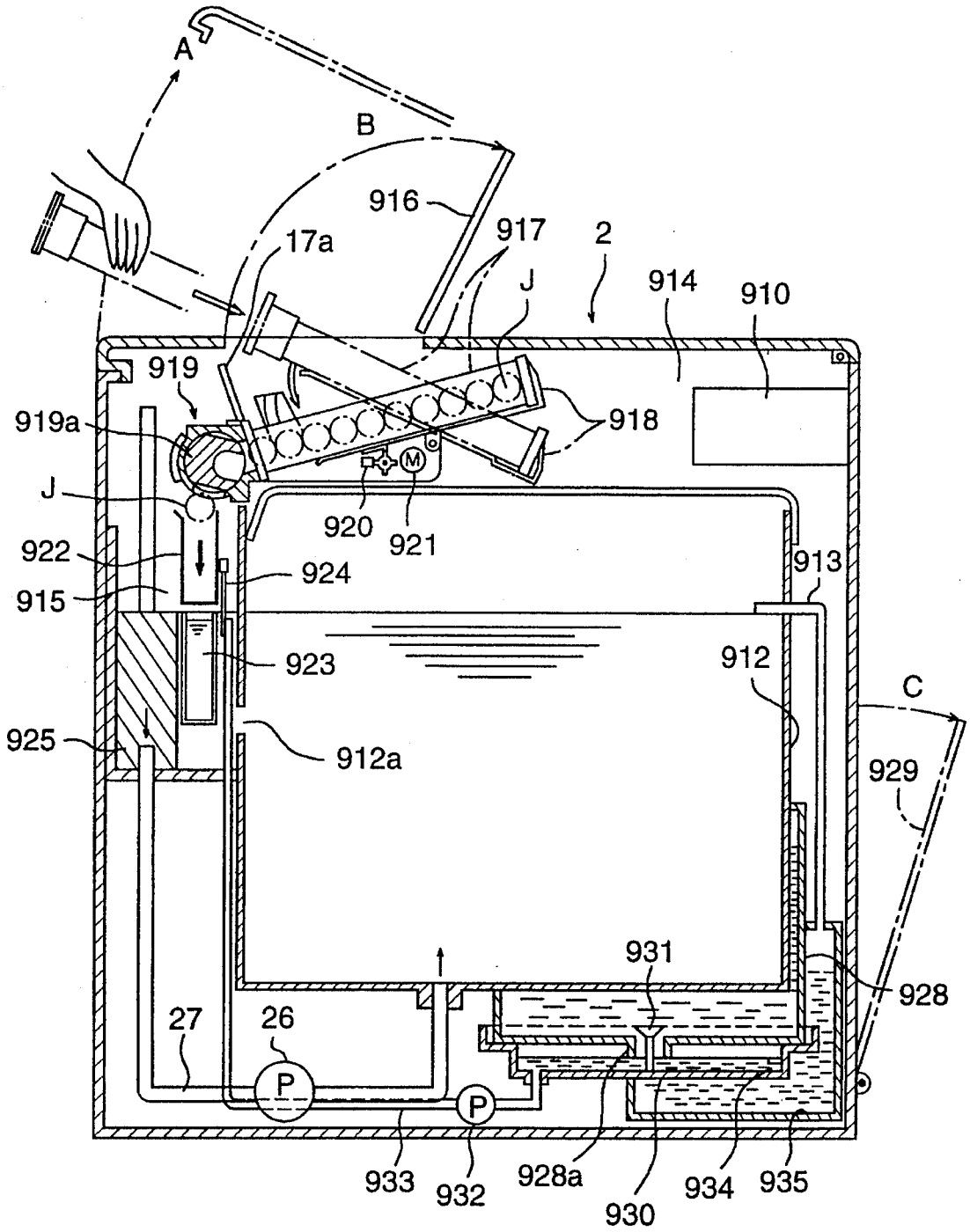
FIG. 40 shows another supplying method of a solid processing agent.

In FIG. 40, the numeral 912 is a processing tank corresponding to color developing tank 1A, bleach-fixing tank 1B or stabilizing tanks 1C, 1D and 1E, and pressure-sandwiching transport roller train is not illustrated. The numeral 913 is a overflow pipe, and it is connected to individual or common waste fluid tank 935 when processing tank 912 is color developing tank 3 or bleach-fixing tank 4, while it is connected to stabilizing tank 6 when processing tank 12 is stabilizing tank 7, and it corresponds to communication pipe 976. An overflow pipe as that mentioned above is naturally provided also on stabilizing tank 5 that is a last tank for the flow of a stabilizing solution.

The numeral 914 is a solid processing agent replenishing section corresponding to each of 17, 140 and 200, and the numeral 915 is a processing solution preparation section. Solid processing agent container 917 is attached on or detached from the solid processing agent replenishing section 914 as shown with one-dot chain lines, when partial door 916 provided rotatably on a machine frame top plate of the main portion of an automatic processing machine as shown with B-arrowed lines is opened.

The solid processing agent container 917 is placed on loading stand 918 provided in a swingable manner on the processing agent replenishing section 914, and when the loading stand 918 is swiveled counterclockwise from the position shown with one-dot chain lines to the position shown with solid lines, feed-end door 917a of the solid processing agent container 917 is opened and a feed-end fits an accepting end of separating/feeding device 919, thus the solid processing agent container 917 is set. Information of the setting is inputted in control unit 910 from set-detection means 920.

On the other hand, as stated above, processing amount information is inputted in control unit 10 from light-sensitive material sensor 11 provided on a light-sensitive material feeding-out section of light-sensitive material supply device 1. Then, the control unit 10 drives supply motor 21 based on the information of setting and processing amount information both mentioned above, to rotate supply rotor 919a of the separating/feeding device 919. Each time the supply rotor 919a makes one turn, one piece of tablet J of processing agent rolls in a processing agent accepting cavity provided on the supply rotor 919a, and the tablet J falls on dissolving portion 923 of processing solution preparation section 915 from the processing agent accepting cavity through chute 922.

Incidentally, the solid processing agent container 917 may either be one wherein tablets J are housed in a plurality of rows, and a plurality of processing agent accepting cavities corresponding to the plural rows are provided on the supply rotor 919*a*, and plural tablets J fall simultaneously or one or plural tablets fall for the predetermined rotating angle of the supply rotor when it makes one turn, or be one wherein the supply rotor 919a is provided on its peripheral direction with plural processing agent accepting cavities so that plural tablets may fall in a single rotation of the supply rotor. Or, it may be one wherein processing agent is in s form of powder or granule, and an appropriate amount of them can be supplied intermittently according to the processing amount of light-sensitive materials. However, from the viewpoint of stable replenishment of processing agents in a simple means, a tablet that can roll as mentioned above is preferable.

Incidentally, from the viewpoint of obtaining stable processing by preventing moisture-absorption of solid processing agents while enjoying a merit of miniaturization achieved by replenishment of solid processing agents, it is preferable that a housing chamber that houses solid processing agents or solid processing agent packages and an inlet for solid processing agents are made to be a dehumidified space.

The dehumidified chamber in this case is a space where humidity is kept to be lower than that in the surrounding space by an action of a dehumidifying means. When the dehumidifying power of a dehumidifying means to be used is high, the space does not necessarily need to be airtight perfectly.

When the space is airtight perfectly, moisture entering from the outside can be prevented and thereby the load for a dehumidifying means is light, which is preferable. However, due to opening and closing for housing and ejecting solid processing agents, moisture enters through the portion communicating with the outside. Therefore, the capacity of the dehumidifying means is established to be high, and dehumidifying is carried out after the space is closed. With regard to the capacity required for the dehumidifying means, it is not specified in the invention because it is to be appropriately selected depending on the size of the space and the level of dehumidification.

The solid processing agent inlet mentioned above means an entire solid processing agent adding means having functions to house solid processing agents for replenishment and to eject solid processing agents in fixed quantity based on a command of a control means.

The dehumidifying means in this case is represented by one that keeps the space on the dried state such as those including a method by means of desiccant which is installed in the space and adsorbs moisture, a method by means of a membrane module that catches moisture entering the space, a method which forces air in the space to raise internal pressure and prevents a moist atmosphere from entering from the outside, and a method that blows dried air in the space, and known methods are used. The reasons for employing a dehumidifying means in particular lie in the following circumstances; a solid processing agent inlet is installed over a processing tank or in the vicinity thereof for achieving simple structure requiring no complicated transport mechanism, and thereby solid processing agents are surrounded by a moist atmosphere containing moisture evaporating from a heated processing solution, which requires prevention of moisture-adsorption; it is necessary to prevent that a moist solid processing agent with its surface destroyed being transported sticks not only to a housing section but also to a transport path related to adding; and dew condensation needs to be prevented for supporting that solid processing agents are stably added.

Figure 41:
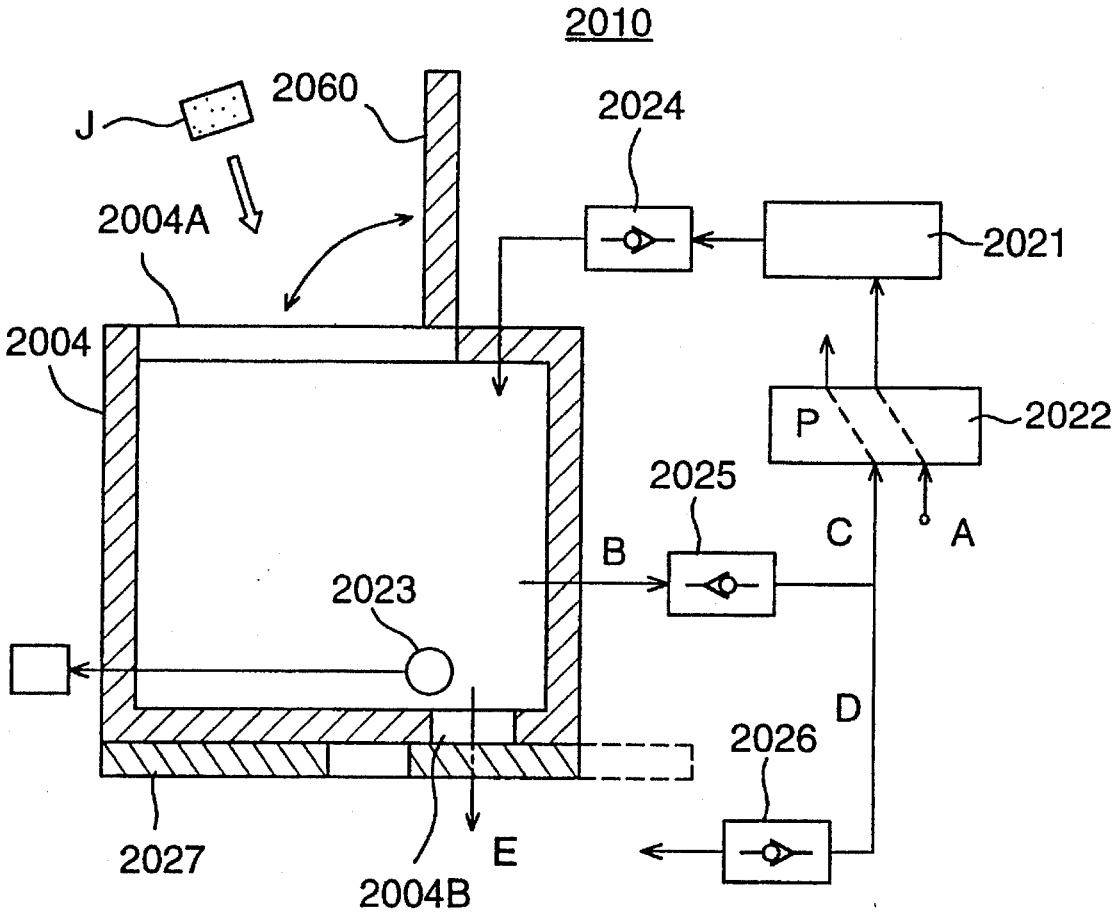
FIG. 41 shows the constitution of the dehumidifier.

An example wherein a method of blowing in dried air is employed as dehumidifying means 2010 will be explained as follows, referring to FIGS. 41 and 42. FIG. 41 represents a block diagram of a dehumidifying means and FIG. 42 represents a flow chart for the process of blowing in dried air.

Figure 42:
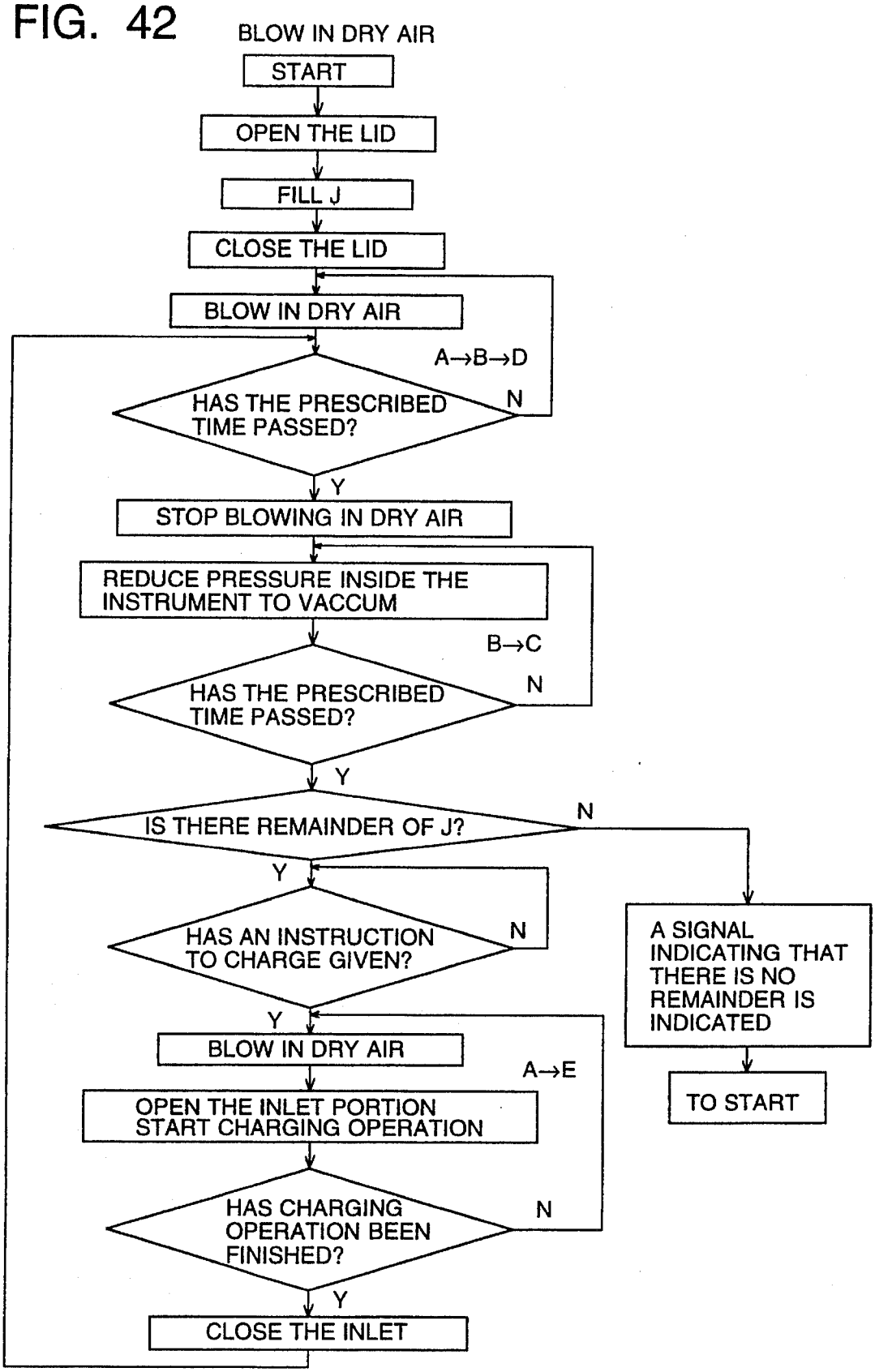
FIG. 42 is a flow chart explaining the work of the dehumidifier.

Dried air is blown into solid processing agent inlet 2004 by both dry air generating means 2021 and compressor 2022, and internal pressure in the solid processing agent inlet 2004 can be caused to be negative by the compressor 2022 in the structure thereof, and its operations are shown in FIG. 42.

In FIG. 42, closing and opening lid 2060 of the solid processing agent inlet 2004 is opened first, and solid processing agent J is loaded through inlet 2004A, and then the closing and opening lid 2060 is closed. Then, dried air is blown into the solid processing agent inlet 2004 by both the dry air generating means 2021 and the compressor 2022, and the blowing in of dried air is stopped after a predetermined period of time. After that, the compressor 2022 sucks air from the processing agent inlet 2004 to keep the negative pressure for the predetermined period of time. Solid processing agent residual amount detecting means 2023 detects an amount of residual solid processing agents, and when no residual solid processing agent is detected, signals representing that there is no residual solid processing agent are generated to urge reloading.

When there are residual solid processing agents, solid processing agents J are added based on the command for adding. Before adding, however, dry air generating means 21 and compressor 2022 are operated to blow dried air into solid processing agent inlet 2004, and then, sliding lid 2027 is moved to open inlet 2004B for carrying out the operation of adding solid processing agent J.

Then, after completion of the operation of adding solid processing agent J, the inlet 2004B is closed for blowing in dried air for the predetermined period of time. After the operation of blowing in is stopped, operation for generating negative pressure is carried out again.

Owing to the constitution mentioned above, there is no chance for solid processing agent J to be placed in the moist atmosphere.

Incidentally, check valves 2024, 2025 and 2026 shown in FIG. 41 are valves by which the flow in the arrowed direction is allowed but that in the opposite direction is not allowed. Each of A, B, C, D and E shown in the figure represents a path for air.

(Example 9)

Automatic processing machines wherein floating lids on automatic processing machines (FIGS. 1–7) used in Example 1 were adjusted to change numerical apertures of color developing tanks to be those shown in Table 18 were used for processing for the period of one month under the conditions in Example 3. Then, color papers subjected to wedge exposure were processed, and the maximum density for blue and density on unexposed area were measured. The summarized results are shown in Table 18. Incidentally, there was no significant difference in sulfuration of blix and in dissolved state of replenisher.

TABLE 18

| Experiment No. | Aperture area ($cm^2/l$) | Maximum density of blue | Density of blue on unexposed area | Remarks |
|---|---|---|---|---|
| 9-1 | 100 | 1.90 | 0.10 | Solid processing agent was not dissolved sufficiently, affecting maximum density, and frequent replacement of filter was required. Tarring was observed in color developing tank. |
| 9-2 | 55 | 2.17 | 0.05 | Undissolved solid processing agent was observed. Slight tarring was observed in color developing tank. |
| 9-3 | 15 | 2.19 | 0.05 | Slight undissolved solid processing agent was observed. |
| 9-4 | 12 | 2.26 | 0.02 | No problem |
| 9-5 | 10 | 2.29 | 0.01 | No problem |
| 9-6 | 3 | 2.29 | 0.01 | No problem |
| 9-7 | 2 | 2.29 | 0.01 | Slight crystals were formed between wall and processing solution and they adhered to light-sensitive material slightly. |

TABLE 18-continued

| Experiment No. | Aperture area ($cm^2/l$) | Maximum density of blue | Density of blue on unexposed area | Remarks |
|---|---|---|---|---|
| 9-8 | 1 | 2.29 | 0.01 | Crystals were formed between wall and processing solution and they damaged light-sensitive material slightly. |

The table indicates that stable photographic characteristics can be obtained when an aperture area on an unexposed portion is not more than 12 $cm^2/l$. It is also indicated that background whiteness is better than blue density on an unexposed portion. The aperture area of not more than 13 $cm^2/l$ is further better. However, when the aperture area is 2 $cm^2/l$ or less, there is no clearance through which a light-sensitive material is transported, and crystals in extremely small quantities existing between a wall and a processing solution damage the light-sensitive material, which is a problem as a product.

(Example 10)

As a mold-preventing means, following means were used in a water-replenishing tank of warm water replenishing device 32 in FIG. 4, and experiments identical to those in Example 3 were made.

(1) Ethylenediaminetetraacetic acid in quantity of 0.5 g/l was added.

(2) 1,2-benzisothiazoline3-on in quantity of 0.1 g/l was added.

(3) 5-chloro-2-methyl-4-isothiazoline3-on in quantity of 0.1 g/l was added.

(4) Water subjected to ion-exchange treatment wherein DIAION SK1B (strongly acidic ion-exchange resin, made by Mitsubishi Kasei) and DIAION PA406 (OH type strongly basic anion-exchange resin, made by Mitsubishi Kasei) were mixed at a volume ratio of 1:1 was used.

(5) A UV irradiation device made by Kindai-Baio Lab was used.

(6) Bio-sure SGD (made by Kinki Pipe Lab.) in quantity of 1 g/l was added.

(7) As a comparison, experiments were made without using a mold-preventing means.

The results were exactly the same except Item (7). Further, the inside of a water-replenishing tank was observed visually. The results of the observation were satisfactory except Item (7) in which something like an alga was produced on the surface and on a wall portion. In Item (7), streaks, uneven desilvering and contamination were caused. The reason for this is considered to be that suspended substances in the water-replenishing tank entered each processing tank and adhered to a light-sensitive material.

(Example 11)

Automatic processing machines wherein circulation pumps were adjusted or replaced and thereby circulation amounts were changed to those shown in the following table in automatic processing machines (FIGS. 1–7) used in Example 1 were used for processing for the period of three days under the conditions in Example 3. The state of processing tanks and that of processed light-sensitive materials were observed.

| Experiment No. | Amount of circulation (cycle/min) | Processing tank | Light-sensitive material |
|---|---|---|---|
| 11-1 | 4.0 | Undissolved solid processing agent and scum both in extremely small amount were observed. | Latitude was slightly narrow on photographs. |
| 11-2 | 3.0 | Though scum was observed, it was not problematic at all. | Quality problem was hardly observed. |
| 11-3 | 2.0 | No problem at all | No problem at all |
| 11-4 | 1.0 | No problem at all | No problem at all |
| 11-5 | 0.8 | No problem at all | Quality problem was hardly observed. |
| 11-6 | 0.6 | Slightly longer time was required for dissolution of solid processing agents. | Uneven density was observed on images. |
| 11-7 | 0.4 | Slightly longer time was required for dissolution of solid processing agents. | Uneven density which is problematic as a product was observed. |

From the foregoing, it is understood that occurrence of undissolved solid processing agent and scum and reduction of latitude can be prevented with circulation amount of 3.0 cycles/min or less, and dissolution of solid processing agent and uneven density of light-sensitive materials can be prevented with circulation amount of 0.8 cycles/min or more.

As described above, the automatic processing machine for silver halide photographic light-sensitive materials of the present invention offers constant photographic performance by adding a previously separately weighed solid processing agent directly to the processing tank and dissolve it therein, compensating the lacked or dissolved components by the photographic material and separately supplying the required amount of replenishing water as necessary.

The necessity of replenisher preparing operation at given intervals by the user as in the prior art, and processing solution performance is kept constant by automatically adding the solid processing agent according to the amount of photographic material processed solely by presetting the solid processing agent.

Another advantage is system size reduction in the case of color negative film processing; a 40 to 50 liter of replenisher tank volume is saved, since four or five kinds of processing solutions are required. Also, a complete solution is offered to the critical problem of low storage stability of replenishers in this age of the tendency toward lower replenishing rates, when a 10-liter replenisher is used over a period of over 1 months, in contrast to the prior art, wherein 2 weeks of storage stability is sufficient for a replenisher in a replenisher tank with a lid.

Prepared to meet the current demand for low replenishing rates, all replenishers as 1.4 to 2 times dense as the tank solutions, since the chemical is concentrated up to its maximum solubility, indicating supersaturation. This poses problems of crystal separation and tar formation in winter storage, which can damage the photographic material processed. These problems have been totally solved by the present invention.

Accordingly, the present invention involves the use of nothing other than as thin solutions as the processing tank solution. This is because basically the replenisher never exceeds the processing tank solution in concentration, since the solid processing agent is used to compensate the shortage only.

For the reason described above, the conventional replenishing methods do not allow replenishing rate reduction because the concentration of replenisher is limited by the limit of solubility. Particularly for color developer replenishers for color printing paper and bleach-fixer replenishers, which are too low in stability to allow replenishing rate reduction, the solid processing agent replenishing method of the present invention, which is free of replenishers, allows replenishing rate reduction.

The solid processing agent is not dangerous in transport, so that it does not necessitate the use of tough containers. It is also free of transport safety regulation as for dangerous liquid products, thus permitting simplified packaging. Other advantages are high handling safety and freedom of damage or contamination of the human body or clothing.

However, since the solid processing agent is faulty that much time is required to dissolve it due to difficulty in its dissolution, liquid processing agents are predominant, though solid processing agent kits were common. The present inventors made investigations with an emphasis on this respect, and found that replenishing operation is possible for constant photographic performance free of any problems even when the solid processing agent is dissolved over a long period by adding a small amount of separately weighed solid processing agent directly to a processing solution tank kept at a given temperature. Accordingly, in contrast to the conventional idea of replenisher kits that a replenisher, in complete solution, is stored in a replenishing tank, and is injected to the processing tank as necessary to maintain a constant composition, the present invention has eliminated the troublesome chemical replenisher dissolving operation by the user, replenishing tanks of automatic developers, and dangerous dense liquid chemical kits and conventional chemical bottles containing them by regularly adding a solid processing agent, previously separately weighed according to the information on the amount of processing of silver halide photographic light-sensitive material, to at least part of the processing tank kept at a constant temperature and supplying a given amount of replenishing water periodically to part of the processing tank as necessary, and the absence of replenishing tanks makes it possible to markedly improve processing stability owing to remarkable improvement in the life time of processing solutions.

In another currently available method, known as AR replenishment, the replenisher is prepared in solution before using, and dense solution kit elements A, B and C and replenishing water are supplied by direct collection by a bellows constant discharge pump. The four components are added before mixing them, rather than separately added directly to the processing tank. This has not been attempted with a solid processing agent.

In the automatic processing machine of the invention, circulation of processing solution is stopped after a predetermined period of time from the moment when a light-sensitive material transport means stops running on the occasion of stoppage after termination of processing of a light-sensitive material Owing to this, it is possible to prevent that circulation is stopped with undissolved processing agents, and there can be obtained an effect that deterioration of processing solutions and increase of power consumption can be restrained.

What is claimed is:

1. An apparatus for processing a light-sensitive silver halide photographic material, comprising:

a processing tank for containing a processing solution, the processing tank including a processing section to process the light-sensitive silver halide photographic material, a supplying section, and circulating means for circulating the processing solution between the processing section and the supplying section;

solid agent replenishing means for storing a solid agent and for replenishing the solid agent to the supplying section of the processing tank so that the solid agent is supplied to the processing section through the supplying section by the circulating means;

detection means for detecting an amount of processed light-sensitive silver halide photographic material;

control means for controlling the solid agent replenishing means so as to cause the solid agent replenishing means to replenish the solid agent in accordance with the detected amount of processed light-sensitive silver halide photographic material; and water-replenishing means for replenishing water to the processing tank; and wherein the circulating means continues circulation of the processing solution for a predetermined time period after a processing of photographic material has been completed.

2. The apparatus of claim 1, wherein an amount of the solid agent supplied at one time is 0.1 to 50 g.

3. The apparatus of claim 1, wherein the solid processing agent comprises granules produced by a granulating process.

4. The apparatus of claim 1, wherein the solid processing agent comprises tablets produced by a tablet-making process.

5. The apparatus of claim 1, wherein the processing tank further includes a solid processing agent receiving section communicated with the processing section, and wherein the circulating means circulates the processing solution between the processing section and the solid agent receiving section.

6. The apparatus of claim 5, wherein the processing tank further includes a separation means for separating the processing section from the solid agent receiving section so that an insoluble component of the solid processing agent is prevented from entering into the processing section.

7. The apparatus of claim 6, wherein the separation means comprises a filter.

8. The apparatus of claim 6, wherein the processing section includes a developing tank, a fixing tank and a stabilizing tank, and each of the tanks of the processing section is provided with the solid agent replenishing means and the control means.

9. The apparatus of claim 1, wherein the processing section includes a developing tank, a bleach-fixing tank, and a stabilizing tank, and each of the tanks of the processing section is provided with the solid agent replenishing means and the control means.

10. The apparatus of claim 1, further comprising a heater to heat the processing solution so as to maintain a temperature of the processing solution within a predetermined range while the circulating means is continuing the circulation.

11. The apparatus of claim 1, wherein the control means further controls the circulating means so as to circulate the processing solution 0.5 to 2.0 times/minute.

* * * * *